US008240770B2

(12) United States Patent
Bertele

(10) Patent No.: US 8,240,770 B2
(45) Date of Patent: Aug. 14, 2012

(54) THREE-DIMENSIONAL ARTICLE PRODUCED FROM SHEET MATERIAL

(75) Inventor: Nitzàn Bertele, Tel Aviv (IL)

(73) Assignee: Crembo Color Design Ltd. (Krooom), Netanya (IL)

( * ) Notice: Subject to any disclaimer, the term of this patent is extended or adjusted under 35 U.S.C. 154(b) by 8 days.

(21) Appl. No.: 12/542,753

(22) Filed: Aug. 18, 2009

(65) Prior Publication Data

US 2010/0096964 A1 Apr. 22, 2010

Related U.S. Application Data

(63) Continuation-in-part of application No. 11/648,799, filed on Jan. 3, 2007, now Pat. No. 7,625,047.

(30) Foreign Application Priority Data

Aug. 6, 2009 (IL) ..... 200287

(51) Int. Cl.
*A47C 7/02* (2006.01)

(52) U.S. Cl. ..... 297/440.12

(58) Field of Classification Search ..... 297/440.12
See application file for complete search history.

(56) References Cited

U.S. PATENT DOCUMENTS

| | | | | |
|---|---|---|---|---|
| 2,244,605 | A * | 6/1941 | Benoit | 297/440.12 X |
| 2,765,112 | A * | 10/1956 | Derman | 229/122.27 X |
| 3,121,588 | A | 2/1964 | Beckman | |
| 3,178,227 | A | 4/1965 | Snyder | |
| 3,250,570 | A | 5/1966 | Smith | |
| 3,331,634 | A | 7/1967 | Harrison | |
| 3,336,608 | A | 8/1967 | Lerner | |
| 3,463,546 | A * | 8/1969 | Giebel | 297/440.12 |
| 3,566,808 | A | 3/1971 | Slate et al. | |
| 3,608,916 | A * | 9/1971 | Halko et al. | 297/440.12 |
| 3,640,575 | A | 2/1972 | Dosi | |
| 3,717,377 | A * | 2/1973 | Johnson | 297/440.12 |
| 3,727,979 | A | 4/1973 | Schier et al. | |
| 3,729,244 | A | 4/1973 | Butler | |
| 3,837,719 | A | 9/1974 | Barron | |
| 3,861,579 | A | 1/1975 | Manis et al. | |
| 3,866,550 | A | 2/1975 | Geschwender | |
| 4,067,615 | A | 1/1978 | Gehry | |
| 4,085,970 | A | 4/1978 | Klein | |
| 4,340,251 | A | 7/1982 | Geoffroy-Dechaume | |
| 4,509,645 | A | 4/1985 | Hotta | |
| 4,546,941 | A | 10/1985 | Hildebrand | |
| 4,648,658 | A | 3/1987 | Calco | |
| 4,813,744 | A | 3/1989 | Scalisi et al. | |
| 4,841,882 | A | 6/1989 | Ehrman | |
| 4,875,737 | A | 10/1989 | Cardenas | |

(Continued)

FOREIGN PATENT DOCUMENTS

| | | |
|---|---|---|
| AT | 384538 | 5/1987 |

(Continued)

*Primary Examiner* — Rodney B White

(57) ABSTRACT

A three-dimensional article produced from sheet material and comprising a frame unit having a plurality of outer sides made of sheet material each of which having a different angular disposition is provided. First and second longitudinal ends of the frame unit are interconnected by a female fastener embedded in the first end and by a male fastener introduced through the second end and coupled with the female fastener. A kit for assembling the three-dimensional article comprising a plurality of expandable separate members made from sheet material and set in a flat condition is also provided.

15 Claims, 50 Drawing Sheets

U.S. PATENT DOCUMENTS

| | | | | |
|---|---|---|---|---|
| 4,934,756 | A | | 6/1990 | Webb et al. |
| 4,984,848 | A | | 1/1991 | Scalisi et al. |
| 5,273,169 | A | | 12/1993 | Maglione |
| 5,382,081 | A | | 1/1995 | Henry |
| 5,682,623 | A | | 11/1997 | Fenoglio |
| 5,697,675 | A | | 12/1997 | DeWitt et al. |
| 5,795,027 | A | | 8/1998 | Howard et al. |
| 5,855,412 | A | * | 1/1999 | Smith et al. ..... 297/440.12 X |
| 6,039,243 | A | | 3/2000 | Lickton |
| 6,048,032 | A | | 4/2000 | Stewart |
| 6,083,580 | A | | 7/2000 | Finestone et al. |
| 6,161,901 | A | | 12/2000 | Avner |
| 6,206,473 | B1 | | 3/2001 | Kondratiev |
| 2008/0155944 | A1 | | 7/2008 | Bertele |

FOREIGN PATENT DOCUMENTS

| | | |
|---|---|---|
| DE | 1966824 | 3/1967 |
| FR | 2848794 | 6/2004 |
| WO | 2011/016021 | 2/2012 |

* cited by examiner

THREE-DIMENSIONAL ARTICLE PRODUCED FROM SHEET MATERIAL

REFERENCE TO CO-PENDING APPLICATIONS

This application is a Continuation-In-Part of U.S. patent application Ser. No. 11/648,799, filed on Jan. 3, 2007; and furthermore claims priority to Israeli patent application serial number 200287, filed on Aug. 6, 2009.

FIELD OF THE INVENTION

The present invention relates to the field of assembly kits. More particularly, the invention relates to three-dimensional articles produced from flat sheet material such as cardboard sheets. The invention is particularly useful for producing various articles of children furniture, and is therefore described below with respect to such an application.

BACKGROUND OF THE INVENTION

Cardboard sheets (e.g. corrugated cardboard sheets), widely used in constructing inexpensive, light-weight containers, have also been used for constructing various articles of furniture, particularly for children, and have also been supplied in kit form for this purpose. Examples of such cardboard kits are described in U.S. Pat. Nos. 4,067,615, 4,934,756 and 6,083,580. However, such kits for making three-dimensional articles, particularly articles of children furniture, have not found widespread use because of the difficulty in producing kits that can be supplied in a compact flat condition for shipping, handling or storage, to be assembled into a three-dimensional article having dimensional stability and structural rigidity, and yet provide a pleasing appearance.

It is an object of the present invention to provide three-dimensional articles produced from sheet material such as cardboard having important advantages particularly with respect to foldability into a compact flat form for storage, shipping or handling as well as dimensional stability and structural rigidity when assembled in the three-dimensional article, and also to provide a pleasing appearance in the assembled article.

It is an additional object of the present invention to provide a kit for use in producing three-dimensional articles from flat sheet material.

Other objects and advantages of the invention will become apparent as the description proceeds.

SUMMARY OF THE INVENTION

The present invention provides a three-dimensional article produced from sheet material, comprising a frame unit having a plurality of outer sides made of sheet material each of which having a different angular disposition, wherein first and second longitudinal ends of said frame unit are interconnected by means of a female fastener embedded in said first end and of a male fastener introduced through said second end and coupled with said female fastener.

The first end of the frame unit comprises a side flap formed with at least one aperture, said side flap being folded and affixed to a base portion of a frame unit side such that the female fastener placed on a predetermined region of said base region is embedded within said side flap while being accessible to the male fastener by means of a corresponding aperture. The second end of the frame unit comprises a side flap formed with at least one aperture, said side flap of the second end remaining in an opened position while its at least one aperture is aligned with the at least one aperture of the folded side flap of the first end and a male fastener introduced through an aperture of the second end is coupled with a corresponding embedded female faster, whereby to form a reinforced connection.

The reinforced connection protrudes from the inner side of the frame unit, to allow the frame unit to be positioned flush with a wall of a room within which it is positioned.

In one aspect, the frame unit comprises a plurality of exterior members, each of which being interconnected by means of a reinforced connection. By virtue of the reinforced connections, none of the edges of an exterior member are visible in an assembled three-dimensional article, to provide an esthetically pleasing appearance. Other advantages of concealing the edges of the exterior members are an increased resistance to humidity or water that tends to penetrate through cut edges, an increased resistance to fire that tends to first ignite the exposed edges of the sheet material, and preventing injury to children by the sharp edges of the sheet material.

In one aspect, at least one expanded stabilizing element is frictionally engaged with inner faces of the frame unit, for increasing the structural strength of the three-dimensional article.

The three-dimensional article is selected from the group consisting of cabinet, table, storage box, wheeled storage box stool, doll house, chair, trunk, bench, wine holder, and file holder.

The present invention is also directed to a kit for assembling a three-dimensional article, comprising a plurality of separate members made from sheet material and set in a flat condition, including one or more first members configured with a side flap in which is embedded at least one accessible female fastener and one or more second members configured with a side flap in an opened position formed with at least one aperture, wherein a male fastener introduced through an aperture of the opened side flap of a second member is coupleable with a corresponding and aligned embedded female faster of a first member, so that when a plurality of said first and second members are serially interconnected such that each of which has a different angular disposition a frame unit is formed.

The fabrication of members with folded, and at times adhesively affixed, side flaps and inward flaps increases the rigidity of the members during storage and shipping, thereby preventing the formation of a convex base portion which would make the assembly of a three-dimensional article a more difficult operation.

DETAILED DESCRIPTION OF PREFERRED EMBODIMENTS

The present invention is a novel three-dimensional article comprising a plurality of interconnected members, each of which is made from sheet material such as corrugated cardboard or plastic. The plurality of members, which are preferably provided in kit form, are initially positioned in a flat condition for increased compactness during storage and transportation and are then expanded during assembly.

Figure 1A:
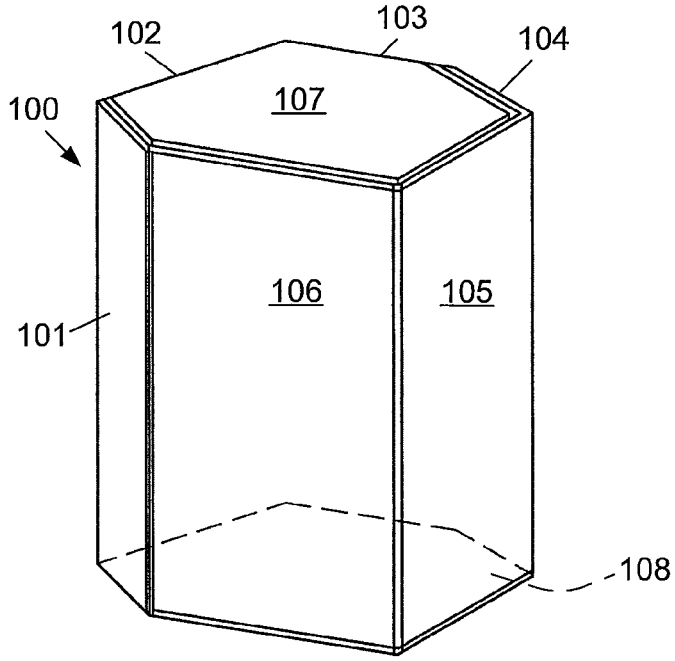
FIGS. 1A-1N illustrate the various components of a kit for assembling a stool, and the various steps in assembling the stool.
Figure 1B:
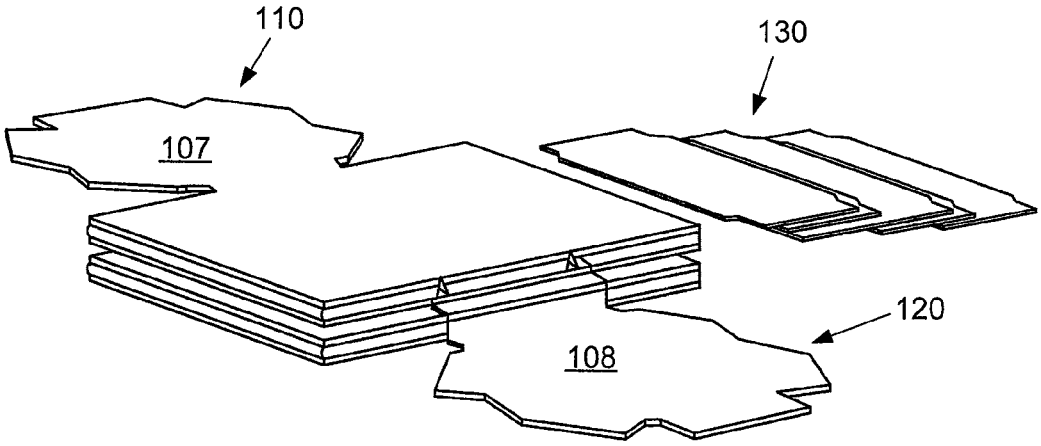
Figure 1C:
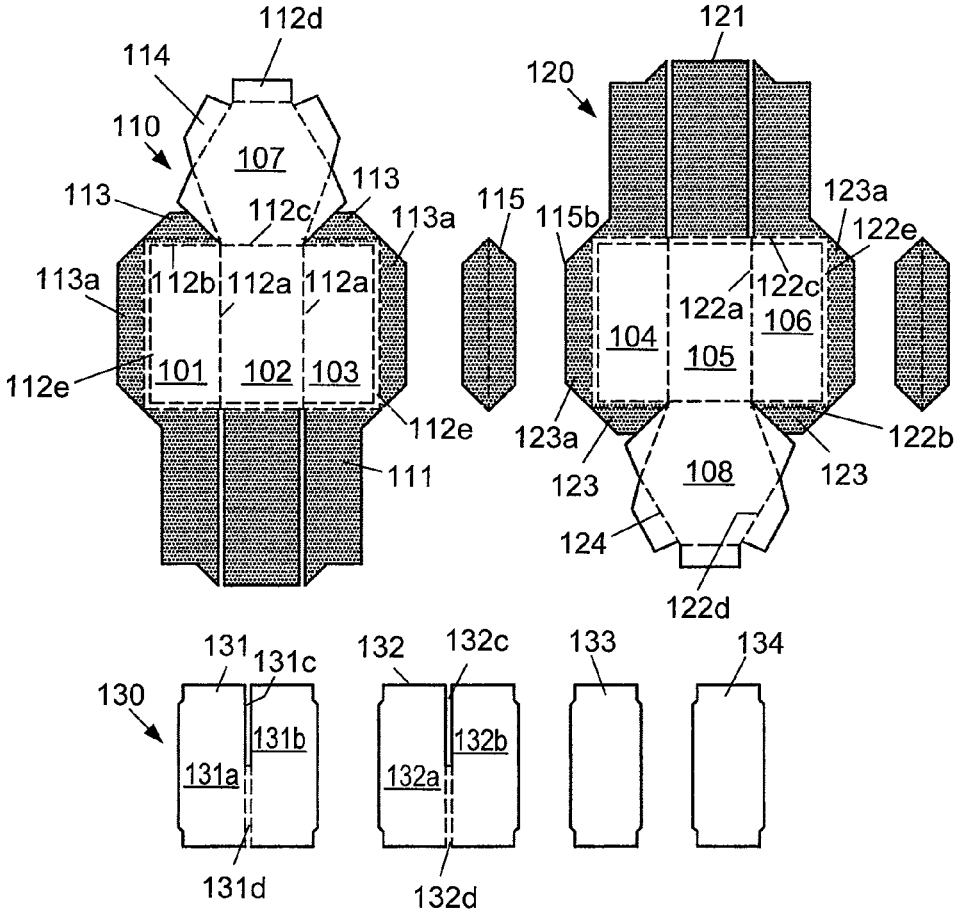
Figure 1D:
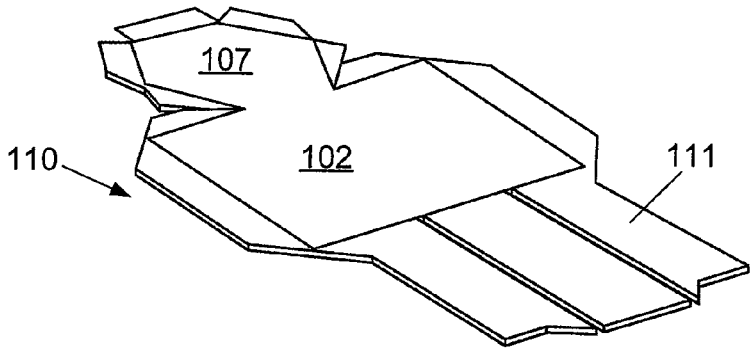
Figure 1E:
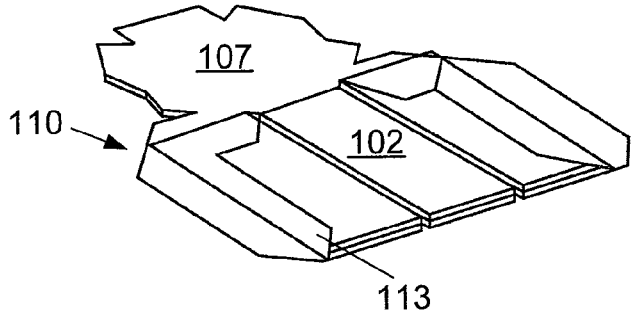
Figure 1F:
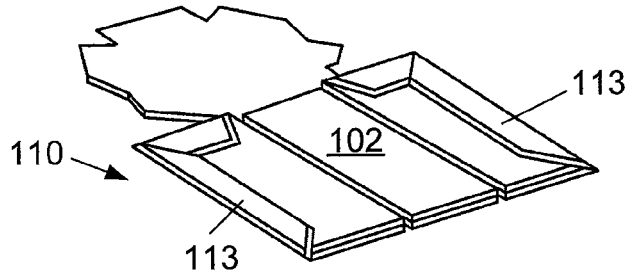
Figure 1G:
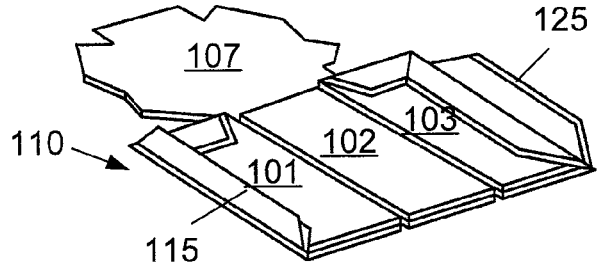
Figure 1H:
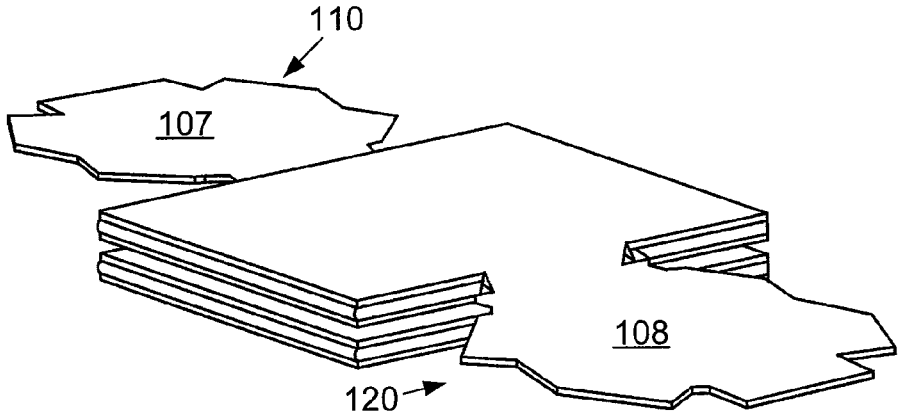
Figure 1I:
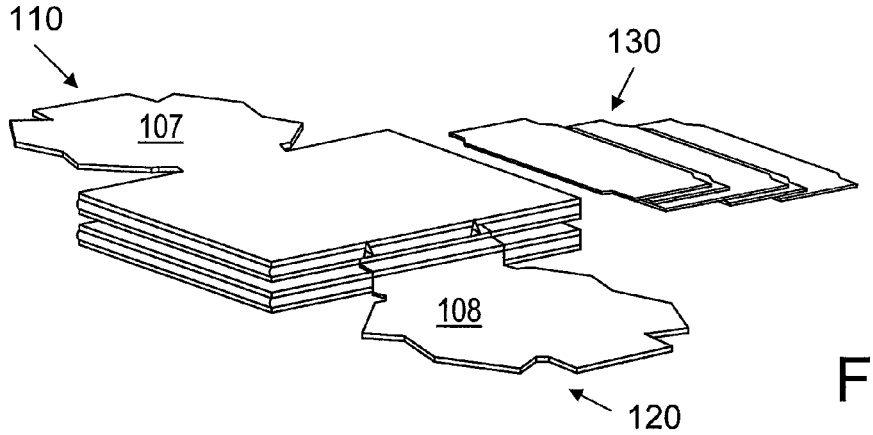
Figure 1J:
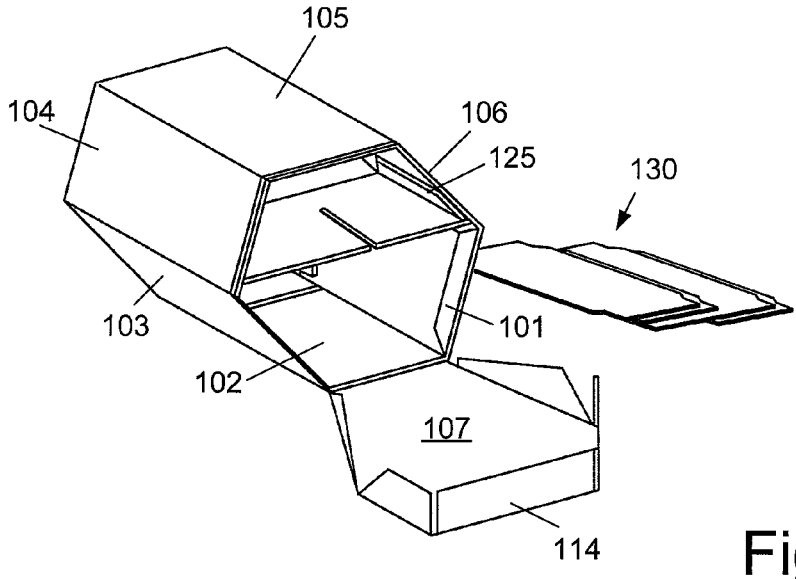
Figure 1K:
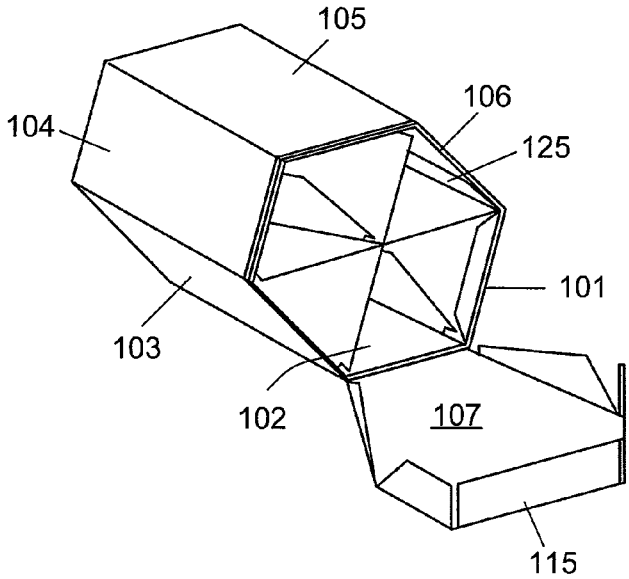
Figure 1L:
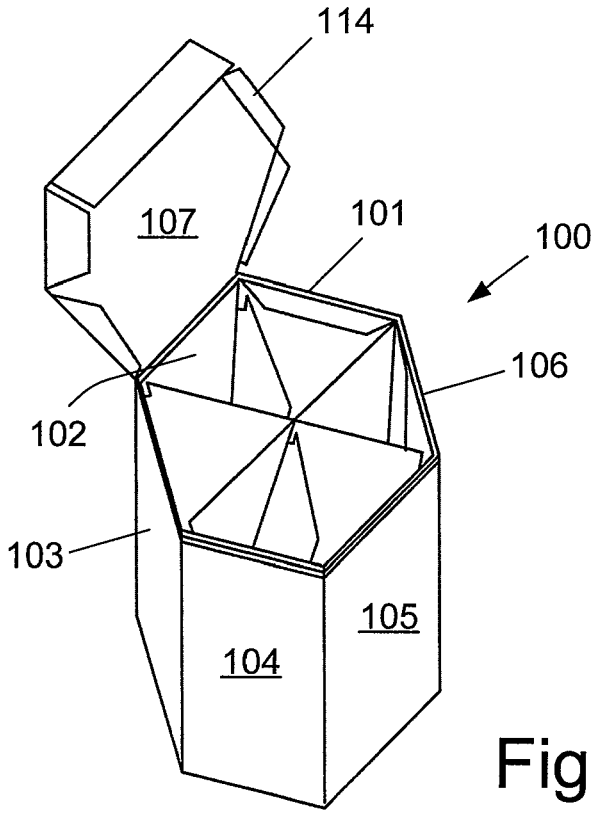
Figure 1M:
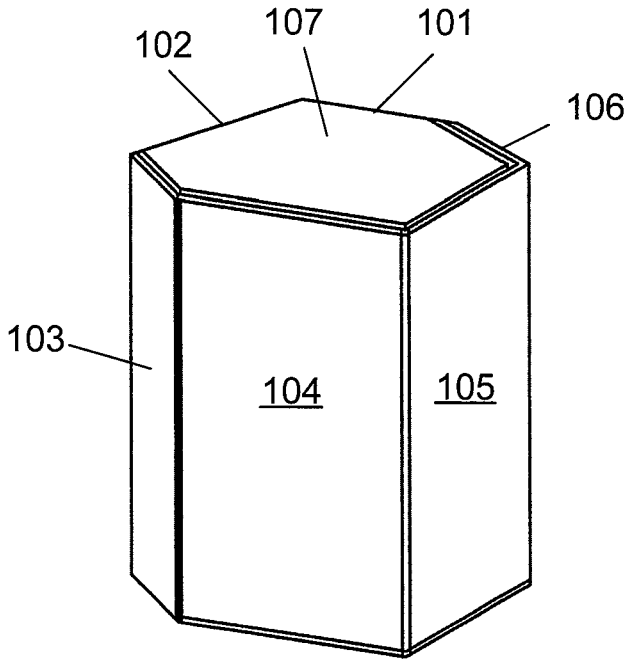
Figure 1N:
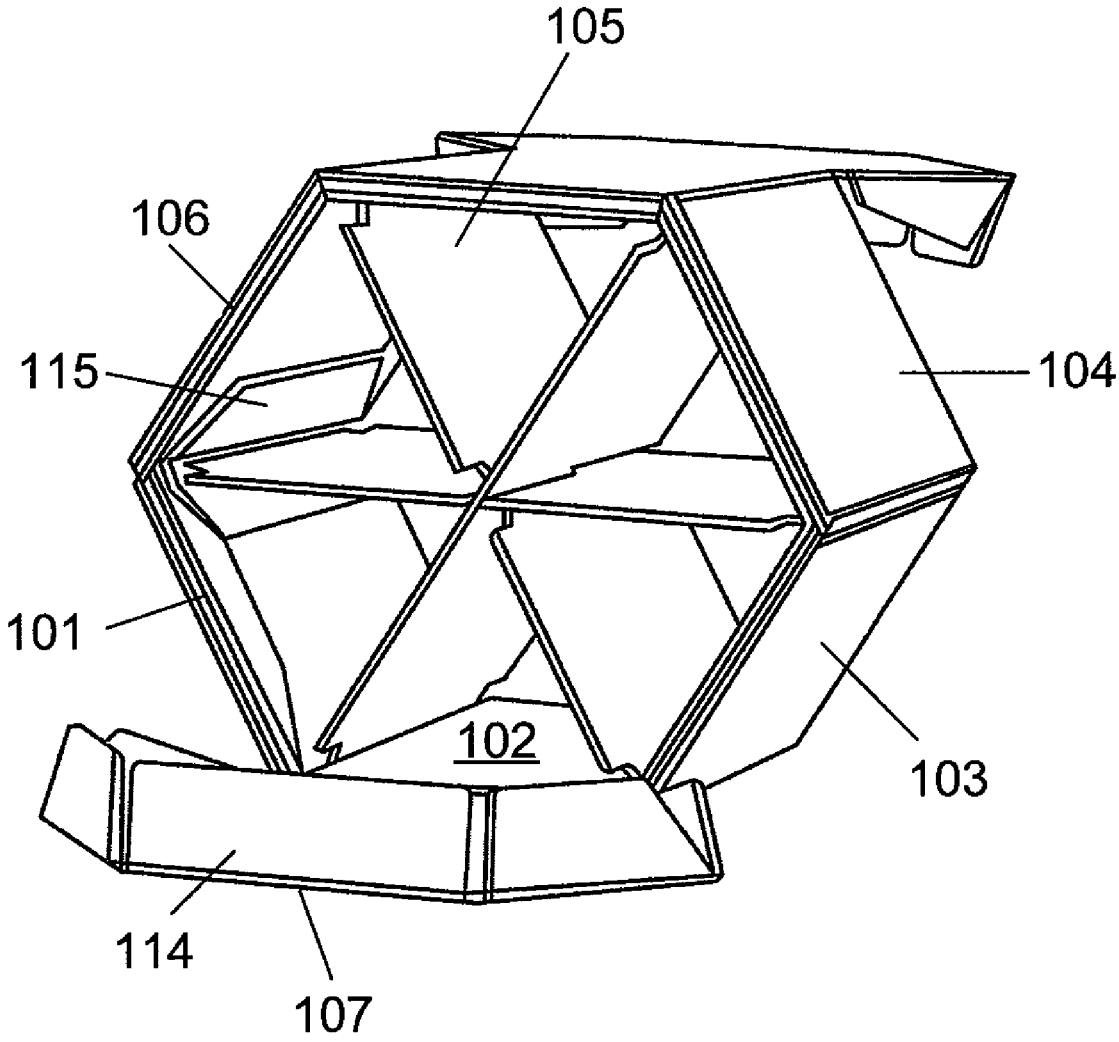

FIGS. 1A-1N illustrate a kit for use in assembling a stool, generally designated 100 in FIG. 1A. Such a kit includes three cardboard units or sub-assemblies, generally designated 110, 120 and 130, respectively, in FIG. 1B. The construction of each such sub-assembly or unit is more particularly illustrated in FIG. 1C, which shows the various cardboard sheets in flat form. FIG. 1C also illustrates, by dotted lines, the surfaces of the two units 110 and 120 which are to be adhesively joined to each other to produce the assembly in FIG. 1B to be used in making the stool 100 in FIG. 1A.

Each sheet of the assembly is cut according to a predetermined configuration and is formed with a predetermined arrangement of fold lines to enable the assembly to be expanded from the flat condition of FIG. 1B to the three-dimensional condition defining the stool 100 of FIG. 1A.

As shown in FIG. 1A, the three-dimensional stool 100 to be formed by the cardboard sheets within the kit includes a peripheral array of side walls 101-106, closed at one end by a top wall 107, and at the opposite end by a bottom wall 108. In the example illustrated, the peripheral side wall is of hexagonal configuration, including the six sides 101-106; accordingly, the two end walls 107, 108 would also be of hexagonal configuration.

The peripheral side walls 101-106 and the two end walls 107, 108, are defined by the two units 110, 120 (FIG. 1C) when joined together. The flat cardboard sheets of unit 130 (FIG. 1C) are disposed within the stool 100, as shown as example in FIG. 1K, to structurally reinforce the stool when assembled.

The construction of each of the two units 110, 120 is more particularly illustrated in a flat condition in FIG. 1C. Thus, unit 110 includes the three side walls 101-103, together with the top wall 107, whereas unit 120 includes the remaining three side walls 104-106, and the bottom all 108. Unit 110 further includes a section 111, on the side opposite to top wall 107, which is adhesively joined to a corresponding section 121 in unit 120 defining the opposite side including bottom wall 108, to produce the sub-assembly illustrated in FIG. 1B.

As further seen in FIG. 1C, both units 110 and 120 are formed with a first group of fold lines 112*a*, 122*a*, permitting the assembly of the two units 110, 120 to be folded to define the six side walls 101-106 around the periphery of the stool 100. In addition, the two units 110, 120 are formed with second fold lines 112*b*, 122*b*, respectively, spaced inwardly of the edges of the peripheral side wall defined by sides 101-106, defining flaps 113, 123, respectively, which are bent inwardly and are joined to the inner surfaces of the peripheral side wall at its two opposite ends. Such flaps 113, 123 thereby present fold lines, rather than cut edges, at the edges of the stool viewable by the user.

The two units 110, 120 are further formed with another fold line (hereinafter a third fold line), 112*c*, 122*c*, respectively, permitting their respecting extensions 107, 108, to be folded over the respective end of the peripheral side wall defined by sides 101-106, and thereby to constitute the top and end walls, respectively, of the stool. Each unit 110, 120, is formed with a further fold line 112*c*, 122*c* (also referred to as a third fold line) permitting adhesive-containing extensions 111 and 121, respectively, to be folded, and to be adhesively joined together in the assembled stool.

Each of the latter extensions defining the top wall 107 and bottom wall 108, respectively, is further formed with fourth fold lines 112*d*, 122*d*, respectively, spaced inwardly of the outer edges of the extension to define bendable flaps 114, 124, respectively, which are receivable against the inner surface of the respective end of the peripheral side wall defined by sides 101-106, for frictionally retaining the extensions defining the top and bottom walls 107, 108, in the place at the respective end of the peripheral side wall.

The two cardboard units 110, 120 are adhesively joined together by side flaps 113*a*, 123*a* defined by fold lines 112*e*, 122*e*, at each end of each unit. The corrugated cardboard used for cardboard units 110, 120, are relatively thick, in the order of 5 mm. When the two units 110, 120 are adhesively joined together at their side flaps 113*a*, 123*a* and flattened, this would put a considerable strain on the fold lines 112*e* and 122*e* because of the thickness of the cardboard sheets. To avoid this strain, and particularly to permit the two units, when joined together, to be substantially flattened as shown in FIG. 1B, two of the side flaps 113*a*, 123*a* at one end are adhesively joined together by a connector strip 115, and at the opposite end by a second connector strip 125. These connector strips are of substantially thinner construction and are adhesively joined to the inner surfaces of the side flaps 113*a*, 123*a* as shown particularly in FIG. 1J, such that they permit the two units 110, 120 to be completely flattened without unduly straining the fold lines 112*e*, 122*e* at the respective ends of the units.

As indicated earlier, the further cardboard sheets 130 are inserted into the interior of the stool defined by the side walls 101-106, from one end, e.g. while the top wall 107 is still in its open condition as shown in FIGS. 1J and 1K. FIG. 1C illustrates unit 130 as including four sheets 131-134. Sheets 131 and 132 are double sheets, divided into two sections 131*a*, 131*b* and 132*a*, 132*b*, respectively, by a slot 131*c*, 132*c*, extending at a mid portion of each sheet half way of the length of the sheet, leaving the other end of the sheet unslotted as shown at 131*d*. The two smaller sheets 133, 134 are each of the size of the two sections 131*a*, 13*b* and 132*a*, 132*b*.

Thus, as shown particularly in FIGS. 1J and 1K, when inserting sheet 130 into the interior of the stool, sheet 131 is first inserted with its slot 131*c* facing upwardly; sheet 132 is inserted thereover with it unslotted portion 132*d* received within slot 131*c* of sheet 131; and finally the remaining two sheets 133, 134 are inserted in the spaces between sheets 131, 132. Such an arrangement thus provides a radiating array of cardboard sheets within the stool 100, between the top and bottom end walls 107, 108, to thereby substantially increase the strength of the stool to withstand loads.

The manner of using the illustrated kit for assembling the stool 100 will be apparent from the above description. Thus, as indicated earlier, the two connector strips 115, 125 are adhesively joined together at one of the end flaps 114, 124 of the two units 110, 120; and the two units 110, 120 are adhesively joined directly to each other via their other end flaps 114, 124. This may be done at the factory since the relatively thin connector strips 115, 125 permit the two units to assume a compact flattened condition for shipping, handling, etc. as illustrated in FIG. 1B. The cardboard sheets 130-134 constituting unit 130 can also be shipped and handled in a flattened condition, as shown in FIG. 1B.

The user thus receives the flat assembly of the two units 110, 120, and also the flat sheets of unit 130, as illustrated in FIG. 1B. The user then expands the assembly of units 110, 120, to produce a hexagonal peripheral side wall defined by the six side walls 101-106. One of the slotted cardboard sheets 131 is then inserted into the interior of the stool, and then other slotted cardboard sheet 132, with the slot of one sheet receiving the unslotted portion of the other sheet, and with the edges of the four sections 131*a*, 131*b*, 132*a*, 132*b*, seated at the juncture of four of the six sides of the hexagonal peripheral wall. The other two sheets 133, 134, are then inserted into the spaces to engage the remaining junctures of the six side walls.

The flaps 114, 124, defined by fold lines 112*d* and 122*d*, respectively, may then be bent inwardly, as shown in FIGS. 1J-1L, so that they engage the inner surfaces of the side walls and thereby frictionally retain the respective end walls in place, closing the ends of the stool.

It will thus be seen that the cardboard sheet sub-assemblies illustrated in FIGS. 1A-1N are easily and conveniently foldable into a compact flat form, e.g., as seen in FIG. 1B, for storage, shipping or handling, and are easily expanded into the stool illustrated in FIG. 1A. It will also be seen that the stool so produced has a high degree of dimensional stability and structural rigidity, and also has a pleasing appearance since no cut edges are viewable but rather, all viewable edges are in the form of bond lines. The surfaces of the cardboard sheets which are exposed to view in the so-formed stool are preferably colored or otherwise ornamented.

Figure 2A:
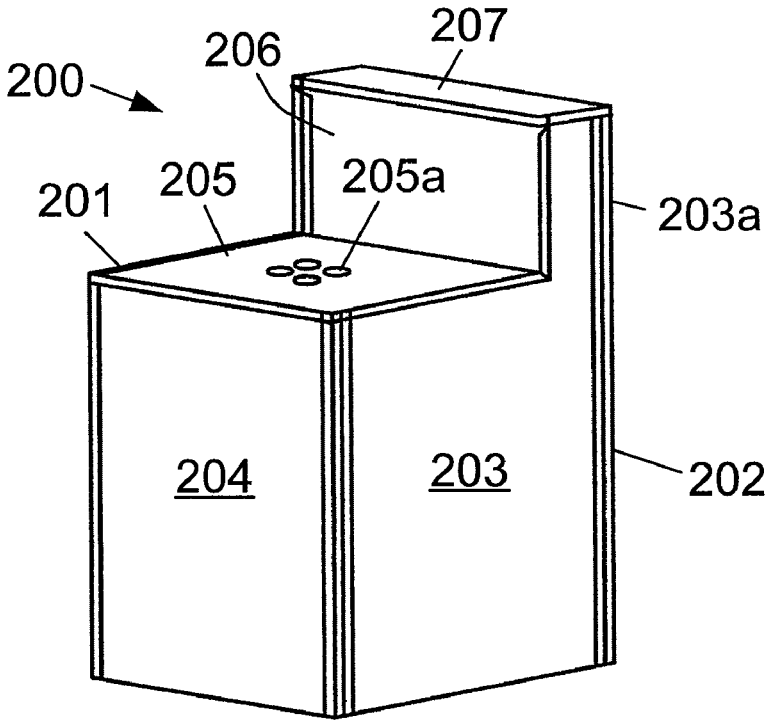
FIGS. 2A-2I illustrate the various components of a kit for assembling a chair, and the various steps in assembling the chair.

FIGS. 2A-2I illustrates a kit constructed in accordance with the present invention for use in making a chair, generally designated 200 in FIG. 2A. Such a chair includes four side walls 201, 204, an end wall 205 serving as seat for the user, a vertically-extending sidewall 206 serving as a backrest, and a top end wall 207. The cardboard kit for use in making the chair 200 of FIG. 2A includes basically the same components as the kit in making the stool of FIGS. 1A-1N, except that the cardboard sheets are of a shape, and are provided with fold lines, to permit them to be expanded from their flattened condition into a chair, as shown at 200 in FIG. 2A.

Figure 2B:
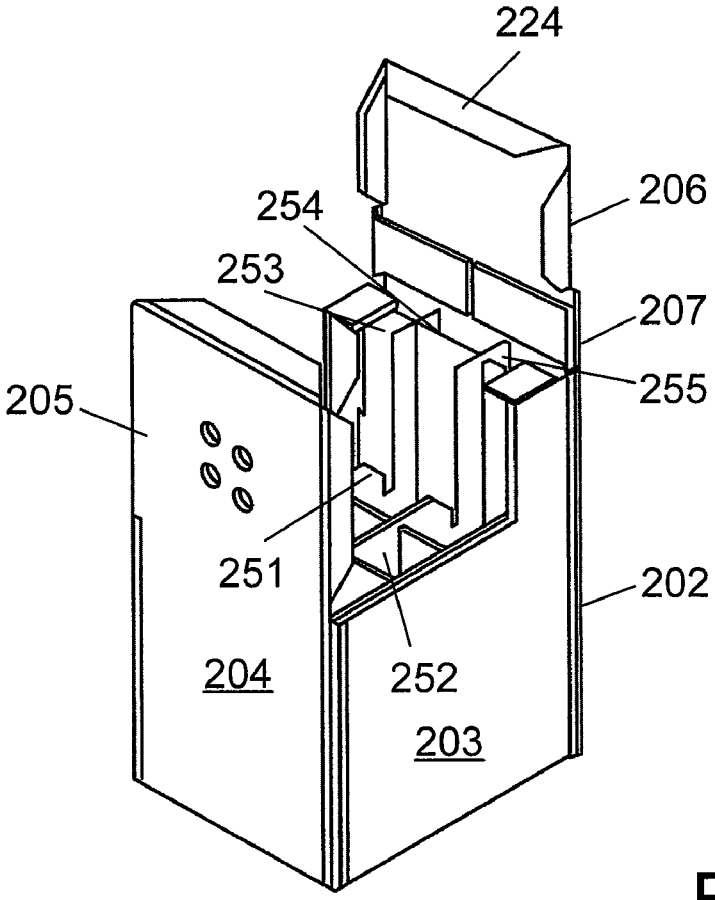
Figure 2C:
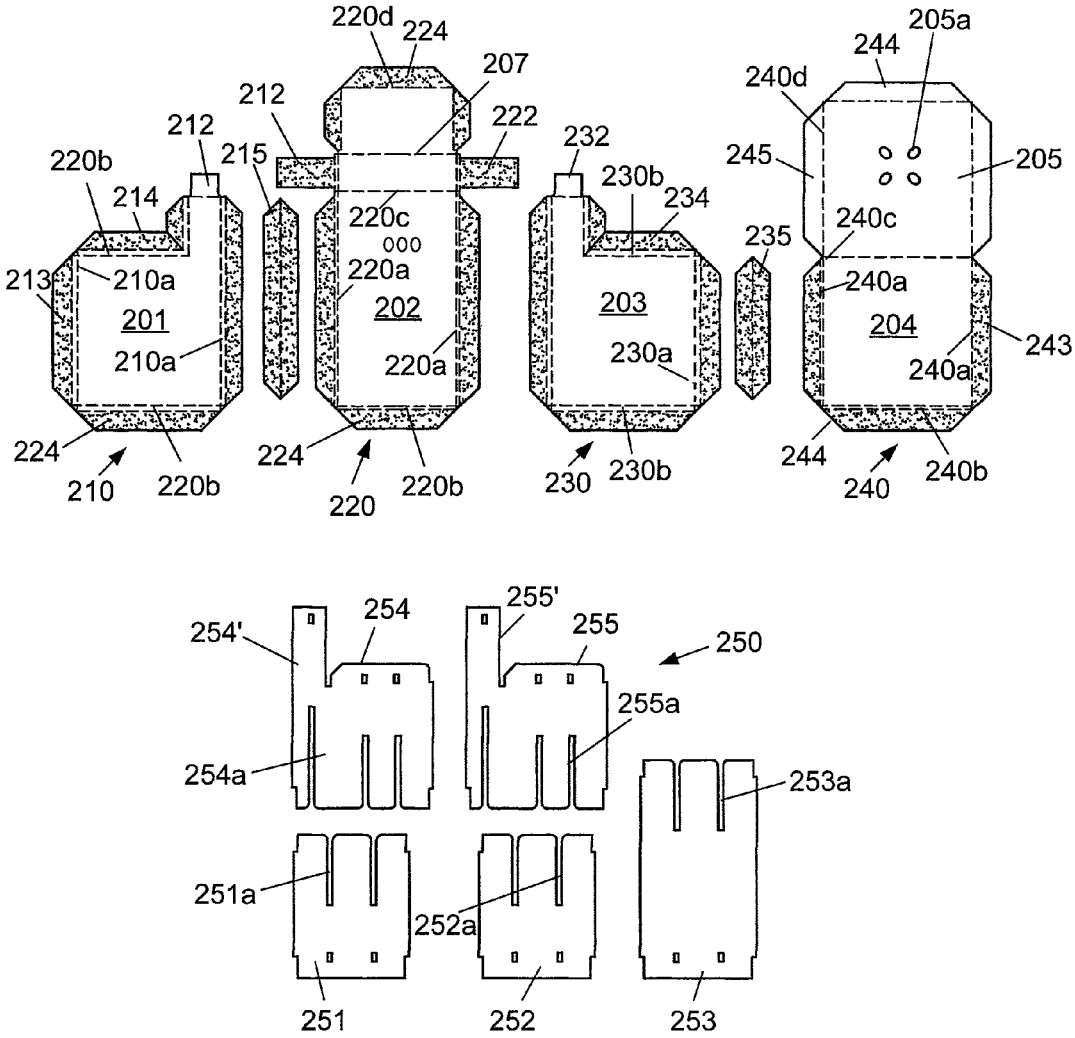
Figure 2D:
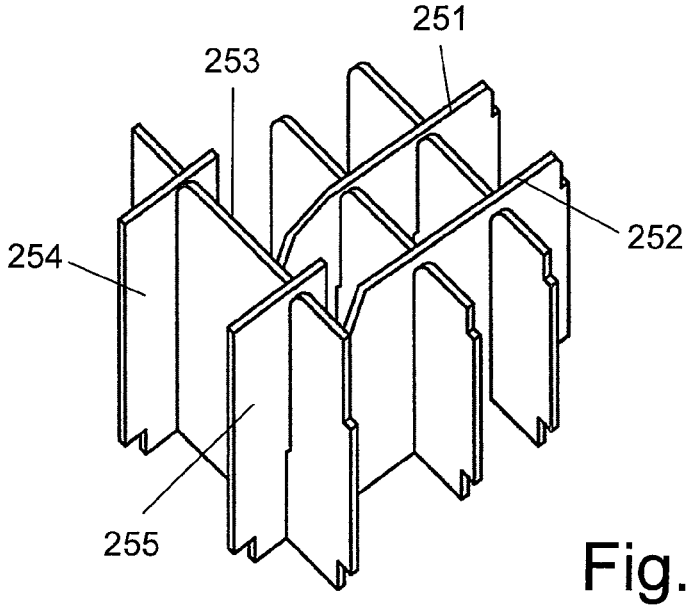
Figure 2E:
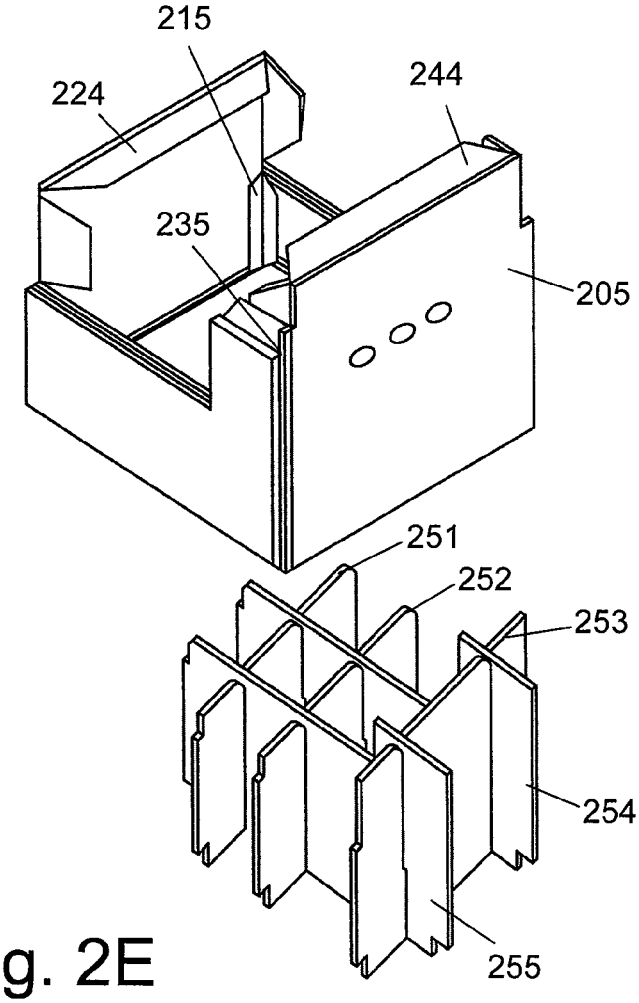
Figure 2F:
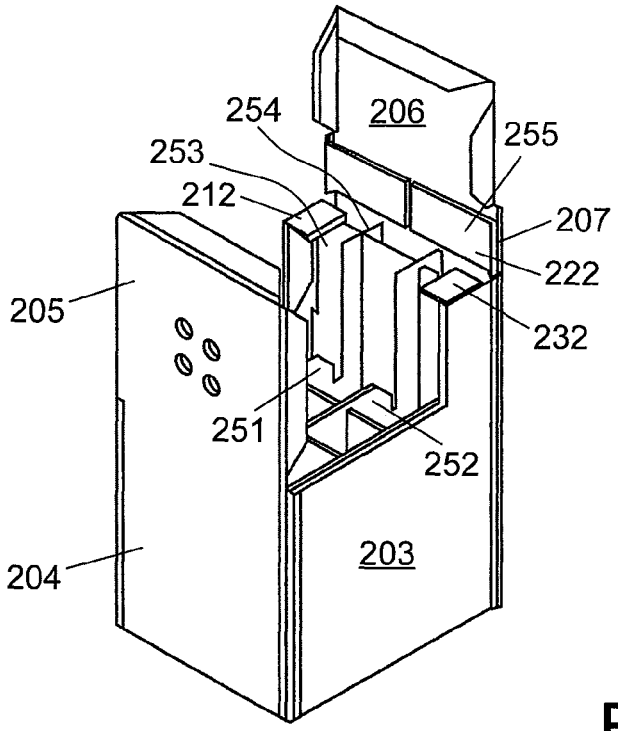
Figure 2G:
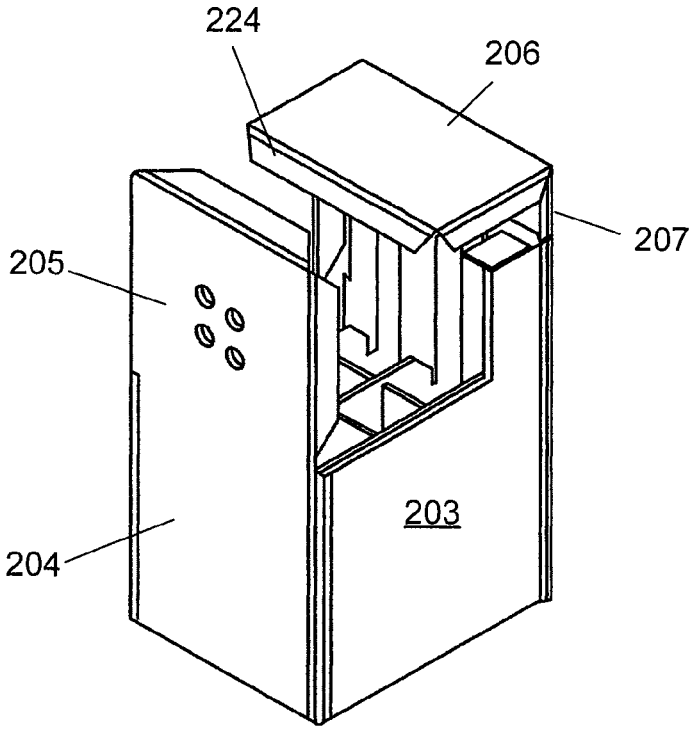
Figure 2H:
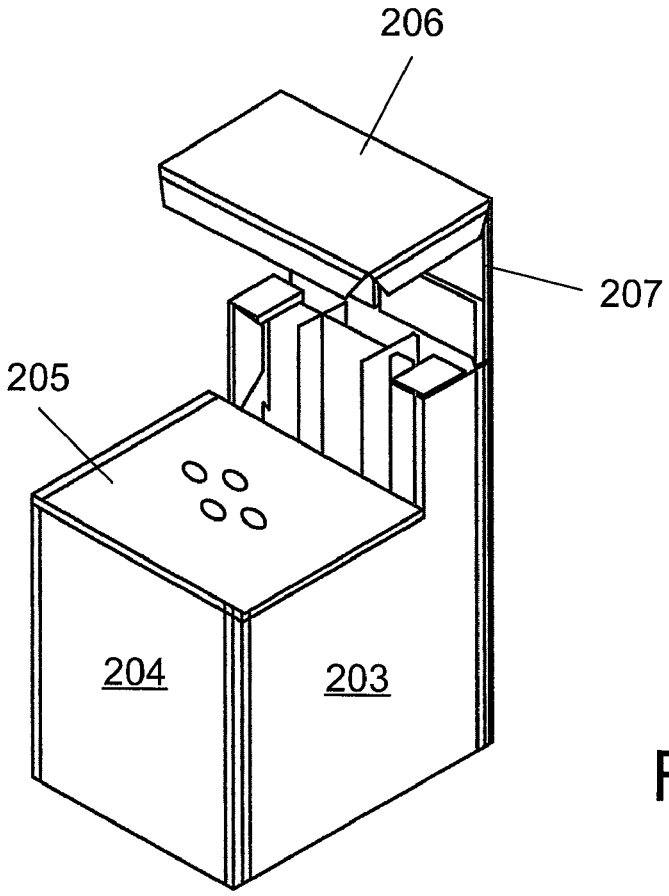
Figure 2I:
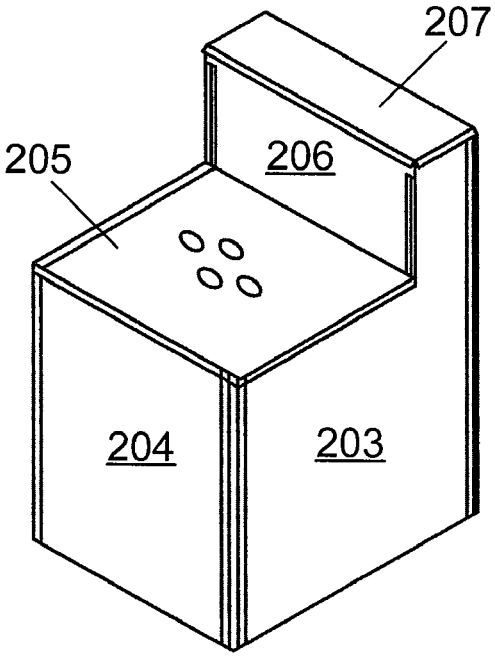

FIG. 2C illustrates the basic components of the kit to enable assembling the chair 200 of FIG. 2A. In this case, the kit includes four cardboard units 210, 220, 230 and 240, for producing the outer configuration of the chair 200, and five cardboard sheets 251-255, constituting the inner reinforcement unit 250 receivable within the interior of the chair to increase the physical strength of the chair against loads.

Thus, as shown in FIG. 2C, cardboard unit 210 defines the left side wall 201 together with its backrest extension 201*a*; unit 220 defines the back side wall 202, together with its backrest extension 202*a*, top wall 207, and vertical wall 206 of the backrest; unit 230 defines the right side wall 203 together with its backrest extension 203*a*; and unit 240 defines the front side wall 204 together with the seat 205. Preferably, seat 205 is formed with finger-receiving apertures 205*a* to facilitate manipulating the seat, or the chair, if desired.

In this case, the unit 210 is joined to unit 220 by a thin connector strip 215, and unit 230 is joined to unit 240 by another thin connector strip 235. In addition, unit 210 is joined to unit 240 via flaps 213 and 243; and unit 220 is joined to unit 230 via flaps 223, 243.

The first fold lines, permitting the cardboard assembly of units 210-240 to be shipped, stored or handled in a compact flat condition, and thereafter to be expanded to a three-dimensional condition to define a peripheral side wall, are fold lines 210*a*, 220*a* and 240*a*. The cardboard assembly of units 210-240 is also formed with second fold lines 210*b*, 220*b*, 230*b* and 240*b*, which define flaps 214, 224, 234 and 244, bent inwardly and joined to the inner surfaces of the peripheral side wall by adhesive such as to present fold lines, rather than cut edges, at the viewable edges of the chair.

In addition, the cardboard seat section 240 includes a third fold line 240*c* which permits seat 205 to be folded over the side walls of the lower seat section of the chair and thereby to close the respective end of that section. Seat section 240 also includes the fourth fold lines 240*d* spaced inwardly of the outer edge of the seat section 205 to define bendable flaps 245 which are receivable against the inner surface of the respect end of the seat section for frictionally retaining the seat 205 in place against the end of the seat section.

Back section 220 includes two third fold lines 220*c* to define top wall 206 and back wall 207, and fourth fold lines 220*d* to define flaps 225 corresponding to flaps 245 in seat section 240.

As still further seen in FIG. 2C, this top section 207 of unit 220 is formed with flaps 222 on its opposite sides, which flaps are adhesively coated for bonding against the inner surface of section 207, thereby reinforcing this section. In addition, the two units 210, 230, straddling unit 220, are formed with flaps 212 and 232, respectively, which are bent over to engage top section 207 of unit 220, as reinforced by the adhesively secured flaps 222, to provide structural reinforcement to the chair when in its expanded condition as shown in FIG. 2A.

As indicated earlier, the flat cardboard sheets constituting unit 250 are used for structurally reinforcing the seat section and back section of the illustrated chair. In this case, this unit includes five flat cardboard sheets 251-255. Cardboard sheets 251 and 252 are of a height for reception within the seat section of the chair; whereas sheet 253 is of a larger height so as to extend also into the backrest section of the chair (FIG. 2B). Sheets 254 and 255 include a main section of a height for reception within the seat section of the chair, and an extension, as shown at 254*i* and 255*i*, respectively, for extending into the backrest section of the chair.

As further seen in FIG. 2C, and particularly in the assembly view of FIG. 2B, each of the reinforcing sheets 251-255 is formed with slots 251*a*-255*a* extending for half the height of the respective section, such that they may be assembled in an egg-crate arrangement within the chair, as shown in FIG. 2B.

FIGS. 2D-2I illustrate the manner of expanding the cardboard assembly including sheets 210-240 to define the external surfaces of chair 200 illustrated in FIG. 2A, and the manner of inserting the reinforcement cardboard sheets 251-255 in an egg-crate array into the interior of the chair so as to structurally reinforce the chair with respect to loads.

It will be appreciated that the cardboard sheets illustrated in FIG. 2C can be supplied, shipped and stored in a flat, compact condition, this being particularly permitted by the thin connector strips 215, 235, and can be erected in a quick and facile manner to form the chair 200 illustrated in FIG. 2A having dimensional stability, structural rigidity and a pleasing appearance such as no cut edges of the cardboard are exposed for view, but only fold lines It will also be appreciated that the surfaces of the cardboard sheets exposed for view in the three-dimensional chair can be colored or otherwise ornamented, thereby providing an extremely pleasing appearance to the chair produced with these cardboard sheets.

Figure 3A:
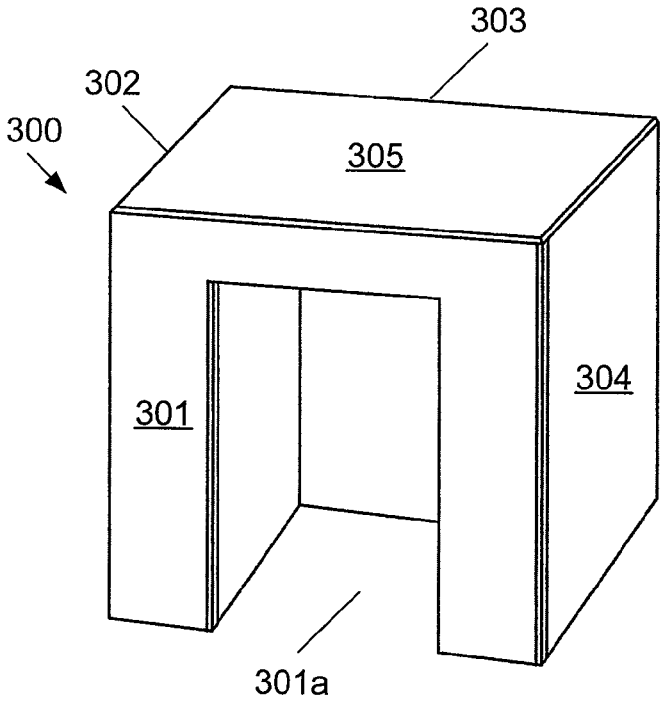
FIGS. 3A-3K illustrate the various components of a kit for assembling a desk, and the various steps in assembling the desk.
Figure 3B:
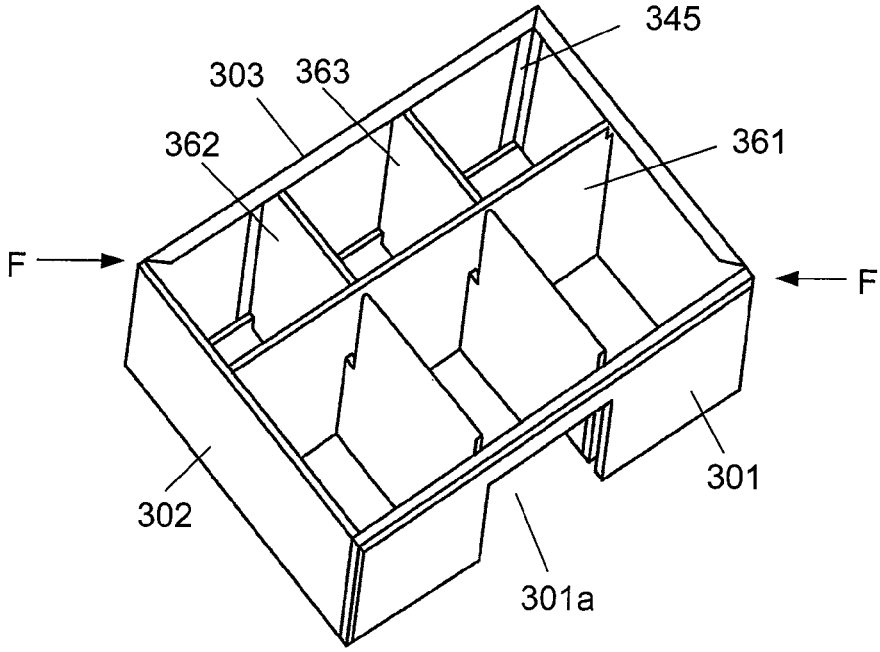

FIGS. 3A-3K illustrate a cardboard kit for constructing a desk 300 as shown in FIG. 3A. The desk, in its expanded condition as illustrated in FIG. 3A, includes a front side wall 301, a left-side wall 302, a back side wall 303, a right-side wall 304, and a top wall 305, serving as the top surface of the desk. The front side wall 301 is formed with a rectangular opening 301*a* to accommodate a chair, or the feet of a person sitting on the chair using the desk. FIG. 3B illustrates the desk 300 of FIG. 3A, but with the top 305 removed.

Figure 3C:
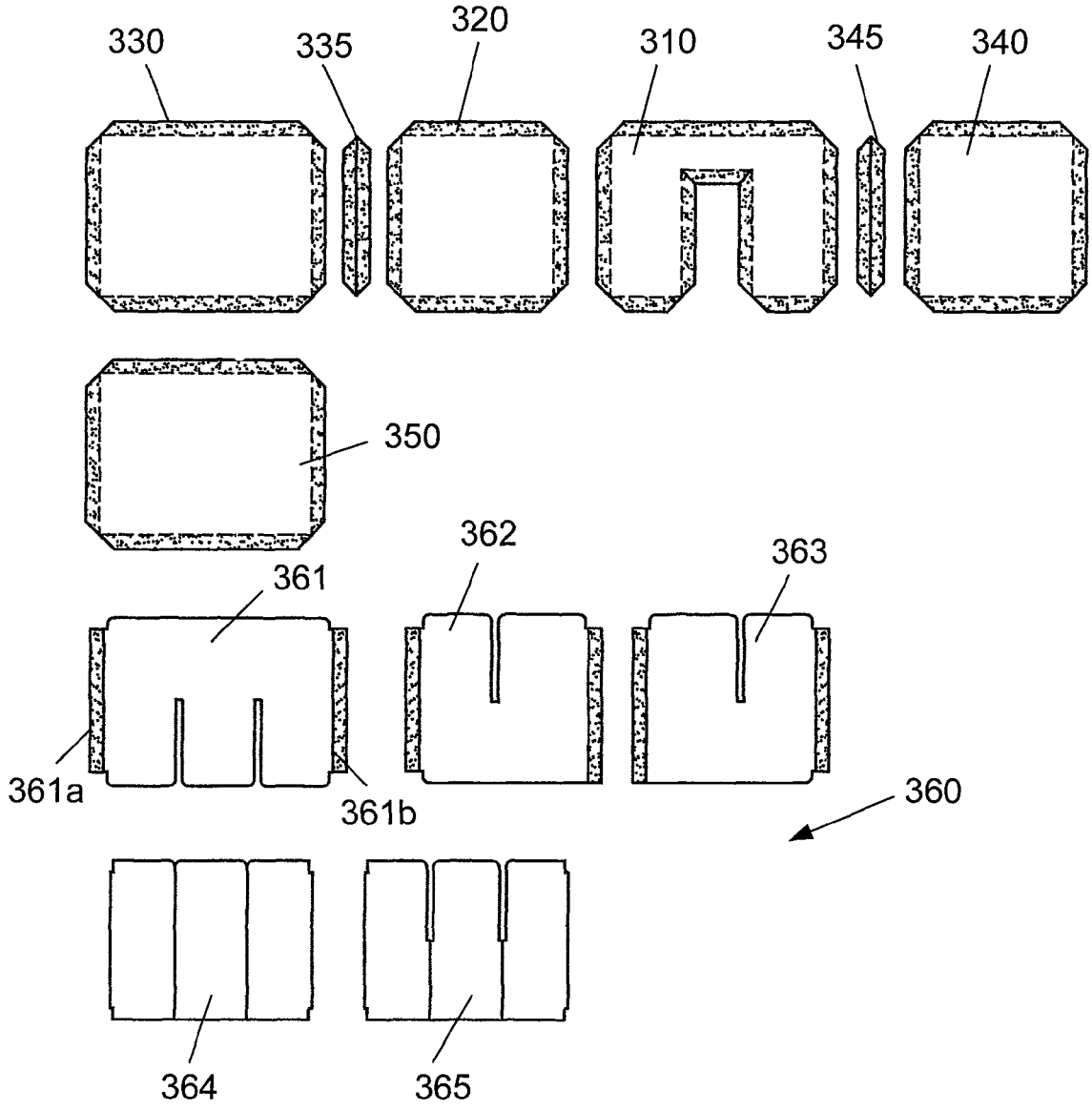
Figure 3D:
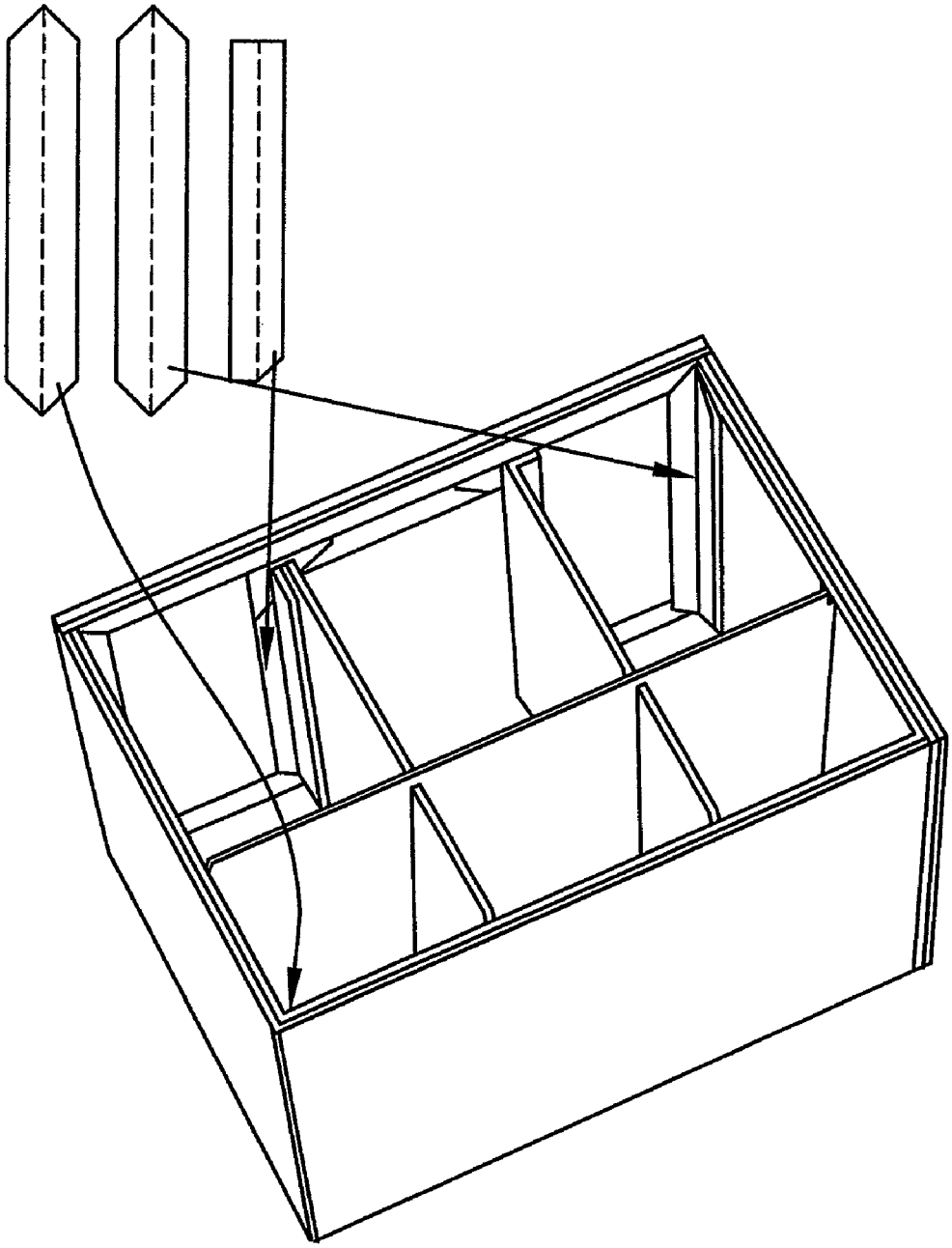
Figure 3E:
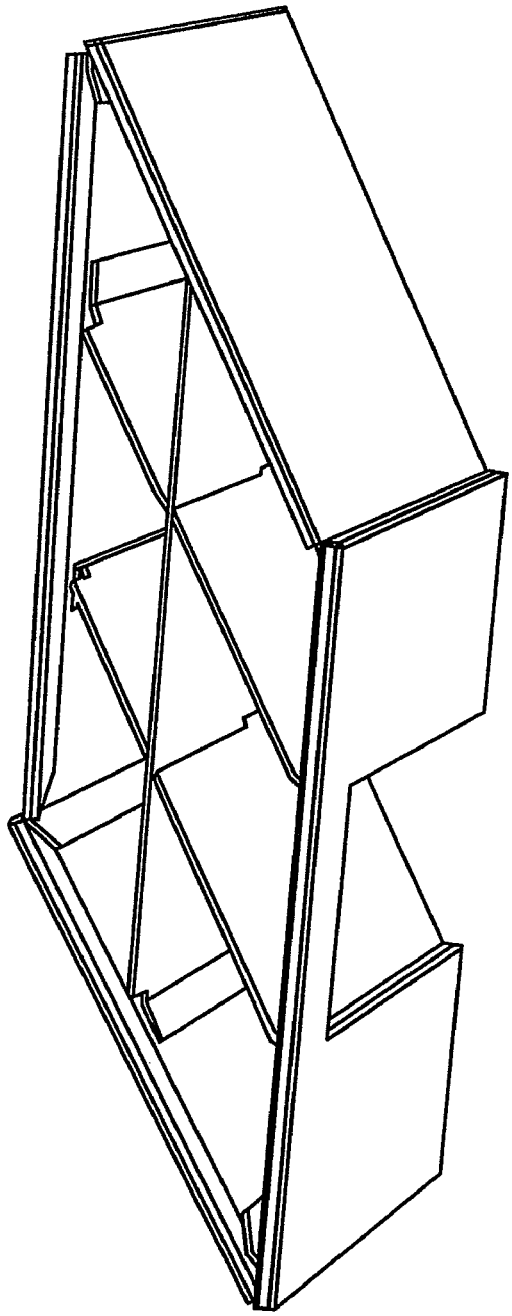
Figure 3F:
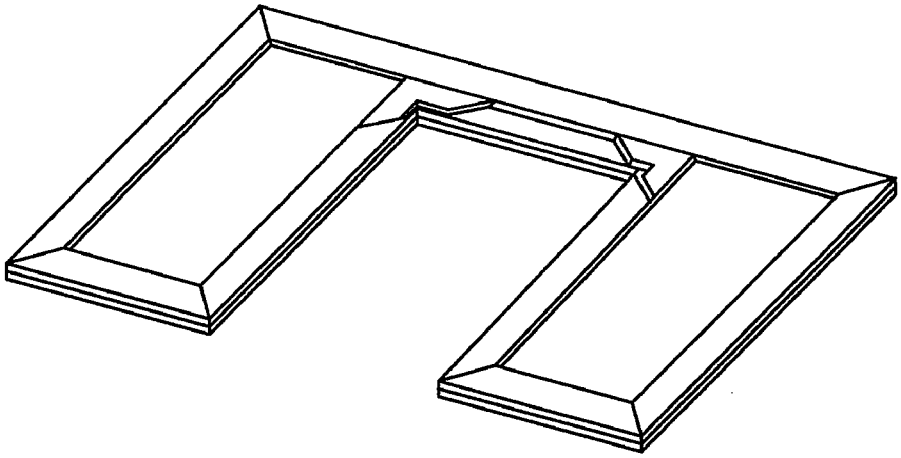
Figure 3G:
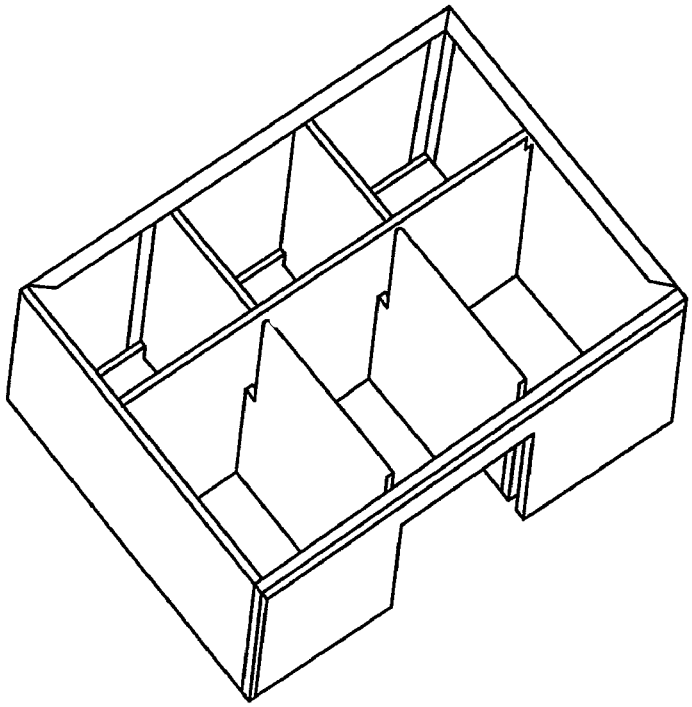
Figure 3H:
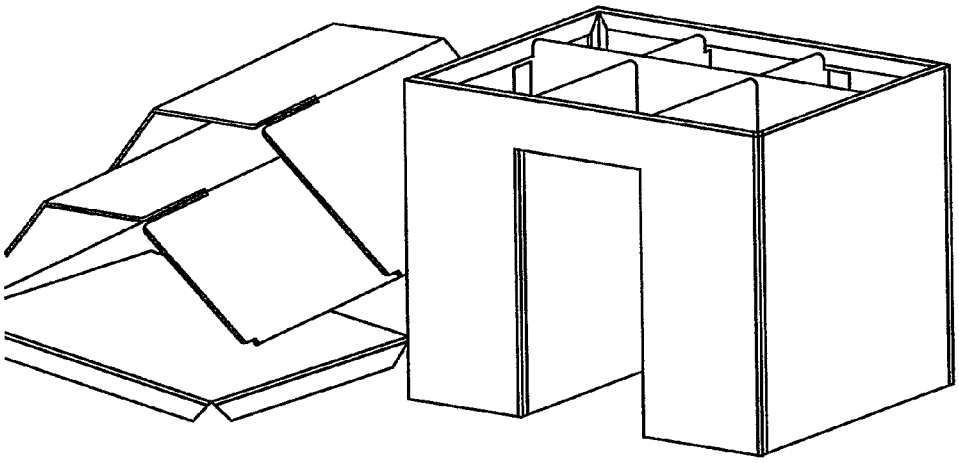
Figure 3I:
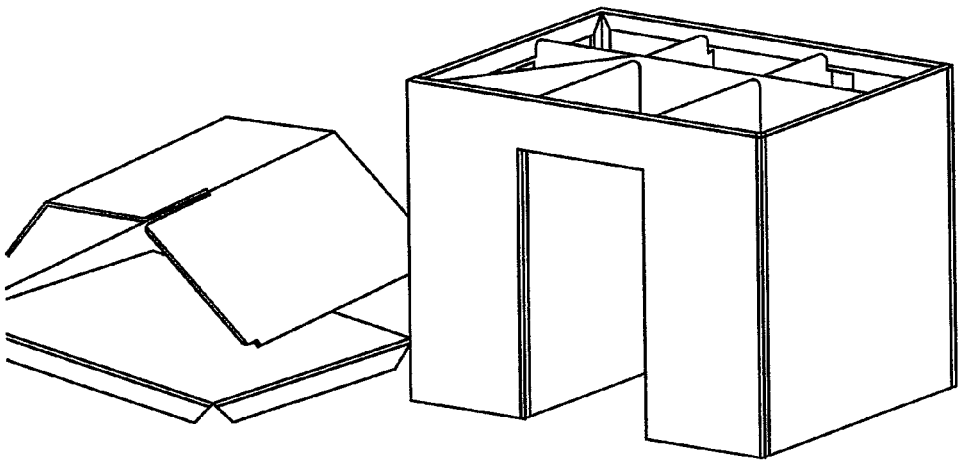
Figure 3J:
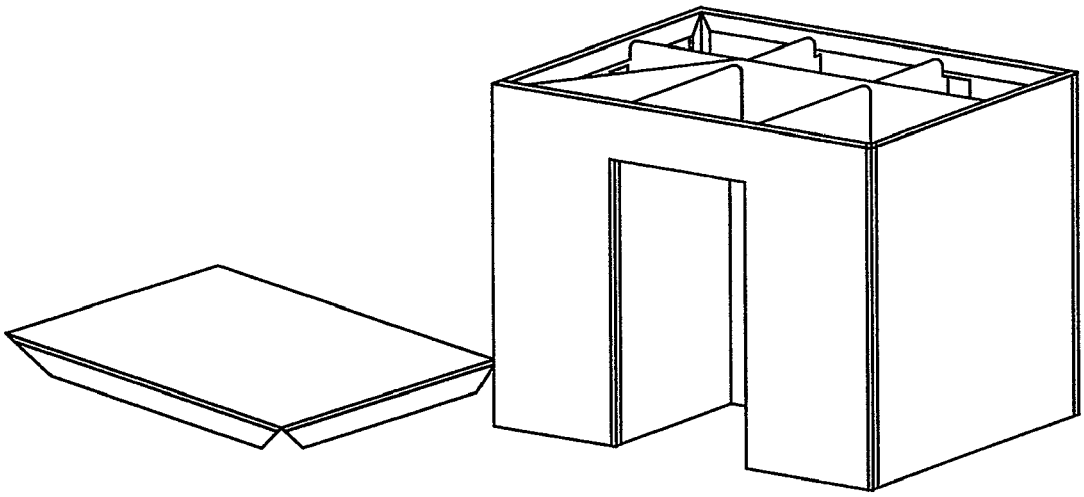
Figure 3K:
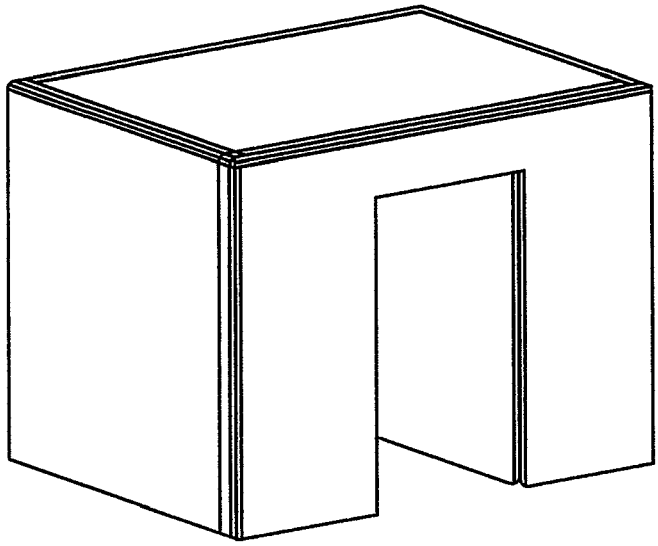

FIG. 3C illustrates the various cardboard units included in the kit to produce the desk 300 of FIG. 3A. Thus, shown in FIG. 3C are: unit 310 defining the front side wall 301 including its opening 301*a*; unit 320 defining the left side wall 302; unit 330 defining the back side wall 303; unit 304 defining the right side wall 304; and unit 350 defining the top wall 305 of the desk. For strengthening purposes, a further cardboard sheet 311 of the same basic shape as the front side wall unit 310 is adhesively bonded to the inner surface and is formed with corrugations extending perpendicular to the corrugations in cardboard sheet 310.

FIG. 3C further illustrates the thin connector strips 335, 345, for joining unit 330 to unit 320, and unit 310 to unit 340, respectively. Unit 330 is also joined to unit 340 by the adhesive-coated flaps 333, 343, and unit 320 is also joined to unit 310 by the adhesive-coated flaps 323, 313. These flaps, together with the connector strips 335, 345, are formed with fold lines such that all four units 310-340, when expanded, define the peripheral side wall for the desk. Since the connector strips 335 and 345 are of thinner material than the cardboard sheets units 310-340, the four so-joined units 310-340 may be folded into a flat compact form along the connector strips 335, 345, without unduly straining the folded edges of the respective units.

FIG. 3C also illustrates the structural sheets, generally designated 360, to be inserted within the interior of desk 300 to provide structural reinforcement for the desk. These sheets include a longitudinally-extending sheet 361 having adhesive flaps 361*a*, 361*b* at its opposite ends for adhesively bonding to the left and right side walls 302, 304, respectively; and transversely-extending sheets 362, 363 having adhesively-coated flaps 362*a*, 362*b* and 363*a*, 363*b*, respectively, to be bonded to the front side wall 301 and back side wall 303, respectively, of the desk.

As shown in FIG. 3C, cardboard sheet 361 is formed with two slots 361*c*, 361*d*, extending for one-half the height of the sheet; whereas cardboard sheets 362 and 363 are each formed with a single slot 362*c*, 363*c*, also extending one-half the height of the respective sheet, but on the opposite side of the sheet as compared to the slot 361. The three sheets 361-363 are assembled in an egg-crate array, as shown in FIG. 3B, with sheets 362 and 363 being received within the slots in sheet 361.

FIG. 3C illustrates two further cardboard sheets 364, 365. Sheets 364, 365 are not fixed within the desk, but rather are removably received within the desk so as to permit the four joined units 310-340, when the top unit 350 is removed, to be folded into a flat compact form for shipping or storage. Thus, as shown in FIG. 3B, when a force is applied to the opposite sides of the joined units 310-340, as indicated by the arrows F, the four joined units will be folded along the fold lines defined by the two thin connector strips 335, 345, into a compact form. To assemble the desk, it is only necessary to expand the four units, by pulling in the opposite direction from the arrows shown in FIG. 3B, then inserting the reinforcing sheets 364, 365, and finally applying the desk top panel 350 over the top of the so-expanded unit.

The cardboard sheets illustrated in FIG. 3C include not only the first fold lines in the four sheets 310-340 and in the flexible connector strips 335, 345 permitting the cardboard assembly to be folded from the flat condition to a three-dimensional expanded condition, as illustrated in FIG. 3B and as described above, but further include the second fold lines spaced inwardly of the viewable edges of the desk defining the flaps 311-341 and 312-342 which are bent inwardly and joined to the inner surfaces of their respective sheets 310-340 such as to present fold lines, rather than cut edges, at the viewable edges of the cardboard assembly, and also to strengthen those edges. The third fold lines included in the previously-described embodiment, namely those permitting the end wall(s) to be folded over the peripheral side wall, are not present in the construction illustrated in FIG. 3C since the top wall 350 is provided as a removable element, rather than as one integrally formed in the other sheets and defined by the fold line. However, it will be appreciated that, particularly for smaller tables, the table top 350 could also be integrally formed with one of the side walls and connected thereto by a fold line. The fourth fold lines, namely those spaced inwardly of the outer edges of the top sheet 350, are provided to define bendable flaps receivable against the inner surfaces of the peripheral side wall of the four units 310-340 for frictionally retaining the top wall in place.

The kit illustrated in FIGS. 3A-3K for producing the desk 300 is otherwise of basically the same construction as described above, and provides the same basic advantages.

Figure 4A:
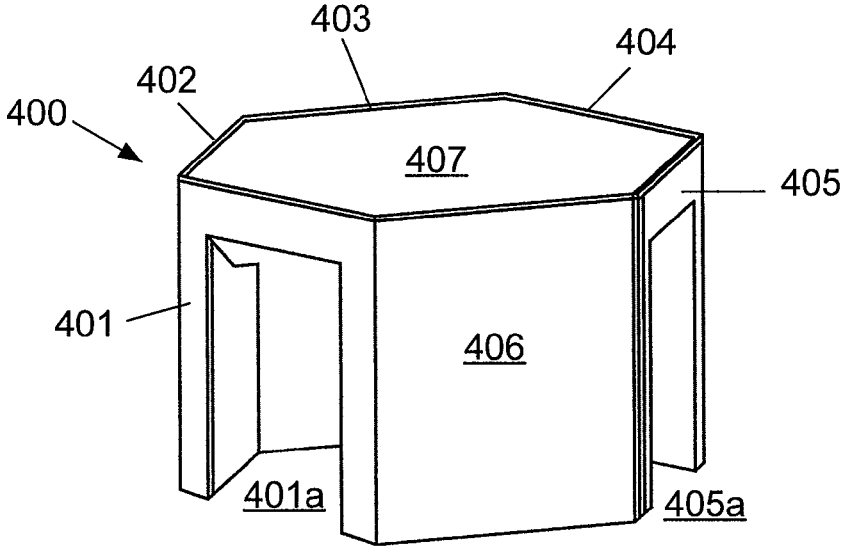
FIGS. 4A-4N illustrate the various components of a kit for assembling a table, and the various steps in assembling the table.
Figure 4B:
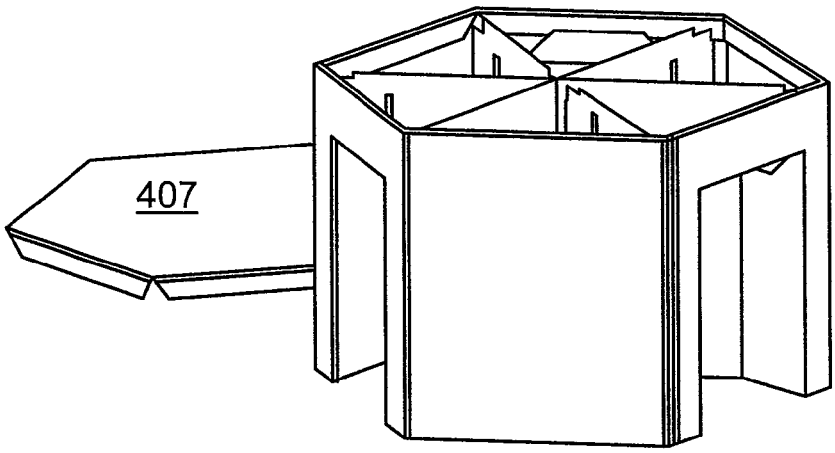
Figure 4C:
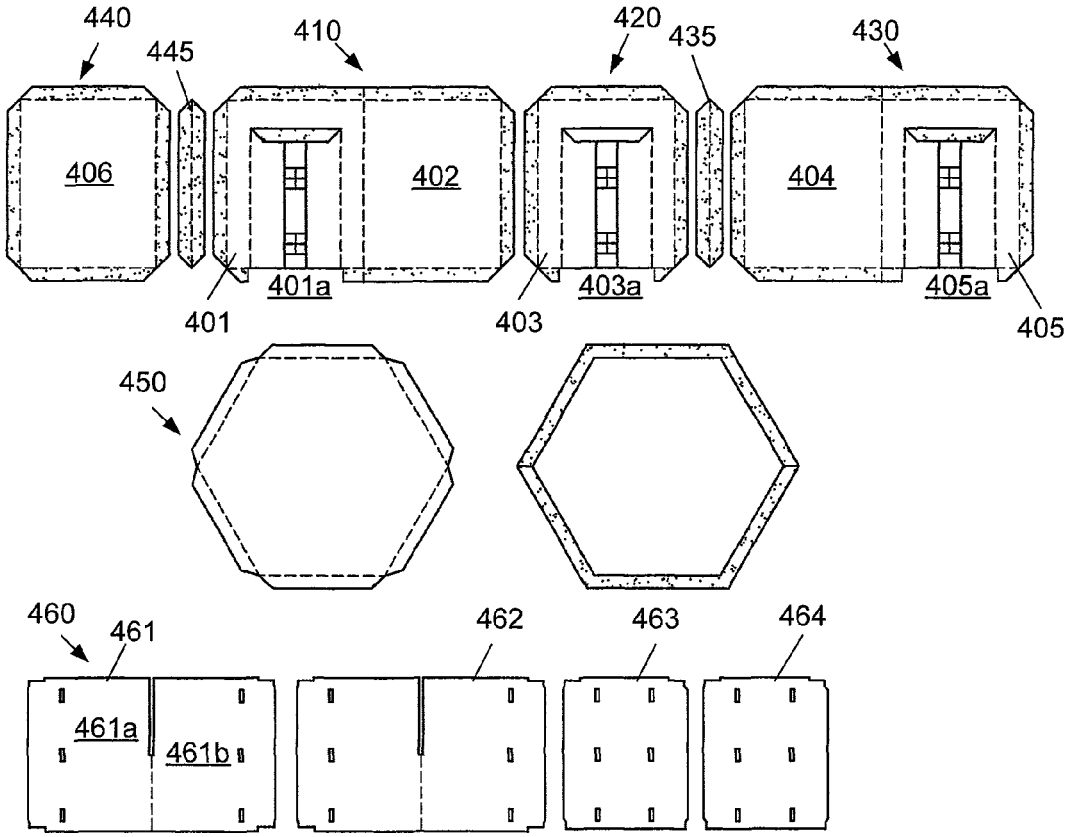
Figure 4D:
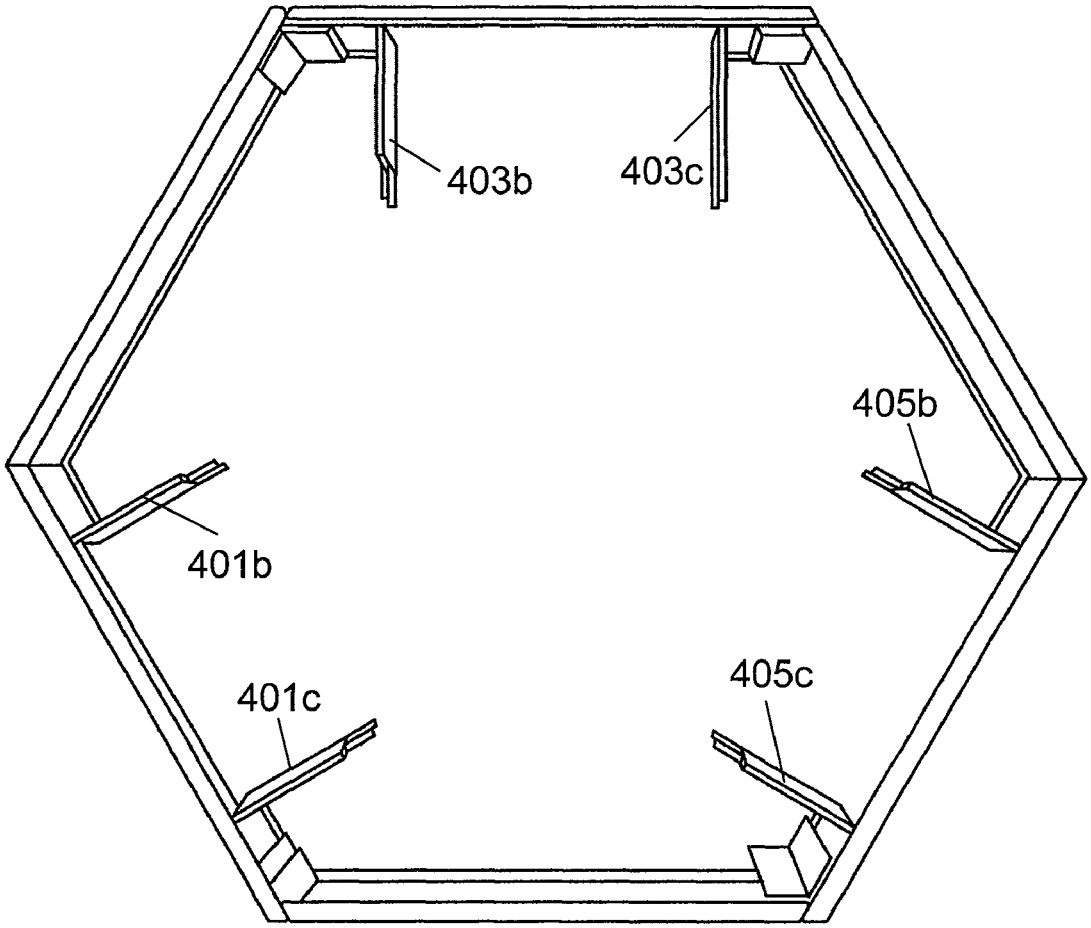
Figure 4E:
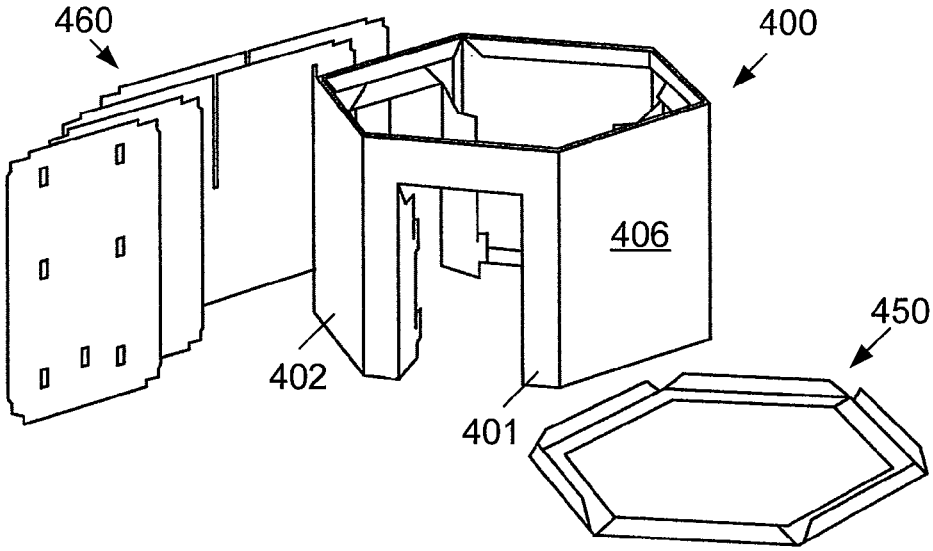
Figure 4F:
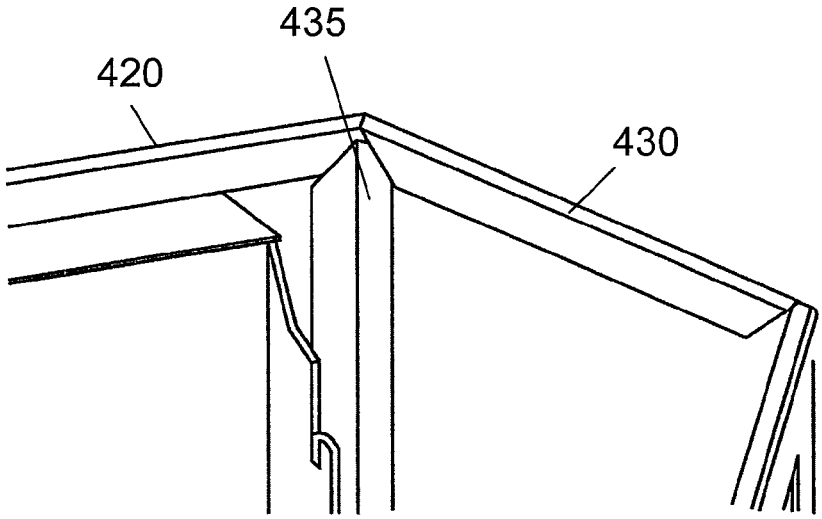
Figure 4G:
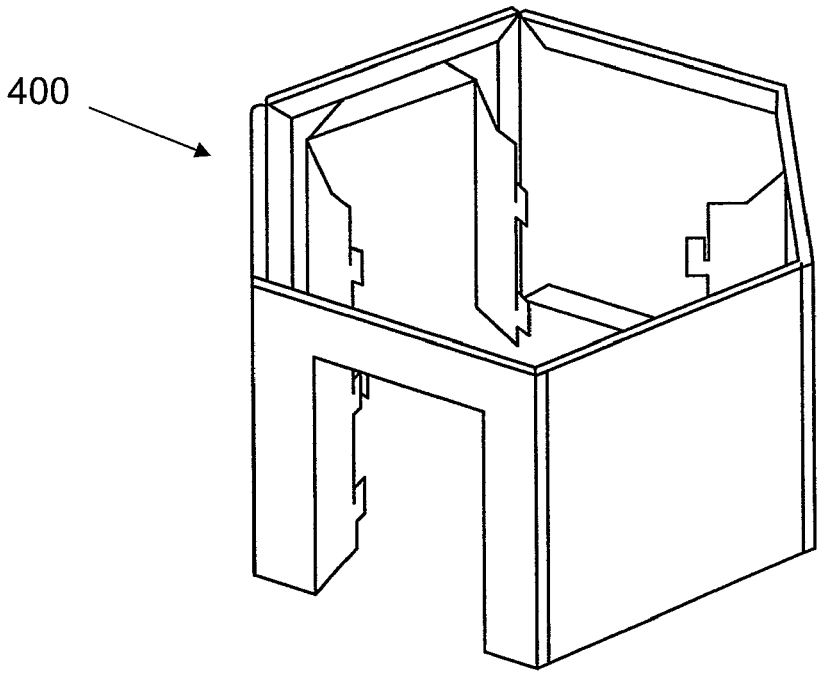
Figure 4H:
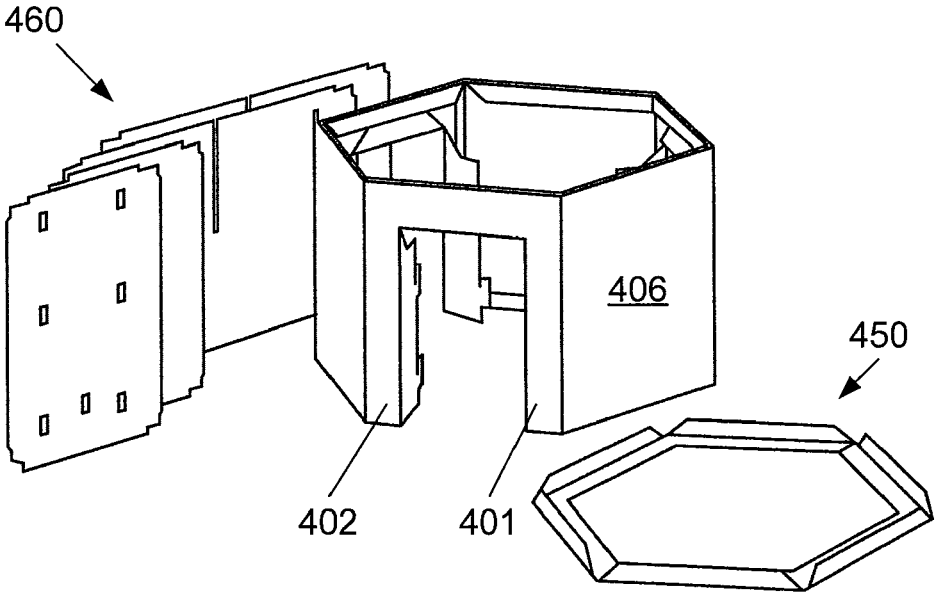
Figure 4I:
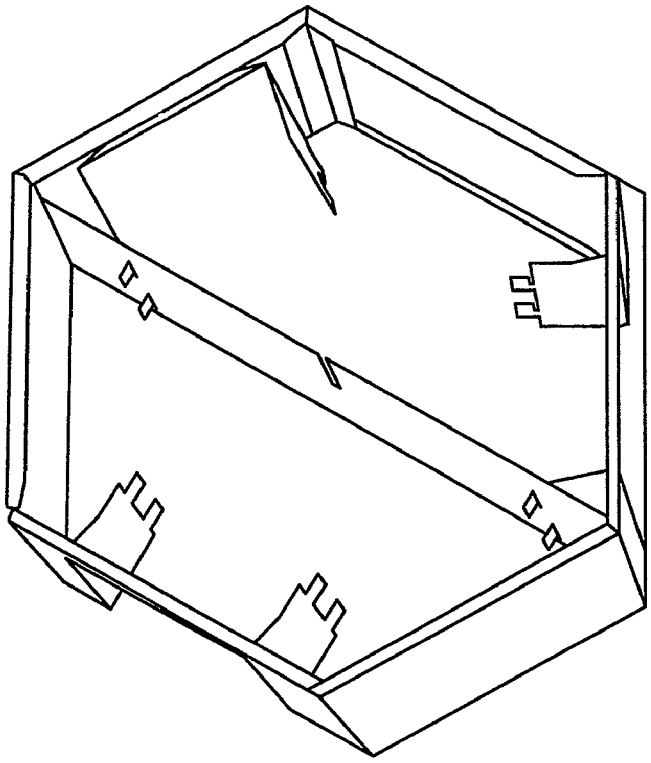
Figure 4J:
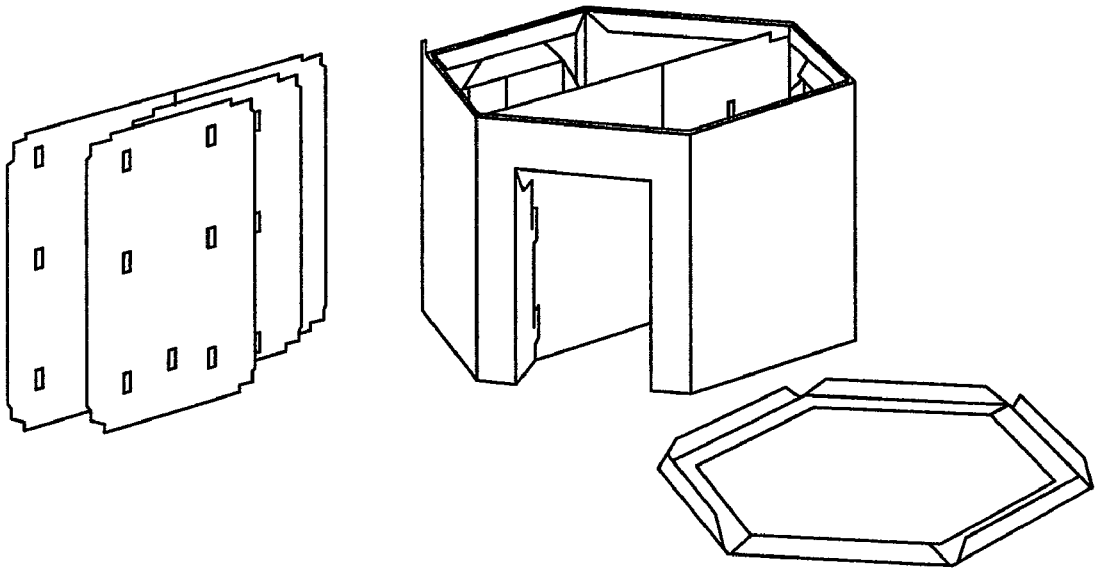
Figure 4K:
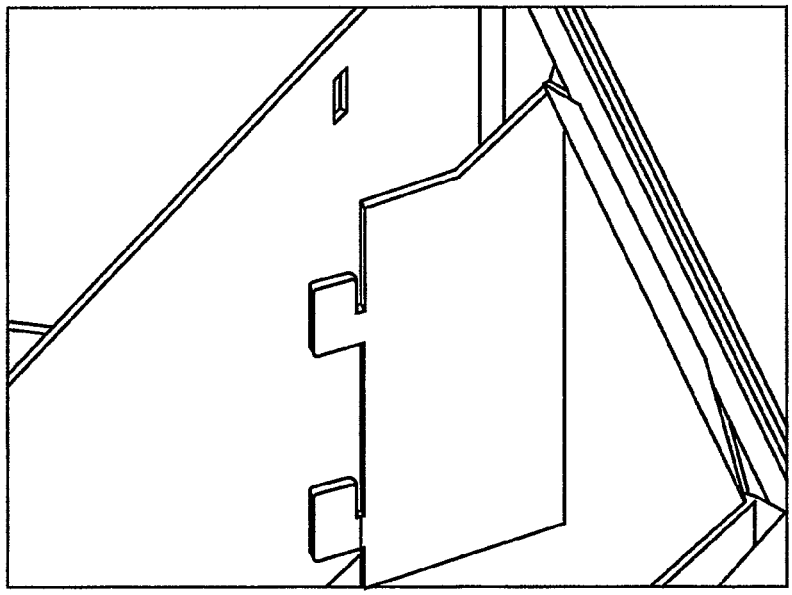
Figure 4L:
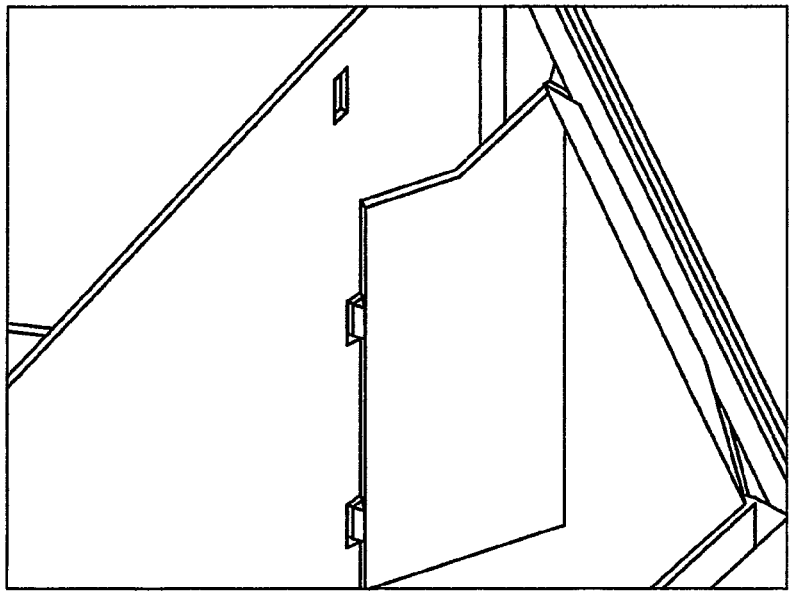
Figure 4M:
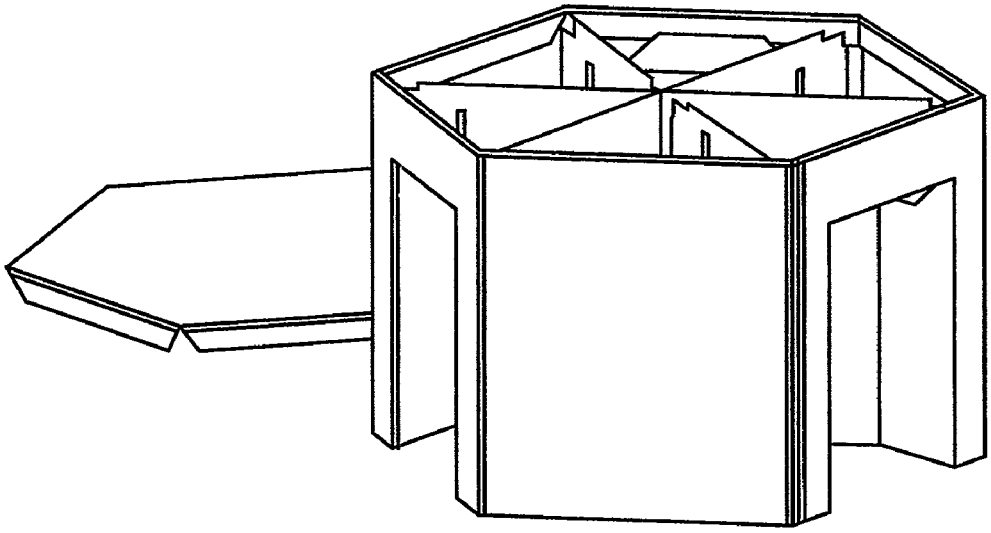
Figure 4N:
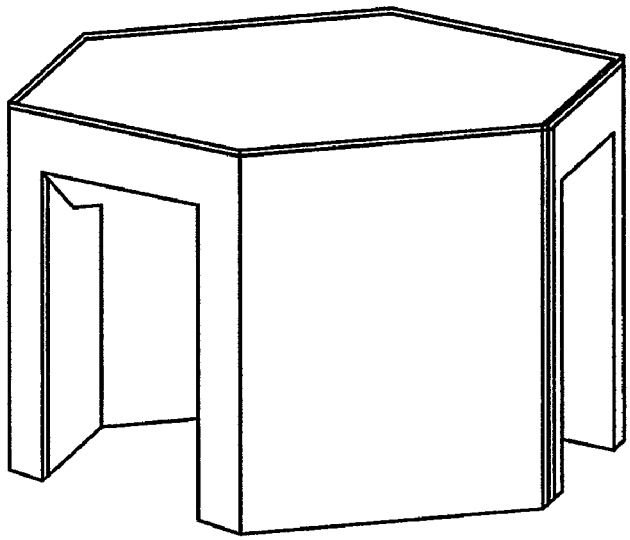

FIGS. 4A-4N illustrates the contents of a cardboard kit for use in assembling a table, generally designated 400, in FIG. 4A. The illustrated table is of hexagonal configuration, including six sides 410-406, covered at their upper ends by a table top 407.

Table 400 illustrated in FIG. 4A is similar to desk 300 illustrated in FIG. 3A, except for its hexagonal shape, and for the provision of openings in three of its side walls, namely openings 401*a*, 403*a* and 405*a* in side walls 401, 403 and 405, respectively, instead of the single opening in desk 300. The other differences between the two kits are more particularly described below.

FIG. 4C illustrates, in flat form, the cardboard sheets included in the kit for assembling table 400. These cardboard sheets are included in four units 410, 420, 430 and 440, which are preferably preassembled together at the factory as a sub-assembly and included in flat compact form in the kit. Units 410-440 define the six sides 401-406 of table 400, as will be described more particularly below.

The kit also includes unit 450 in flat form, which unit serves as the table top 407 of table 400; and unit 460, constituted of four cardboard sheets 461-464, which are inserted within the table, before application of the table top 407, to add structural strength to the assembled table.

As shown in FIG. 4C, unit 410 is a relatively long cardboard sheet formed with a middle fold line 410*a* to define the two sides 401, 402; unit 420 is a short cardboard sheet defining side 403; unit 430 is a long cardboard sheet formed with a middle fold line 430*a* defining the two sides 404, 405; and unit 440 is a short cardboard sheet defining side 406. Sides 401, 403 and 405 are formed with the openings 401*a*, 403*a* and 405*a*, respectively. Each of these openings is straddled by an inwardly-extending section of the respective cardboard sheet, as shown in FIG. 4D by extensions 401*b*, 401*c* for opening 401*a*; extensions 403*b*, 403*c* for opening 403*a*; and extension 405*b*, 405*c* for opening 405*a*.

The illustrated kit further includes the thin connector strips 435, 445, for assembling the four units 410-440 into the peripheral side wall of the table. Thus, thin connector strip 435 is adhesively joined to one of the ends of units 420 and 430, whereas thin connector strip 445 is adhesively joined to one of the ends of units 440 and 410. The opposite end of unit 410 is adhesively joined directly to the opposite end of unit 420, and the end of unit 430 is adhesively joined directly to the unit 440. As indicated earlier, the use of the thin connector strips 435 and 445 in the so-formed peripheral side wall of the table enables the peripheral side wall to assume a flat compact condition for storage, shipping, handling, etc. Thus, the four units 410-440 may be compactly packaged with the flat table top unit 450, as well as with the flat structural reinforcement sheets 461-464.

The cardboard sheets included in the kit for assembling the table 400 are also formed with fold lines similar to those formed in the cardboard sheets used for assembling the desk 300. Thus, the cardboard sheets illustrated in FIG. 4C are formed with the first fold lines, e.g., 410*a*, 430*a*, permitting the cardboard sub-assembly of units 410-440, to be expanded from the flat condition for shipping, to a three-dimensional condition to define the peripheral side walls 401-406 of table 400.

The cardboard sheets illustrated in FIG. 4C further include the second fold lines, e.g., 410*b*, spaced inwardly of the viewable edges of the side walls to define flaps which are folded inwardly and adhesively joined to the inner surfaces of the side walls, such as to present fold lines, rather than cut edges, at the viewable edges of the side walls.

Since the table top 407 is defined by unit 450, which is a separate unit from the others (as in the case of desk 300), the cardboard sheets illustrated in FIG. 4C do not include the third fold line mentioned above, permitting an extension of one of the cardboard sheets to be folded over the end of the peripheral side wall defined by units 410-440. But such fold lines could be provided as described above with respect to desk 300, particularly for smaller size tables. However, unit 450, defining the table top, includes the fourth fold lines 450*a* spaced inwardly of the outer edge of the table top to define the bendable flaps 451 receivable against the inner surface of the respective end of the peripheral side wall for frictionally retaining the table top in place over the side walls defined by units 441-440.

FIG. 4C illustrates a further cardboard sheet 452 in the shape of the outer margins of the table unit 450 for adhesive bonding to its underface for increasing the strength of the assembled table.

Unit 460, including the cardboard sheets 461-464 for structurally supporting the table, are assembled as a radiating array within the table, as shown for example in FIG. 4M, rather than as an egg-crate array as shown in FIG. 3B in table 300. For this purpose, two of the cardboard sheets 461, 462 are provided with slots extending for one-half their lengths at the mid portions of the respective cardboard sheets such that each defines two sides of the radial array. This is done by inserting the unslotted portion of one sheet into the slotted portion of the other sheet. The two remaining cardboard sheets 463, 464 are then inserted between the four sides defined by cardboard sheets 461, 462, and define the remaining two sides of the six-sided radial array.

Cardboard sheets 461-464 are further formed with openings to receive tabs formed in the inner ends of the extensions 401*b*, 401*c*, 403*b*, 403*c*, 405*b* and 405*c*, straddling the openings in side walls 401, 403 and 405, respectively. These extensions, as well as all the other surfaces of the cardboard sheets which are viewable in the assembled table 400, are colored or otherwise ornamented to thereby provide the assembled table with a very pleasing appearance. It will be appreciated that table 400, in its assembled condition, also does not present cut edges, but rather fold lines, at all the exposed edges of the assembled table, thereby further enhancing the appearance of the assembled table.

In the following embodiments, two adjacent exterior members are interconnected by concealable embedded fasteners so that, in addition to an improved esthetic appearance, the fasteners do not protrude the outer face of a member, thereby allowing the assembled article to be positioned flush with a wall of a room in which it is disposed.

FIGS. 5-9 illustrate the interconnection of two exterior members by means of male and female rivets, according to one embodiment of the present invention. It will be appreciated that any other suitable fastener well known to those skilled in the art may be employed.

Figure 5:
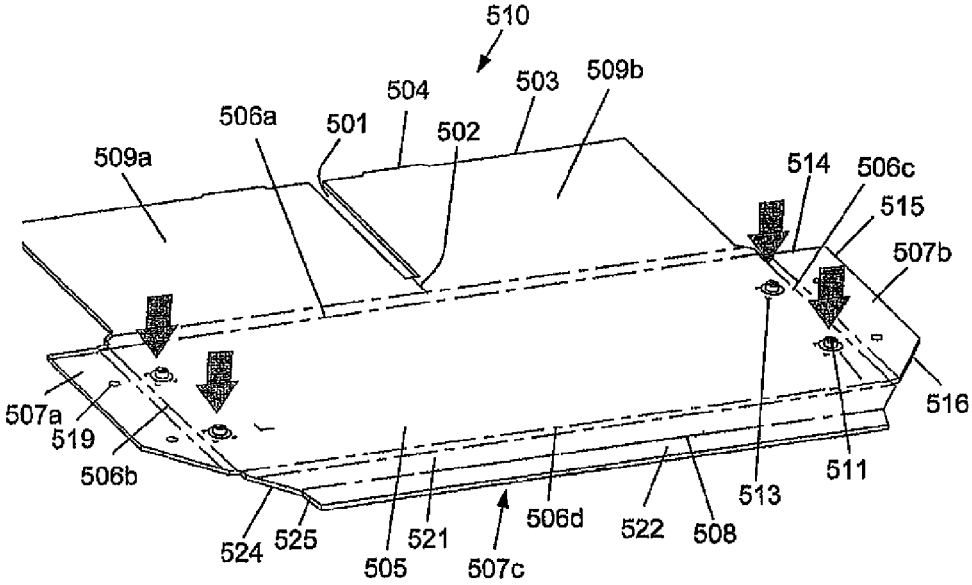
FIG. 5 is a top perspective view of precut sheet material, for fabricating an exterior member of a three-dimensional article, according to one embodiment of the present invention.

FIG. 5 illustrates an exterior member 510 prior to being fabricated at a factory. Exterior member 510, as well as the other members of a given three-dimensional article (hereinafter "article" for brevity), is made of sheet material which is precut according to a predetermined configuration and is formed with a predetermined arrangement of fold lines to enable the member to be expanded from a flat condition to an expanded three-dimensional condition.

Figure 11:
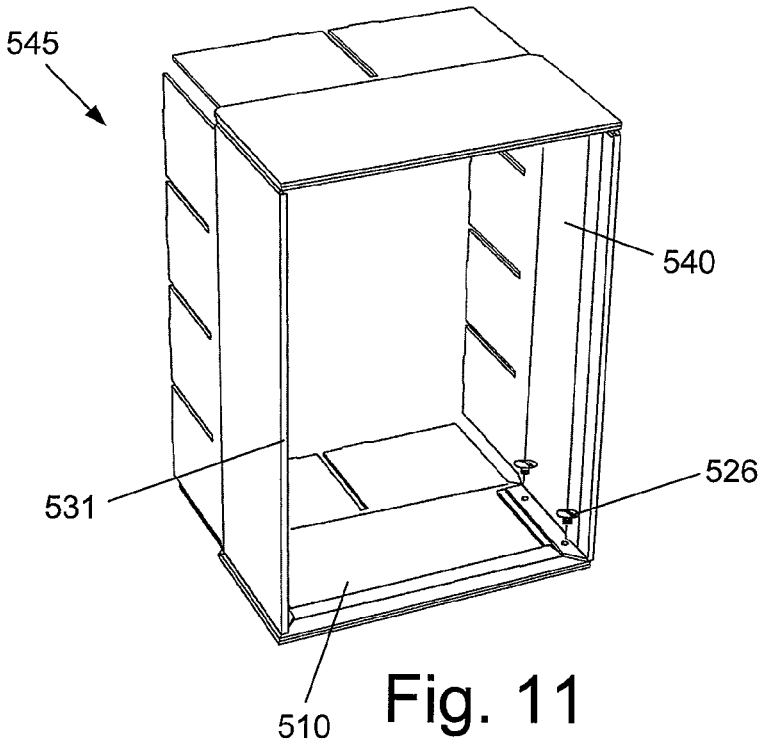
FIG. 11 is a perspective view from the inward side of a frame unit assembled from the members of FIG. 10.

As shown, the inner side of exterior member 510 has a rectangular base portion 505, each edge of which bordering a corresponding fold line 506*a-d*, side flaps 507*a* and 507*b* extending transversally from fold lines 506*b* and 506*c*, respectively, inward flap 507*c* extending from fold line 506*d*, and spaced substantially rectangular extensions 509*a* and 509*b* extending from fold line 506*a*. Base portion 505 is the portion of an exterior member that is visible when the three-dimensional article is fully assembled, e.g. a wall of a cabinet. The flaps are accessible to the inner side of the exterior member, but not to the outer side thereof, as shown in FIG. 11.

Figure 23:
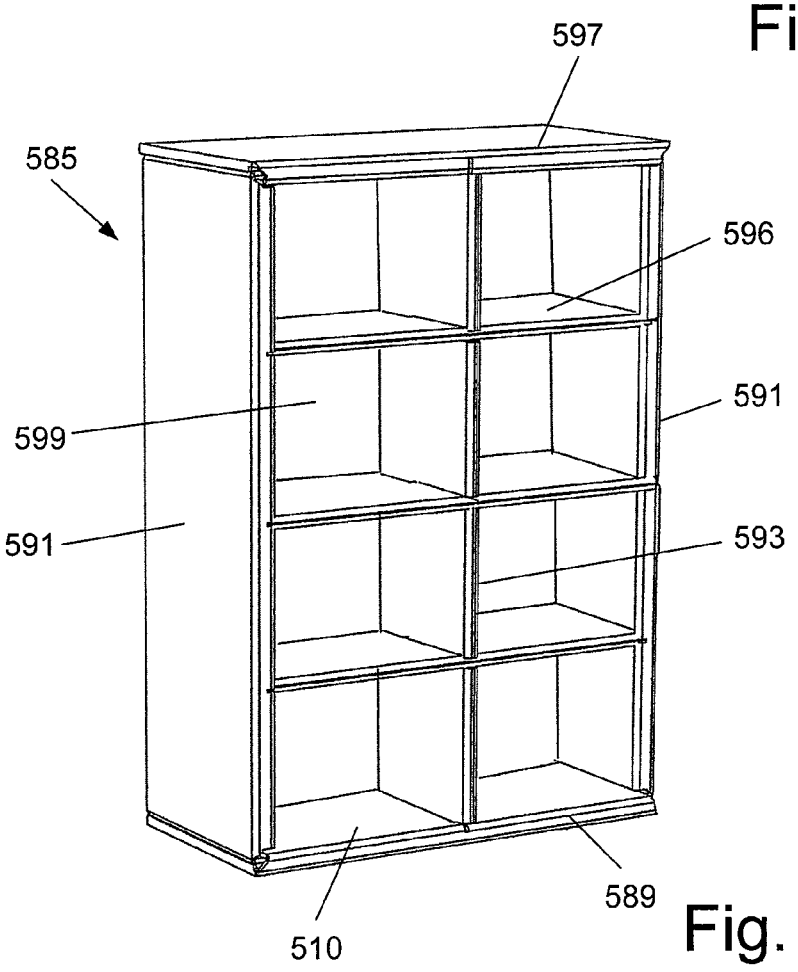
FIG. 23 is a perspective view from the front of a fully assembled cabinet.

As referred to herein, the term "outwardly" means in a direction towards a user who is to access the assembled article, with respect to the disposition of the element of the instantaneous stage of assembly. Thus when exterior member 510 is employed in a cabinet 585, and the cabinet is fully assembled as shown in FIG. 23, its outward edge 589 is the bottommost viewable edge of the cabinet facing the room in which the cabinet is located. However, when exterior member 510 has not yet been fabricated, edge 503 of extensions 509*a* and 509*b* distant from fold line 506*a* is the outward edge. Conversely, an "inward" direction is opposite to the "outward" direction, namely away from a user who is to access the assembled article.

The term "outer" means the side of the member facing the room, generally one that is visible when the article is fully assembled. The term "inner" means the side of the member facing away from the room, generally one that is not visible when the article is fully assembled.

Each side flap of exterior member 510 has a short edge 514 substantially collinear with fold line 506*a*, a relatively long edge 515 substantially perpendicular to edge 514, and an oblique edge 516 extending from edge 515 to fold line 506*d*. Two apertures 519 equally spaced from the corresponding fold line are bored in each side flap. Inward flap 507*c* has an intermediate fold line 508 substantially parallel to fold line 6*d*, dividing the inward flap into a first portion 521 abutting fold line 506*d* and a second portion 522. While edges 524 of first portion 521 are oblique with respect to fold line 506*d* and extend from fold line 506*b* of a corresponding side flap, edges 525 of second portion 522 are perpendicular to fold line 506*d*, extending from a corresponding oblique edge 524 and transversally spaced from a corresponding side flap fold line 506*b*.

When in the flat condition, extensions 509*a* and 509*b* are spaced by a rectangular void area 501, and a cut line 502 bordering abutting portions of the adjacent extension extends perpendicularly from fold line 506*a* to void area 501. A substantially rectangular projection 504 slightly protrudes from outward straight edge 503 of each extension, and is relatively close to void area 501.

Base portion 505 is provided with four marked regions 513 equally spaced from a corresponding aperture 519 arranged such that two marked regions are proximate to fold line 506*b* and two marked regions are proximate to fold line 506*c*. A female rivet 511 is placed on each marked region 513 such that the hollow stem of the rivet is facing upwardly.

Figure 6:
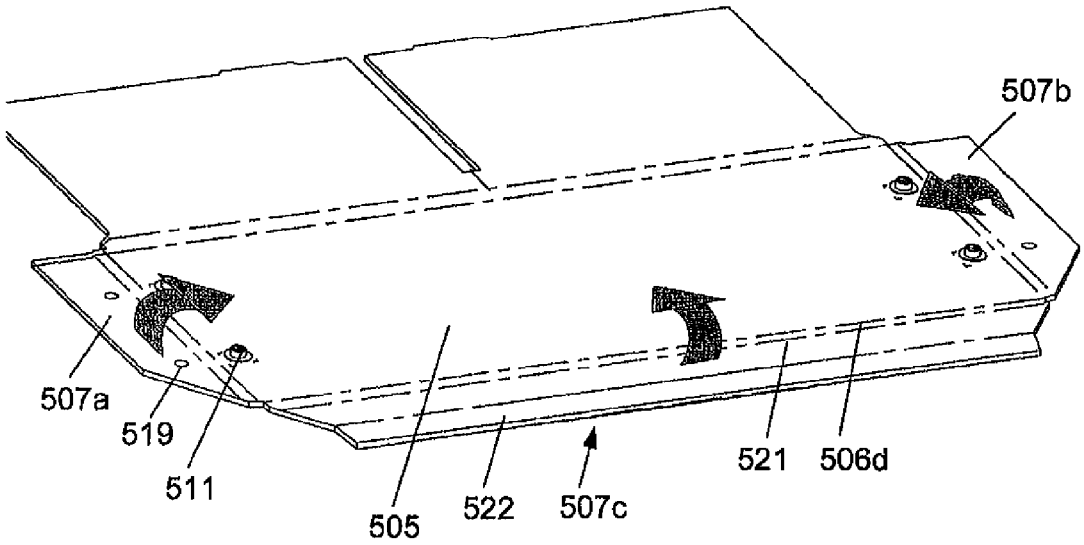
FIG. 6 is a top perspective view of the sheet material of FIG. 5, showing the placement of female fasteners thereon and the folding of flaps thereof.
Figure 7:
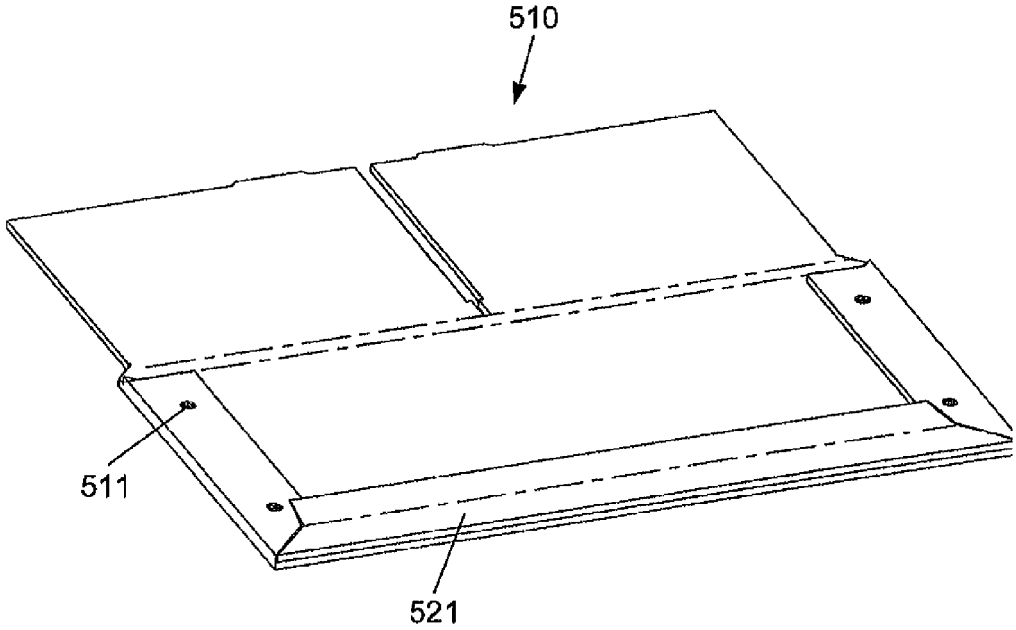
FIG. 7 is a top perspective view of a fabricated exterior member produced from the sheet material of FIG. 5.

In FIG. 6, side flaps 507*a* and 507*b* are folded and adhesively affixed to base portion 505 in such a way that the stem of each female rivet 511 is received in a corresponding aperture 519. Bottom flap 507*c* is then folded along fold line 506*d* while first portion 521 is adhesively affixed to base portion 505. A fabricated exterior member 510 is illustrated in FIG. 7, whereby two female rivets 511 are embedded in a corresponding side flap and an oblique edge of inward flap first portion 521 abuts an oblique edge of a corresponding side flap 507*a*.

Figure 8:
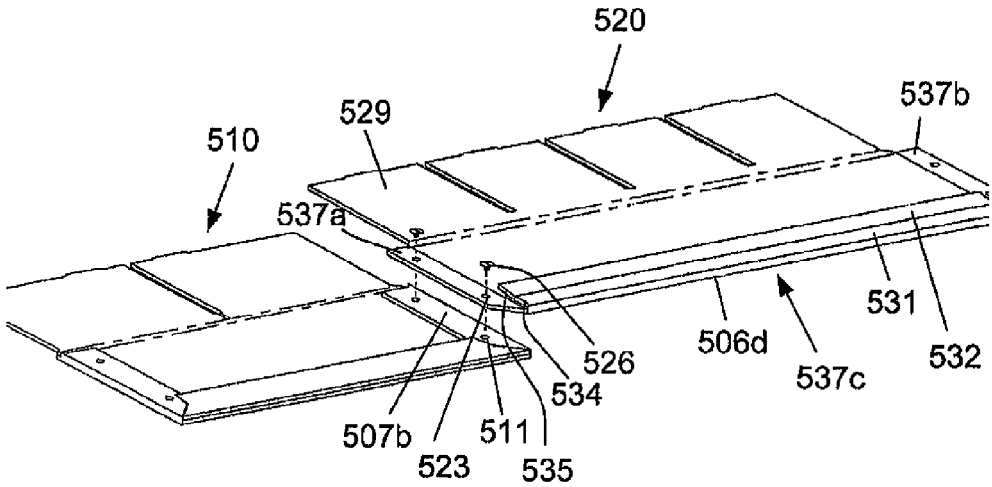
FIGS. 8 and 9 are top perspective views of the interconnection of the exterior member of FIG. 7 and another exterior member.

FIG. 8 illustrates an exterior member 520 which has four equally sized and spaced extensions 529 and which is configured similarly as exterior member 510, with the exception of its inward flap 537*c* provided with first portion 531 and second portion 532 having collinear edges 534 and 535, respectively, substantially perpendicular to fold line 506*d*.

Figure 9:
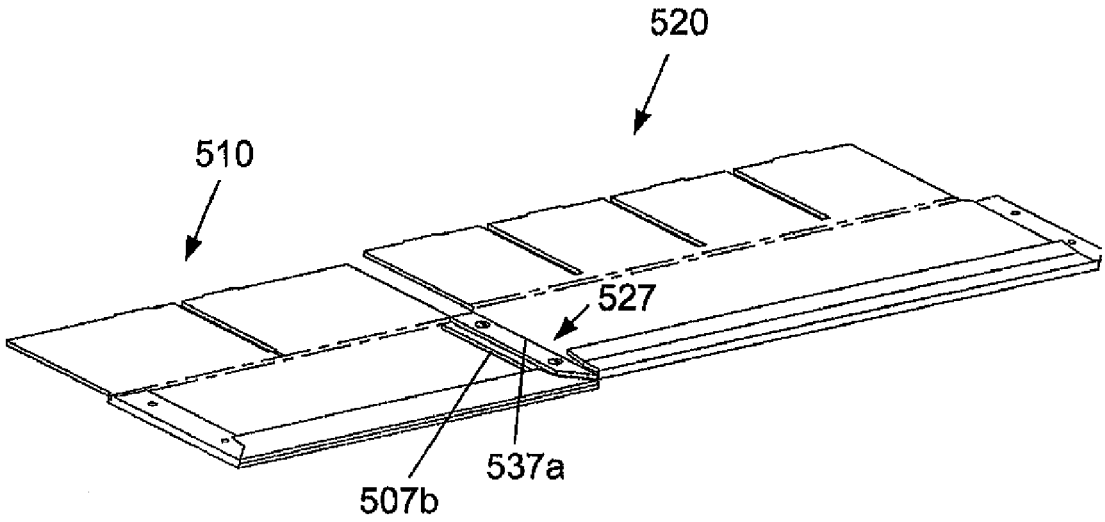

Exterior member 520 is shown to be interconnected with the fabricated member 510. While side flaps 537*a* and 537*b* of member 520 are opened, the two apertures 523 bored in side flap 537*a* are aligned with the two female rivets 511, respectively, embedded in side flap 507*b* of exterior member 510. A male rivet 526 is then introduced in a corresponding aperture 523 and fastened with a corresponding female rivet 511, so that side flap 537*a* of member 520 overlies side flap 507*b* of member 510 while members 510 and 520 are interconnected to form a reinforced connection 527, as shown in FIG. 9. In this fashion, a plurality of exterior members may be serially interconnected without interfering with an adjacent bottom flap outer portion, yet a first exterior member may be angularly disposed with respect to a second exterior member in order to assemble a given three-dimensional article without unduly straining the fold line between the first and second interconnected members.

It will be appreciated that all exterior members of a frame unit may comprise a first side flap in which female rivets are embedded and a second side flap, through the apertures formed therein male apertures may be introduced and coupled with the embedded rivets of the first side flap of an adjacent exterior member.

FIGS. 10-23 illustrate the assembly of a cabinet 585, which may be quickly and effortlessly carried out at the home or workplace of a user.

Figure 10:
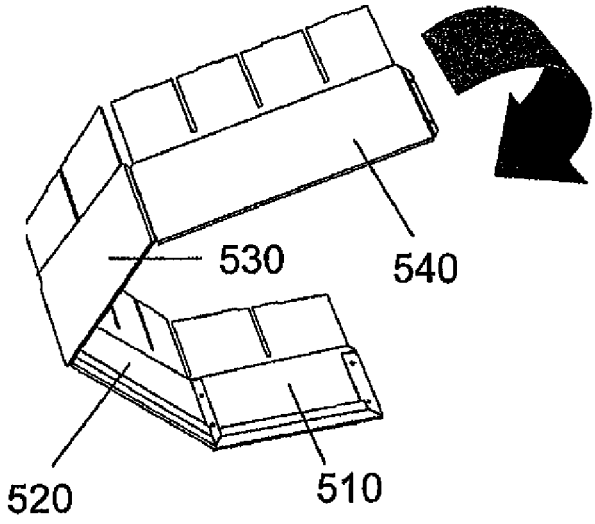
FIG. 10 illustrates the setting of four interconnected exterior members to different angular dispositions.

In FIG. 10, serially interconnected exterior members 510, 520, 530 and 540 are angularly displaced one to the other. Member 530 is identical to member 510, and member 540 is identical to member 520. When each pair of adjacent exterior members are mutually perpendicular as shown in FIG. 11, first member 510 and last member 540 are interconnected by means of male rivets 526 to form a frame unit 545.

Figure 12:
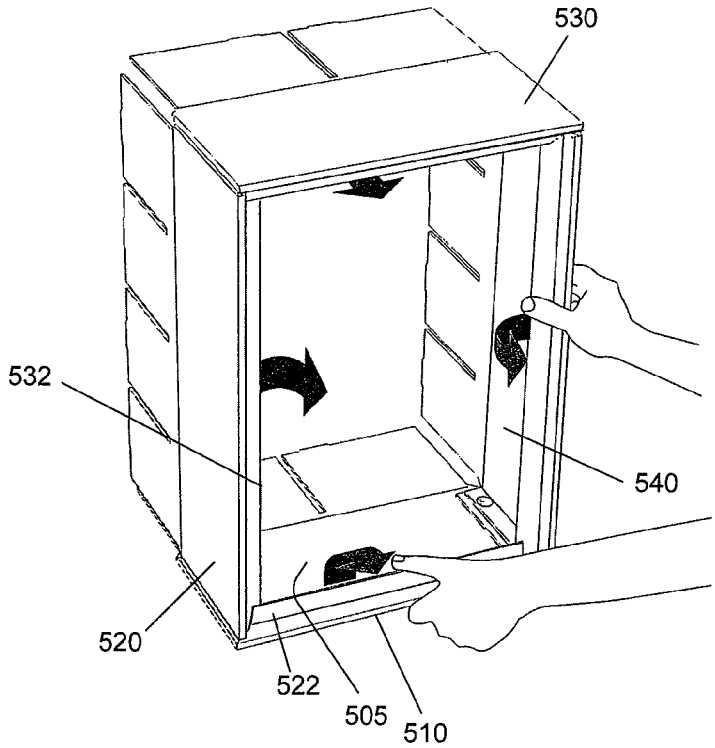
FIG. 12 is a perspective view from the inward side of the frame unit of FIG. 11, showing the opening of inward flap second portions.

In FIG. 12, the inward flap second portion of each of exterior members 510, 520, 530 and 540 is opened until it is substantially perpendicular to the corresponding base portion 505. Inward flap second portion 522 of members 510 and 530 are first opened, and then inward flap second portion 532 of members 520 and 540 are then opened so that each end of a second portion 532 will be restrained by a corresponding end of a second portion 522 perpendicular thereto.

Figure 13:
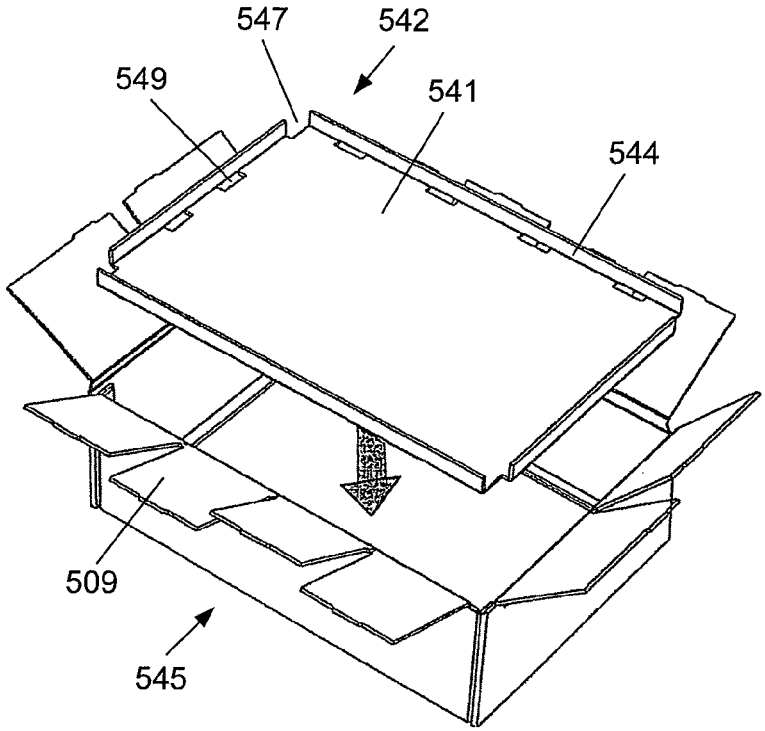
FIG. 13 is a perspective view from the outward side of the frame unit of FIG. 11, showing the introduction of a folded insert within the interior thereof.

As shown in FIG. 13, an insert 542 serving as a back of the cabinet is inwardly introduced into frame unit 545, i.e. in the direction from extensions 509 to the inward flap first portions. In the flat condition, rectangular central portion 541 of insert 542 and the four peripheral elements 544 extending from a corresponding edge thereof are coplanar. Central portion 541 is formed with a plurality of rectangular apertures 549, each set of spaced apertures adjoining the fold line between the central portion 541 and the corresponding peripheral element 544. The number of apertures 549 of a set which adjoins a given fold line between central portion 41 and the corresponding peripheral element 544 is equal to the number of extensions 509 that are provided at the same side of frame unit 545. Prior to being introduced into frame unit 545, the four peripheral elements 544 of insert 542 are folded such that they are substantially perpendicular to, and extend outwardly from central portion 541 and that a corner opening 547 is formed between two adjacent peripheral elements.

Figure 14:
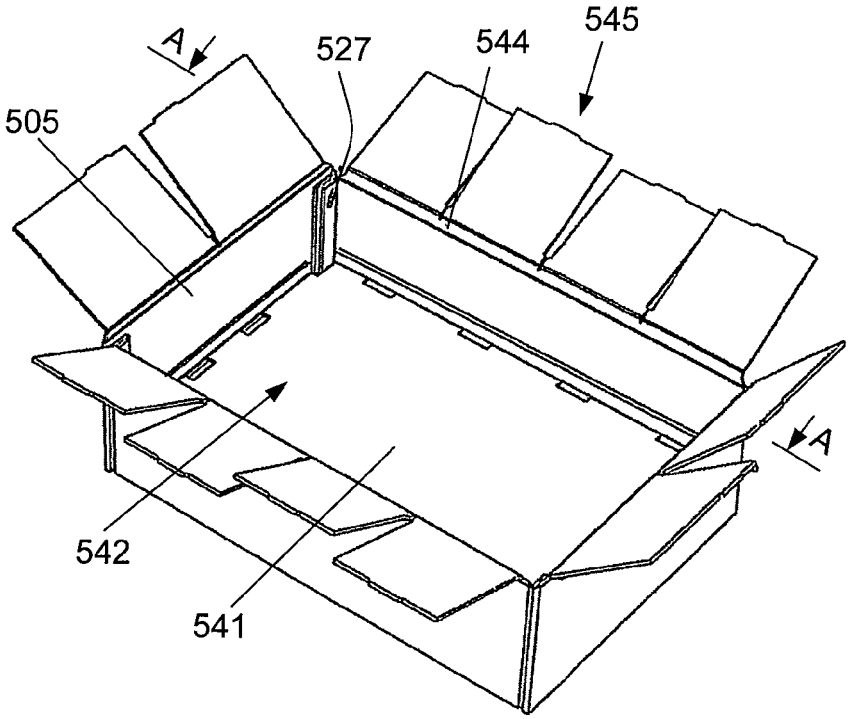
FIG. 14 is a perspective view from the outward side of the frame unit of FIG. 11, showing the proximity of the insert of FIG. 13 to a reinforced connection after having introduced within the frame unit.

FIG. 14 illustrates the folded insert 542 after it has been introduced into frame unit 545, showing two peripheral elements 44 of the insert that abut, or are slightly spaced from, the inward end of a corresponding reinforced connection 527 of the frame unit. The perimeter of central portion 541 of insert 542 is sized to be essentially equal to the perimeter of frame unit 545 as defined by the spacing between the base portion 505 of opposite exterior members.

Figure 15:
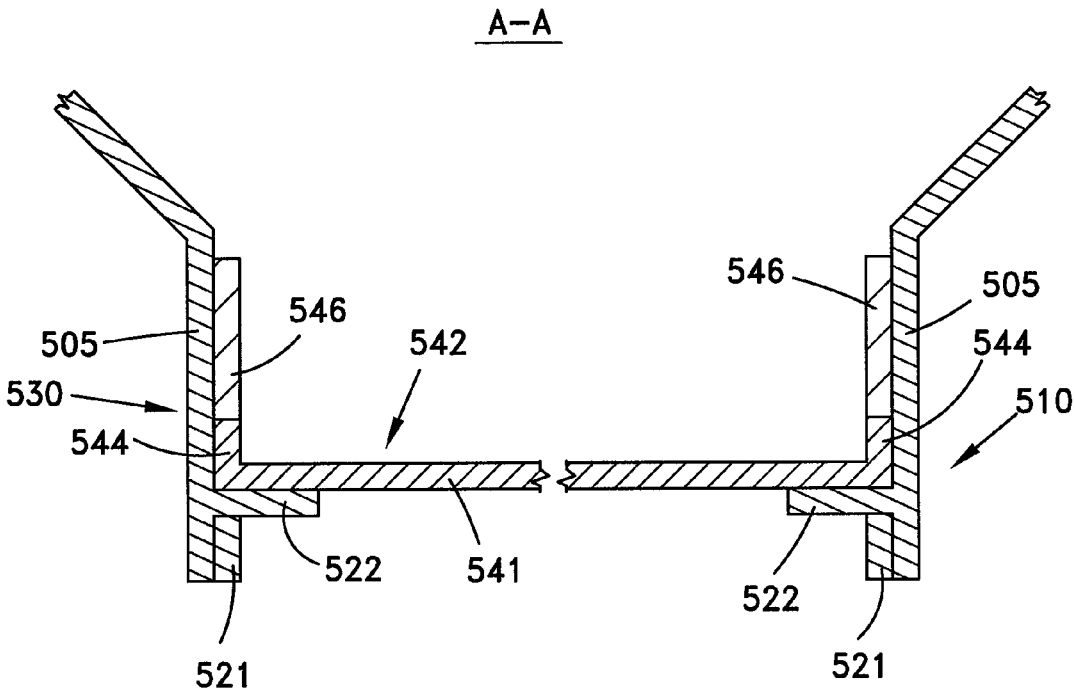
FIG. 15 is a fragmented cross sectional view of the insert of FIG. 13 in contact with the inward flap second portions of FIG. 12, cut about plane A-A of FIG. 14.

As shown in FIG. 15, a reinforcement 546 is adhesively affixed to the base portion 505 of the exterior members, e.g. members 510 and 530, so as to be outwardly spaced from the opened inward flap second portions, e.g. second portions 522. The interspace between a reinforcement 546 and an inward flap second portion serves to properly position insert 542 after it has been introduced into the frame unit. While insert 542 is being introduced into the frame unit, each peripheral element 544 slidingly contacts a corresponding reinforcement 546 until central portion 541 contacts the four inward flap second portions, whereupon each peripheral element 544 is received in a corresponding interspace between a reinforcement 546 and an inward flap second portion and is able to contact base portion 505.

Figure 16:
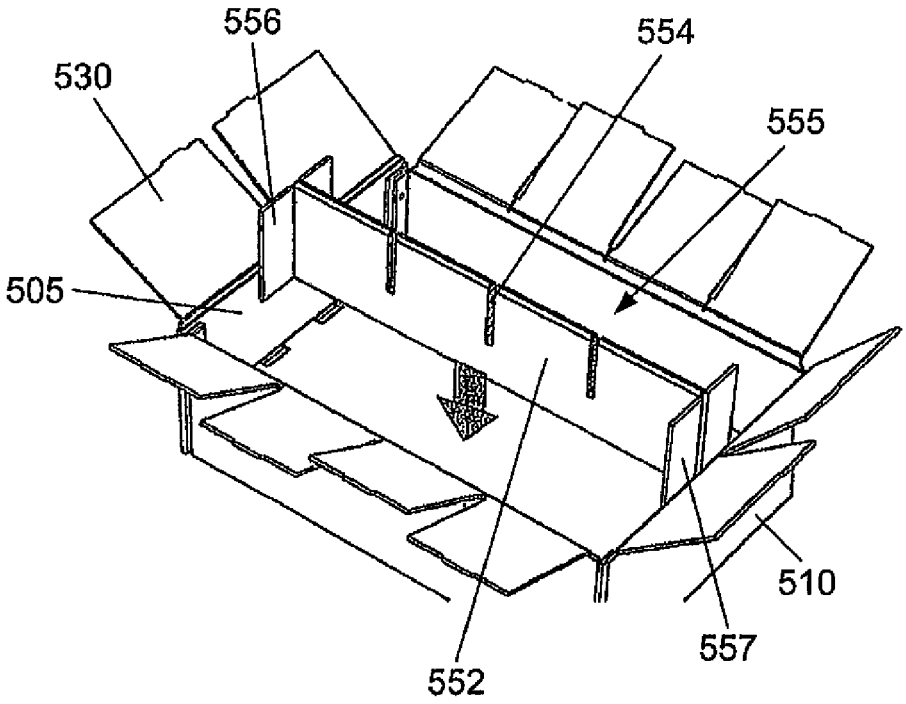
FIGS. 16 and 17 perspective view from the outward side of the frame unit of FIG. 14, showing the introduction therein of a stabilizing element.

FIG. 16 illustrates a stabilizing element 555 that serves as the spine of the cabinet. Stabilizing element 555 is adapted to be in frictional engagement with exterior members 510 and 530 and for providing structural stability to the cabinet. Stabilizing element 555 comprises web 552, which is formed with a plurality of equally spaced and mutually parallel notches 554, and with flanges 556 and 557 provided at each end of web 552. As stabilizing element 555 is configured similarly to an I-beam, it has a relatively high strength to weight ratio. Notches 554 are outwardly extending, being formed only in an outward region of stabilizing element 555. When stabilizing element 555 is in the flat condition, two portions of each of flanges 556 and 557 are in abutting relation with each other, extending continuously from web 52, or alternatively, abut web 552. When the flange portions are expanded, they are adapted to be perpendicular to web 552. The length of stabilizing element 555 from flange 556 to flange 557 is essentially equal to the spacing between base portion 505 of member 530 to the base portion of member 510.

Figure 17:
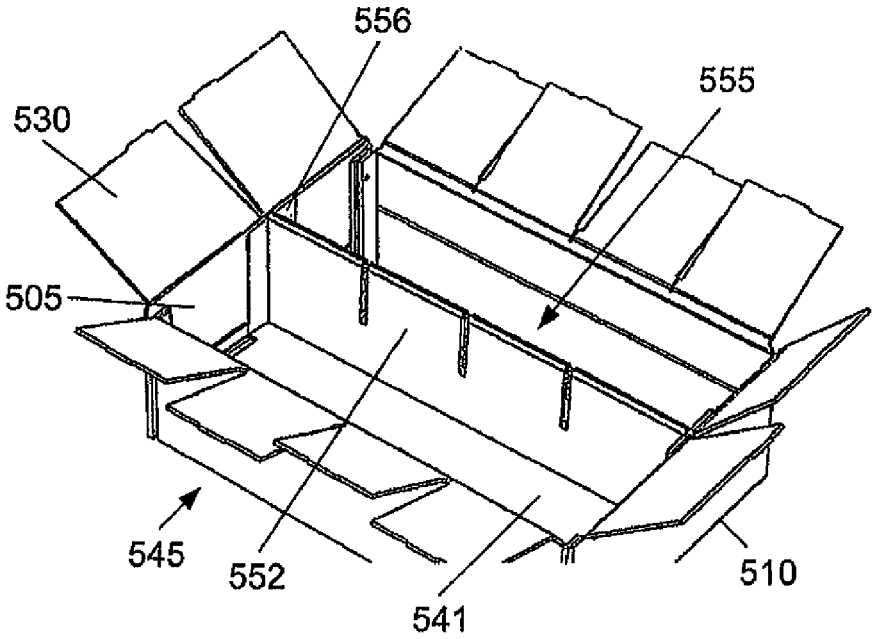

In FIG. 17, stabilizing element 555 is introduced into the interior of frame unit 545 until web 552 contacts central portion 541 of the insert and flanges 556 and 557 frictionally engage base portion 505 of members 530 and 510, respectively.

Figure 18:
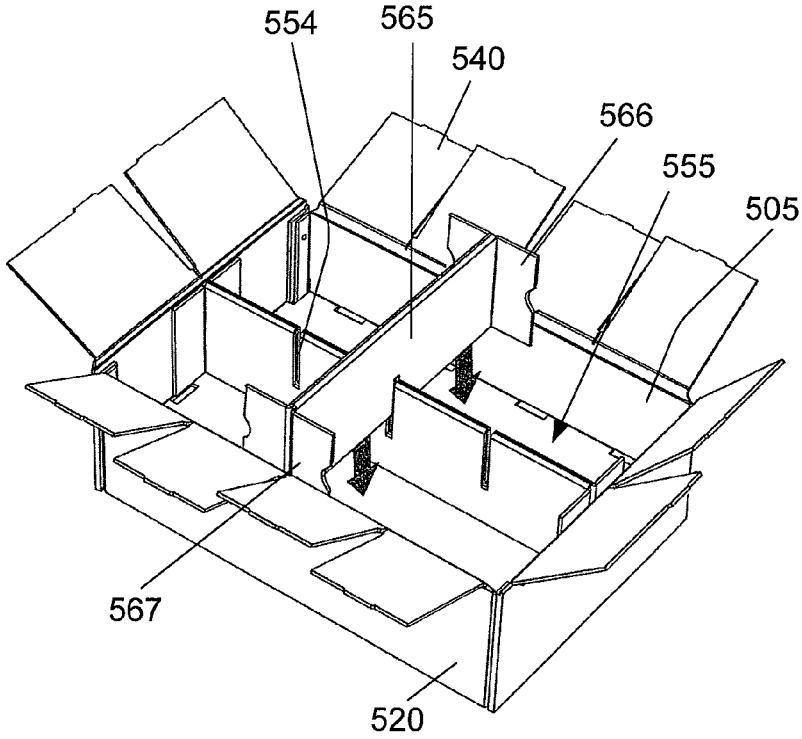
FIGS. 18 and 19 are perspective views from the outward side of the frame unit of FIG. 17, showing the introduction therein of a shelf element that interconnects with the stabilizing element of FIG. 17.
Figure 19:
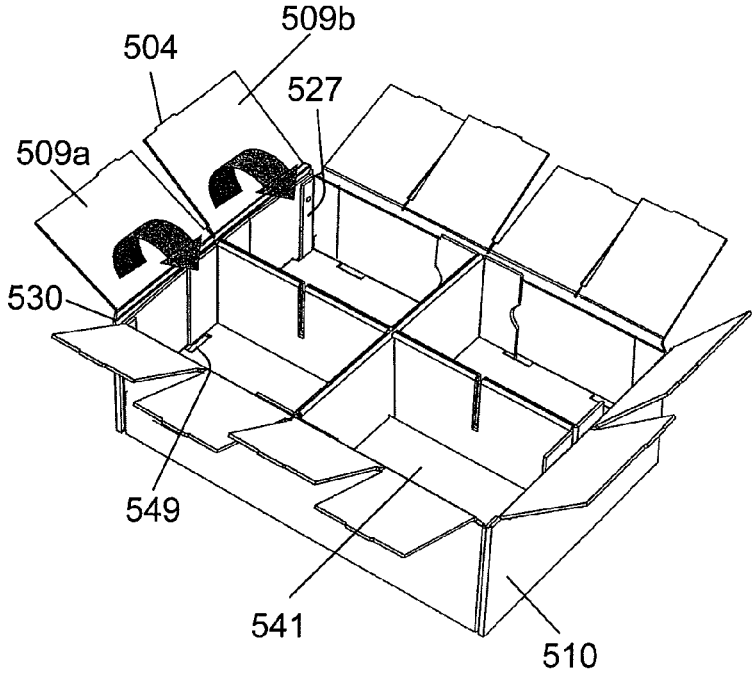
Figure 20:
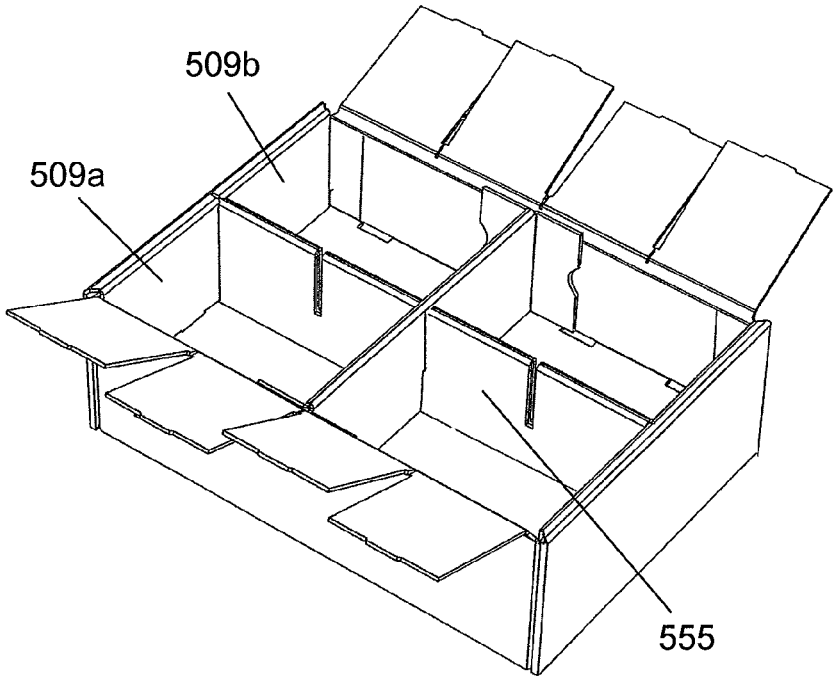
FIG. 20 is perspective view from the outward side of the frame unit of FIG. 17, showing the inward folding of frame unit extension to secure the insert of FIG. 13 and to conceal the reinforced connection of FIG. 14.
Figure 21:
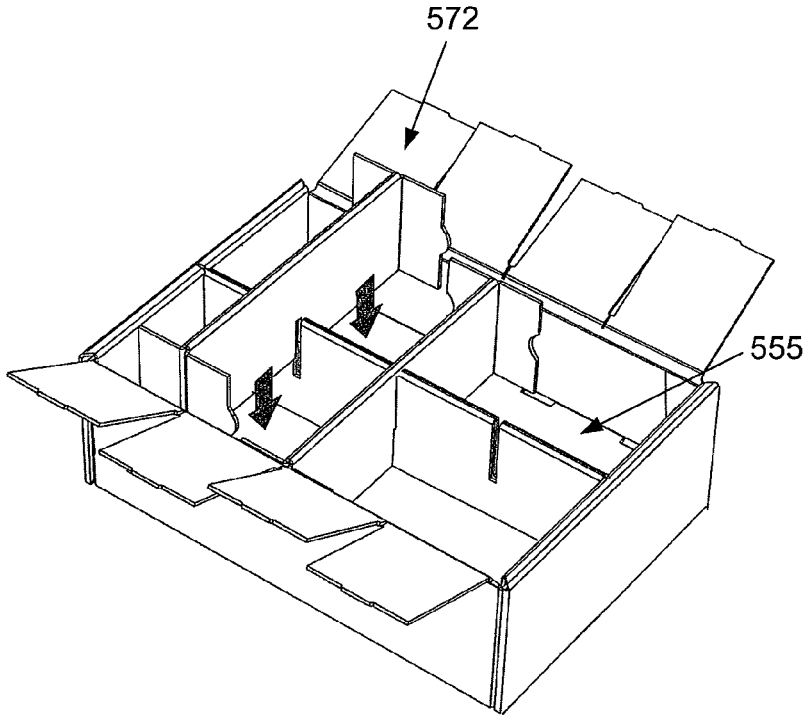
FIG. 21 is a perspective view from the outward side of the frame unit of FIG. 20, showing the introduction therein of an additional shelf element that interconnects with the stabilizing element of FIG. 17.

Referring to FIGS. 18-21, web 565 of shelf element 562, which serves as a shelf of the assembled cabinet and is configured similarly as stabilizing element 555 but having a shorter web, is formed with a single notch. When shelf element 562 is oriented such that its notch is inwardly extending, the notch of shelf element 562 is interconnected with the central notch 554 of stabilizing element 555, as shown in FIG. 18. The length of shelf element 562 from flange 566 to flange 567 is essentially equal to the spacing between base portion 505 of member 520 to the base portion of member 540. Shelf element 562 is then introduced into the interior of the frame unit, as shown in FIG. 19, until web 565 contacts central portion 541 of the insert and flanges 566 and 567 frictionally engage base portion 505 of members 540 and 520, respectively. Extensions 509*a* and 509*b* of each of members 510 and 530 are then inwardly folded until the rectangular projections 504 are engaged with the corresponding apertures 549 of the insert, thereby concealing the corresponding reinforced connection 527, as shown in FIG. 20, as well as urging a peripheral element of the insert to contact a corresponding base portion in the manner illustrated in FIG. 15 and contacting a corresponding flange portion of stabilizing element 555. Two other shelf elements 572 are similarly interconnected with stabilizing element 555, as shown in FIG. 21.

Figure 22:
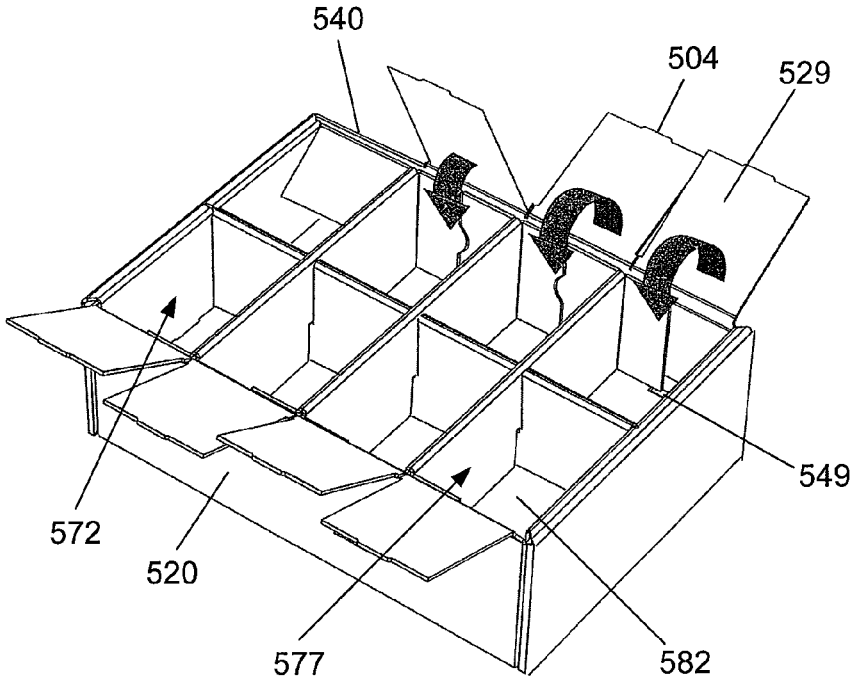
FIG. 22 is a perspective view from the outward side of the frame unit of FIG. 21, showing the inward folding of a frame unit extension into a corresponding cell.

As shown in FIG. 22, eight cells 582 are defined by the various interconnected members in the volume between a first exterior member and between a shelf element and between a second exterior member that is perpendicular to the first exterior member and the spine. The four extensions 529 of each of exterior members 520 and 540 are inwardly folded within a corresponding cell until contacting a corresponding flange portion and each rectangular projection 504 is engaged with a corresponding aperture 59 formed within the central portion of the insert.

A fully assembled cabinet 85 is illustrated in FIG. 23. Cabinet 585 is shown to have two outer walls 591, spine 593 parallel to outer walls 591, four shelves 596 perpendicular to walls 591, top 597, and back 599. Cabinet 585 may be placed in abutting relation with a wall by means of the inward flap first portions 521, 531 (FIGS. 8, 11, and 15) extending along the inward perimeter of the cabinet, and may be hung on a wall by suitable means attached to, or protruding from, the inner face of back 599. Alternatively, cabinet 585 is sufficiently sturdy to be placed in the middle of a room without being supported by a wall.

As cabinet 585 has been assembled by means of embedded fasteners, reinforced connections, and inwardly folded extensions that conceal the reinforced connections, as described hereinabove, the fasteners do not inwardly protrude from back 99, and therefore cabinet 85 may be placed flush with a wall. Outer walls 91 and back 99 are presented with an esthetically pleasing appearance since the fasteners are not noticeable.

The interconnection of spine 593 and shelves 96 increases the load bearing capacity and compressive strength of cabinet 585. The pressing action of an inwardly folded extension 29 onto a corresponding portion of shelf element flange 567 (FIGS. 18 and 22) increases the shear strength of shelves 596, i.e. preventing vertical displacement of a shelf 596 relative to an outer wall 591. Such an arrangement is suitable for a cabinet of relatively small dimensions, e.g. a cabinet perimeter of 70×35, suitable for retaining small objects such as compact discs.

Figure 35:
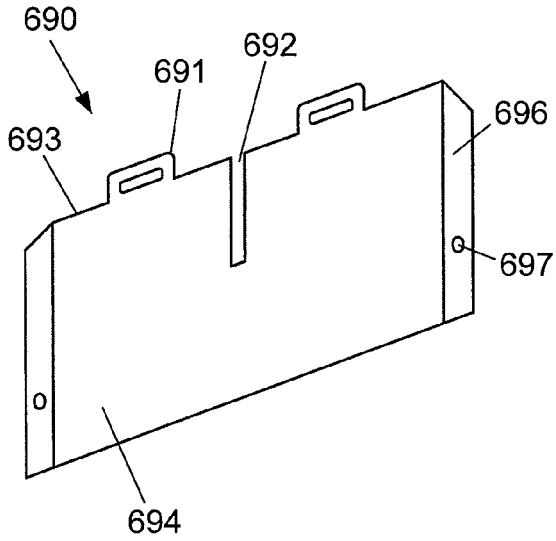
FIG. 35 is a top perspective view of a shelf element, according to an embodiment of the invention.

When cabinet 585 has significantly larger dimensions and is therefore suitable for retaining larger and heavier objects, shelf element 690 illustrated in FIG. 35 may be employed. Shelf element 690 comprises two U-shaped appendages 691 that protrude from inward edge 693 of shelf 694, notch 692 for interconnection with the spine, which may be stabilizing element 555 of FIG. 16, or spine member 695 illustrated in FIG. 36 that also comprises an integral back 685 and contact elements 687 for abutting walls of the cabinet and for increasing its load bearing capacity, flange portions 696 bored with at least one aperture 697, so that when expanded, each flange portion 697 can be fastened to an outer wall of the cabinet. Appendages 691 are configured such that their closed end faces inwardly and their legs extending from the closed end extend to inward edge 693.

Figure 37A:
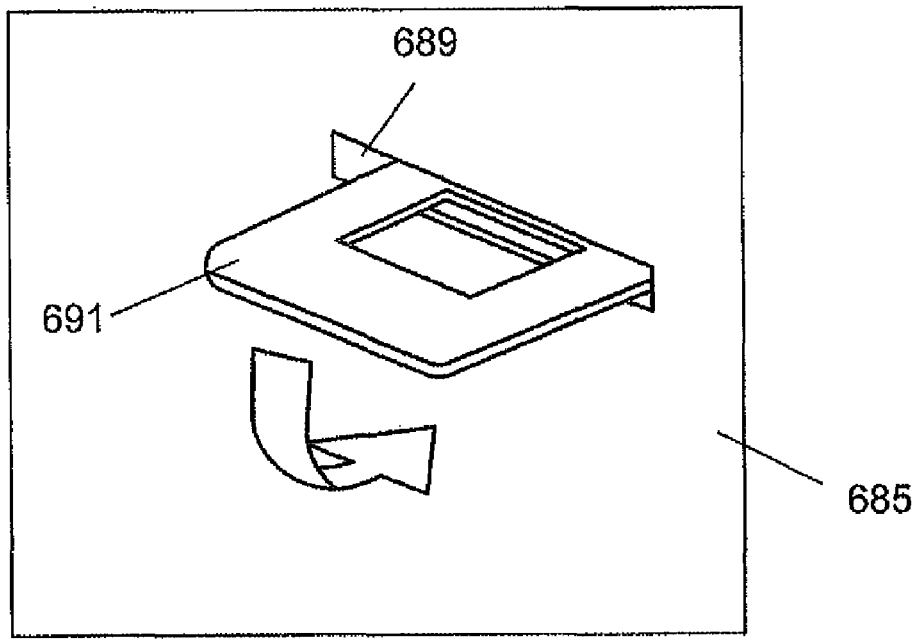
FIG. 37A is a perspective view from the inward side of an appendage of the shelf element of FIG. 35 as it protrudes through a slit formed in the back of the spine member of FIG. 36.

As shown in FIG. 37A, a slit 689 is formed in back 685 of the cabinet. Into each slit 689 is introduced a corresponding appendage 691, so that two appendages for each shelf element that is employed inwardly protrude from back 685.

Figure 37B:
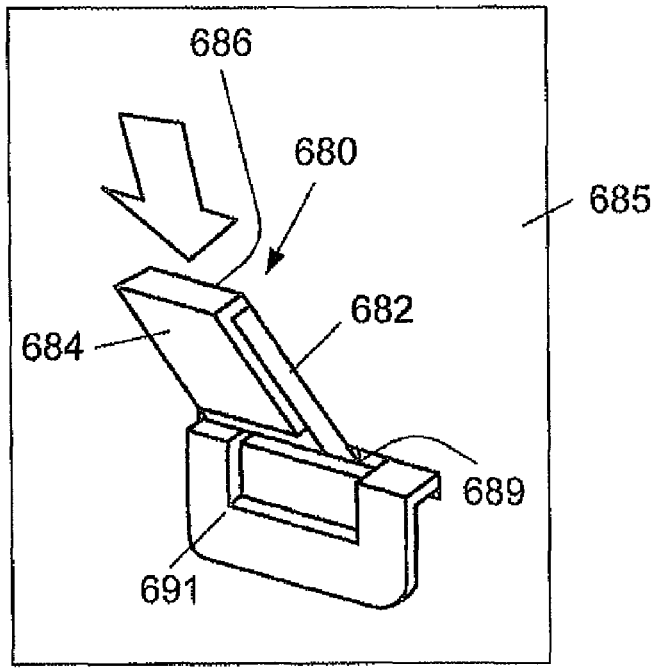
FIGS. 37B and 37C are perspective views from the inward side of the appendage of FIG. 37A, showing the appendage as it is folded onto the back of the spine member and a clip being inserted in the slit and being secured to the appendage.
Figure 37C:
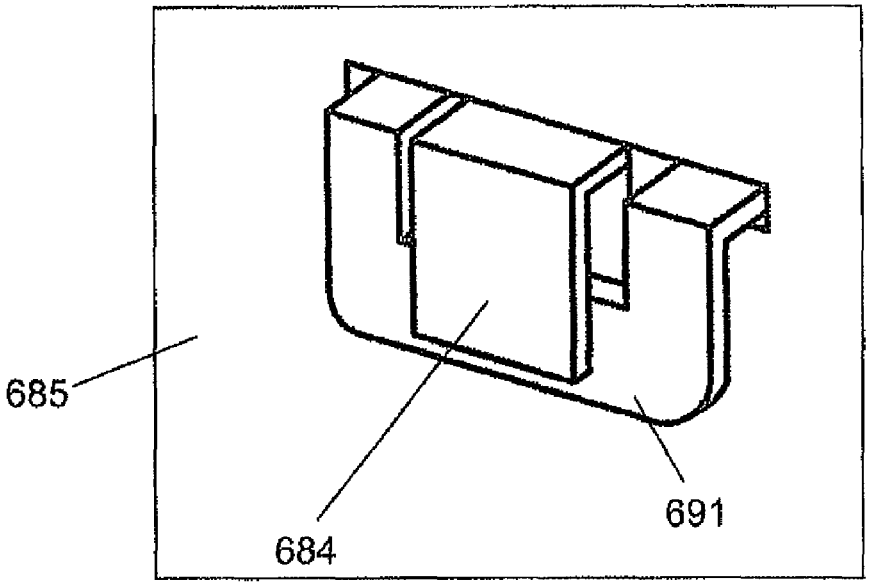

After appendage 691 is folded so as to contact back 685, as shown in FIG. 37B, a clip 680, which may also be made of sheet material, is inserted into slit 689. Clip 680 has two parallel portions 682 and 684, and a portion 686 that extends between the two parallel portions. Portion 682, which may be longer than portion 684, is inserted within slit 689, so that when abutting the inner face of back 685 and lowered, portion 684 engages appendage 691 and presses the same towards back 685, as shown in FIG. 37C.

Figure 36:
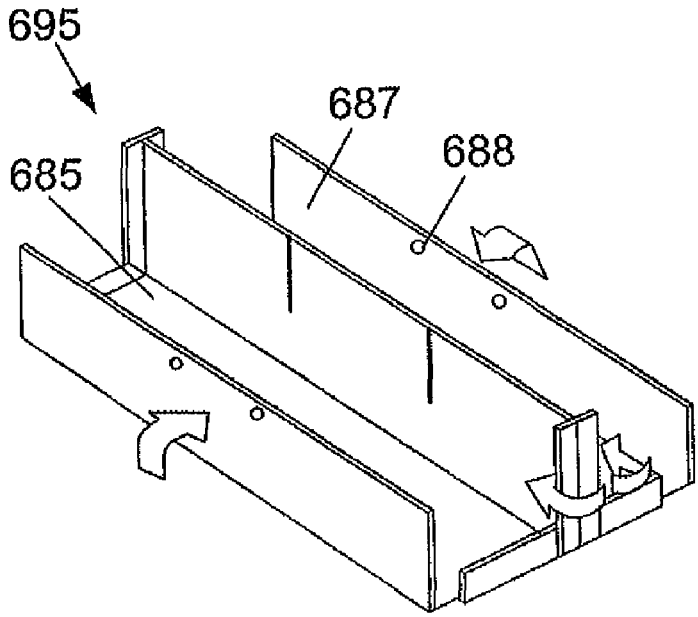
FIG. 36 is a perspective view from the outward side of a spine member, according to an embodiment of the invention.

The back of the cabinet may be fixedly attached to the frame unit since spine member 695 shown in FIG. 36 has an integral back 685 and contact elements 687 that may be interconnected with side walls of the cabinet by fasteners inserted through corresponding apertures 688. The frame unit may be frame unit 545 shown in FIG. 11, or one wherein one or more extensions have expandable flange portions that can be fastened to a contact element 687 for added strength. As back 685 is fixedly attached to the frame unit and shelf elements 690 shown in FIG. 35 are attached to back 685 by means of corresponding clips 680 and add further stability to the cabinet by being interconnected with spine member 695, a cabinet therefore has a significantly improved load bearing capacity.

Figure 38:
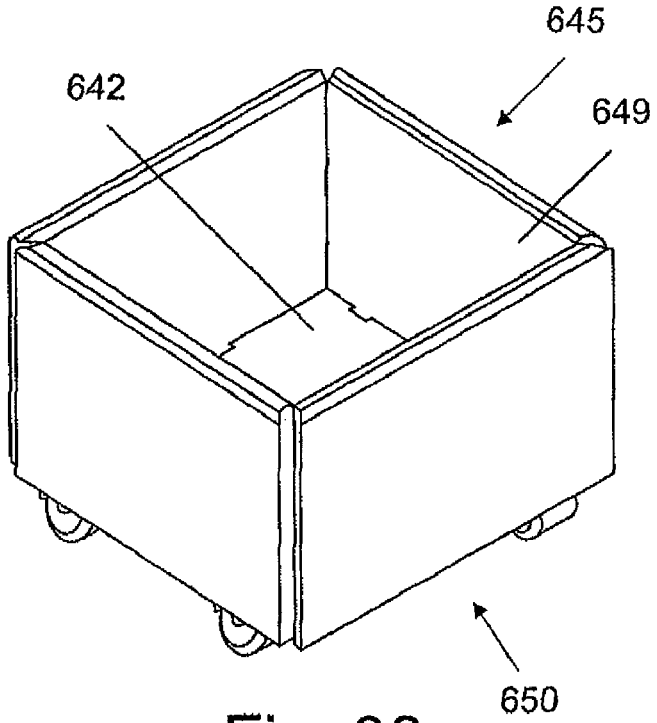
FIG. 38 is a top perspective view of a fully assembled wheeled storage box, according to another embodiment of the invention.

In the embodiment of FIG. 38, a wheeled storage box 645 is produced from a frame unit 650, e.g. a rectangular frame unit, and from an insert 642, in a similar fashion as the assembly method of frame unit 545 illustrated in FIGS. 5-15 and 15, although the exterior members of frame unit 650 are each provided with a single extension 649.

Figure 39:
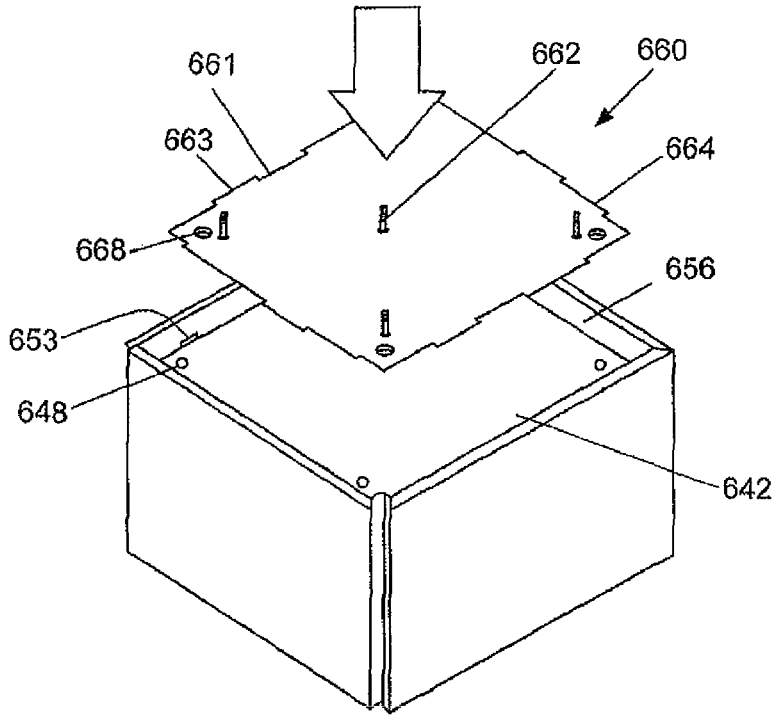
FIG. 39 is a bottom perspective view of the frame unit of the storage box of FIG. 38, showing the engagement of an axle carrying plate therewith.

As shown in FIG. 39, a plate 660, e.g. a substantially rectangular plate, for supporting a plurality of caster wheels is attached to the underside of the central portion of insert 642. The dimensions of the visible periphery of plate 660, as defined by edges 661 and 664, are essentially identical to those of the central portion of insert 642. A plurality of apertures 668, e.g. four, are formed in plate 660, and are aligned with a corresponding number of apertures 648 formed in the central portion of insert 642 by means of a rectangular projection 663 protruding from each visible edge 661 of plate 660 and a similarly shaped aperture 653 for receiving a corresponding projection 663 formed in each inward flap first portion 656. Insert 642 and plate 660 are interconnected by means of male and female fasteners, each of which being introduced in one of the pair of aligned apertures 648 and 663.

Plate 660 may be three-layered, whereby a thin metallic layer is sandwiched between, and affixed to, e.g. adhesively affixed to, two layers made of sheet material. A plurality of downwardly extending axles 662, e.g. five axles, are welded to the metallic layer and the bottom sheet material layer, which may be suitably formed with a set of openings, is fitted over the axles. The metallic layer may be separated into distinct regions, e.g. four regions, so that plate 660 may be folded when all the members of the article are set in the flat condition for compact storage and shipping. The metallic layer is generally not sandwiched within projection 663, to provide sufficient flexibility to allow engagement with corresponding apertures 653.

Figure 40:
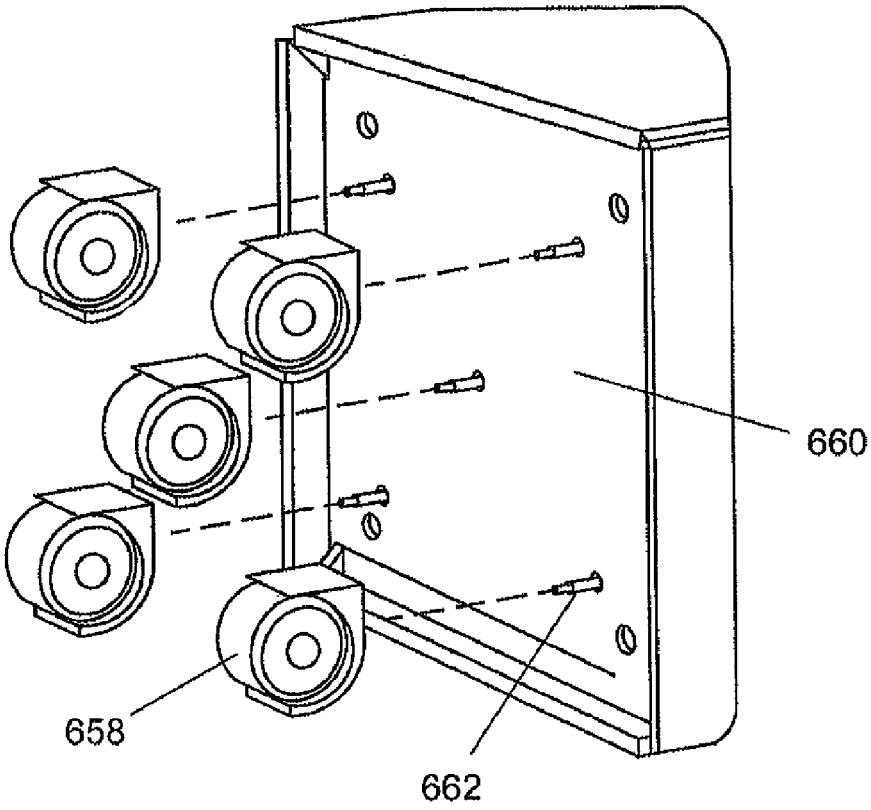
FIG. 40 is a side perspective view from the bottom of the storage box of FIG. 39, showing the coupling of a caster wheel to each axle.

As shown in FIG. 40, a caster wheel 658, or any other type of wheel, is coupled to a corresponding axle 662.

In the embodiment of FIGS. 41-48, a table 645 is produced from a frame unit 630, e.g. a rectangular frame unit, two exterior members of which being provided with divider elements.

Figure 41:
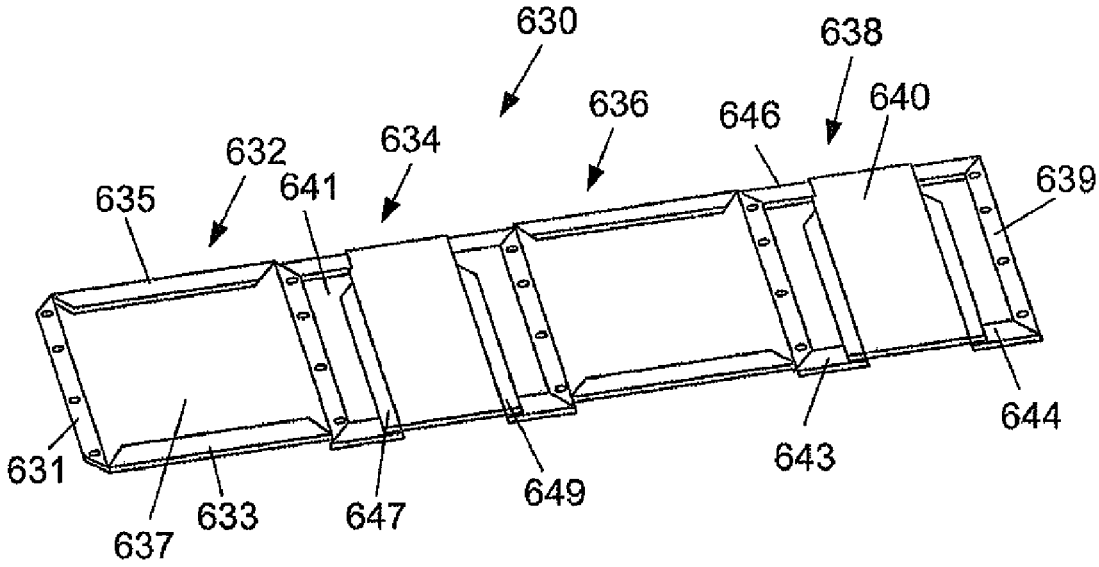
FIG. 41 is a top perspective view of the inner face of interconnected exterior members for assembling a table.

As shown in FIG. 41, an unassembled frame unit 630 comprises interconnected exterior members 632, 634, 636, and 638. Each of members 632 and 636 has two opened side flaps 631 bored with four apertures for the introduction therethrough of corresponding male fasteners, and inward flap 633 and outward flap 635 adhesively affixed to base portion 637 and extending between the two side flaps.

Each of members 634 and 638 has two side flaps 639 in which are embedded female fasteners to be coupled with a corresponding male fastener, a U-shaped base portion 641, two divider elements 640 stacked in a flat condition and overlying the centrally located, rectangular open region of base portion 641, and an outward flap 646 extending between the two side flaps 639. U-shaped base portion 641 may be made of two layers that are adhesively affixed together, and may be provided with border flaps that border the open region. The exterior member may also have spaced inward flaps 643 and 644 that extend between a border flap and a corresponding side flap 639.

A corner reinforcement may be affixed to base portion 641 proximate to each side flap 639 and outward flap 646, to help position a divider element 640 as it is affixed to the base portion. A divider element 640 has two opposed opened side flaps 647 and 649, side flap 647 of one divider element being adhesively affixed to one border element and side flap 649 of the other divider element being adhesively affixed to a second border element. The connection between one of the divider side flaps and a border element may be reinforced by fasteners. A notch 665 (FIG. 44) may be provided between a divider element and the corresponding unattached divider side flap.

Figure 42:
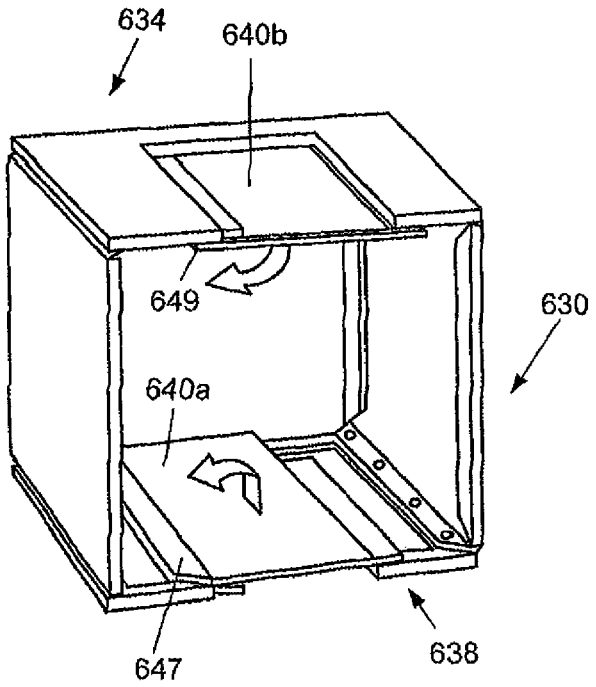
FIG. 42 is a perspective view from the inward side of the interior of a frame unit assembled from the members of FIG. 41.
Figure 43:
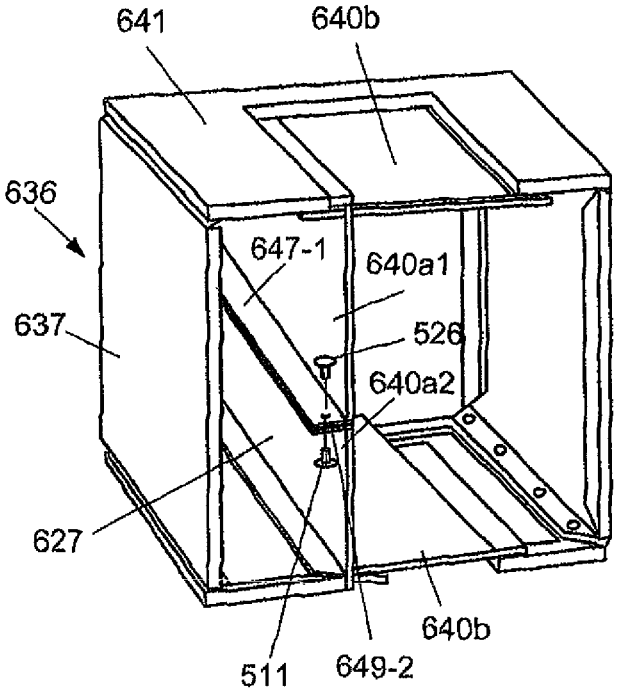
FIG. 43 is a perspective view from the inward side of the interior of the frame unit of FIG. 42, showing a flap of two divider elements being interconnected.

After frame unit 630 is assembled, as shown in FIGS. 42 and 43, the inner divider element 640*a* of each of members 634 and 638 is folded so as to be substantially parallel to base portion 637 of member 636. That is, inner divider element 640*a*1 of member 634 is folded about its side flap 649 and inner divider element 640*a*2 of member 638 is folded about its side flap 647. The unattached divider side flaps 647-1 and 649-2 are folded so as to be perpendicular to the corresponding divider element and facing base portion 637 of member 636, and are then connected together by fasteners 511 and 526. A rectangular shaped interior 627 is defined by the base portion of members 634 and 638, base portion 637 of member 636, and coplanar divider elements 640*a*1 and 640*a*2.

Figure 44:
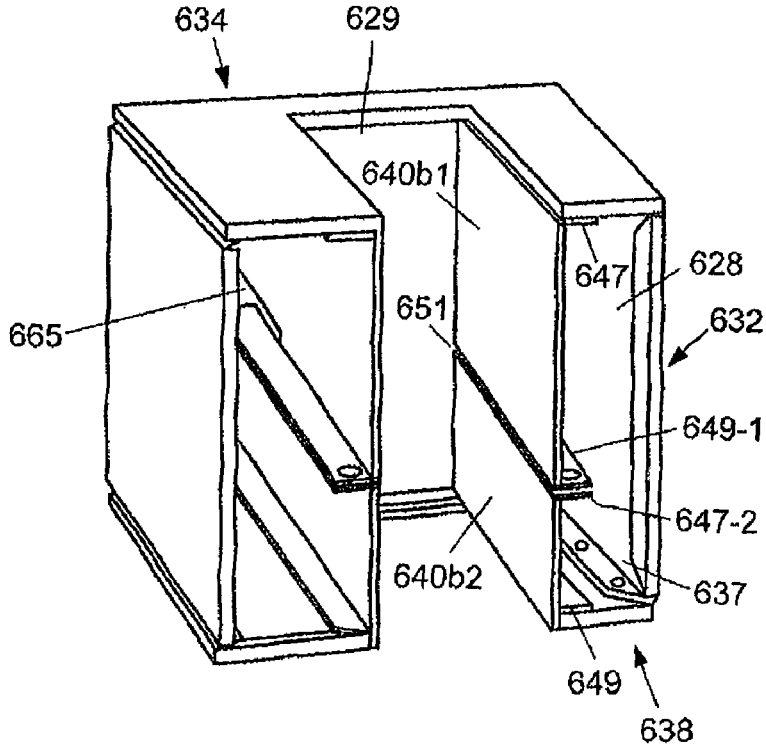
FIG. 44 is a perspective view from the inward side of the interior of the frame unit of FIG. 43, showing a flap of two other divider elements being interconnected.

As shown in FIG. 44, the inner divider element 640*b* of each of members 634 and 638 is folded so as to be substantially parallel to base portion 637 of member 632, thereby exposing an open region 629. That is, inner divider element 640*b*1 of member 634 is folded about its side flap 647 and inner divider element 640*b*2 of member 638 is folded about its side flap 647. The unattached divider side flaps 649-1 and 647-2 are folded so as to be perpendicular to the corresponding divider element and facing base portion 637 of member 632, and are then connected together by fasteners, thereby defining a rectangular interior 628. A void area 651 is produced in the interspace between the folded divider elements 640*b*1 and 650*b*2 and between the folded divider elements 640*a*1 and 650*a*2 shown in FIG. 43.

Figure 45A:
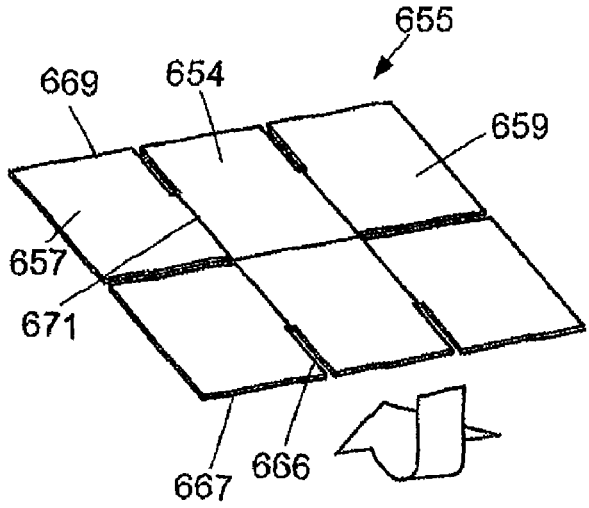
FIG. 45A is a top perspective view of a three portioned stabilizer element in flat condition.
Figure 45B:
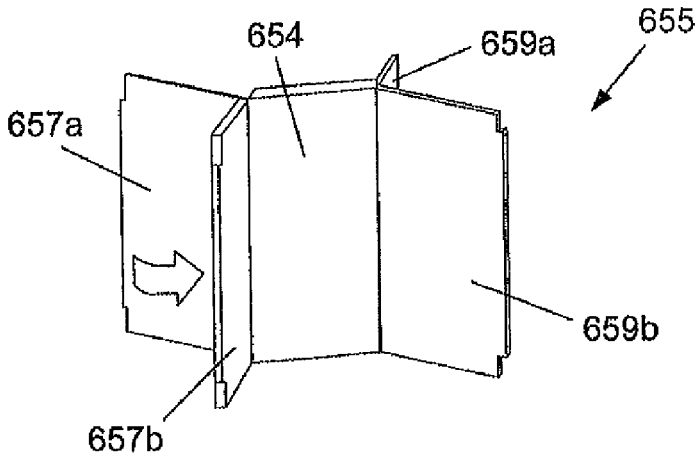
FIG. 45B is a perspective view from the side of the stabilizer element of FIG. 45A in an expanded condition.

A stabilizer element 655, which may be folded during shipping and storage, is illustrated in FIG. 45A. Stabilizer element 655 comprises a thickened middle portion 654 and two expandable side portions 657 and 659, and is formed with a notch 666 along the interface 671 of middle portion 654 and each of side portions 657 and 659. A notch 666 is formed in each interface 671 from inward edge 667, and optionally outward edge 669, of stabilizer element 655 to an intermediate portion thereof. In FIG. 45B, stabilizer element 655 is expanded so that layers 657*a* and 657*b*, as well as layers 659*a* and 659*b*, are separated from each other.

Figure 46:
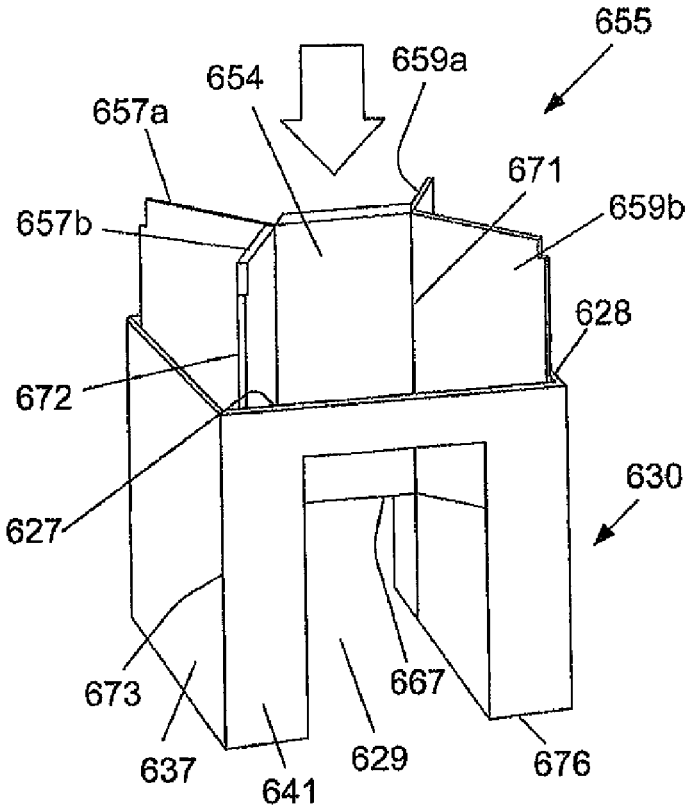
FIG. 46 is a perspective view from the side of the frame unit of FIG. 44, showing the expanded stabilizer unit of FIG. 45B being introduced in its interior.

As shown in FIG. 46, assembled frame unit 630 is set to an upright position and then stabilizer element 655 is brought in frictional engagement therewith. Expanded side portions 657 and 659 of stabilizer element 655 are introduced into side cavities 627 and 628, respectively, of frame unit 630 and middle portion 654 is introduced into central cavity 629. To effect the frictional engagement, a notch 666 (FIG. 45A) of stabilizer element 655 is interconnected with a corresponding notch 665 (FIG. 44) of frame unit 630 while each middle portion interface 671 is received in a corresponding void area 651 (FIG. 44). The width of a stabilizer element side portion is selected so that distal edge 672 of a side portion layer frictionally engages a corresponding corner 673 between base portions 637 and 641. The length of notches 665 and 666 is selected so that inward edges 667 and 676 of stabilizer element 655 and frame unit 639, respectively, will be aligned when stabilizer element 655 is fully introduced into the interior of frame unit 630, as shown in FIG. 47.

Figure 47:
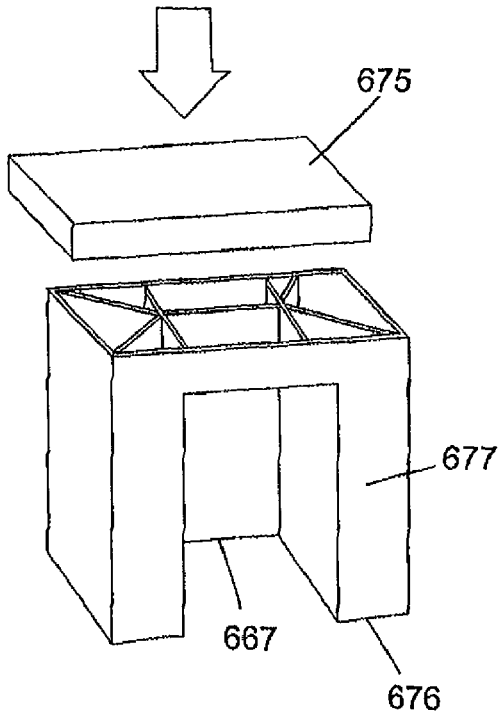
FIG. 47 is a perspective view from the side of the frame unit of FIG. 46, showing a cover unit being secured thereto.

In FIG. 47, a cover unit 675 is secured to the stabilized frame unit 677. Cover unit 675 comprises a reinforcement that is adhesively affixed to a central portion of a sheet in a flat condition, and a two portioned extension extending from each edge of the base portion. A distal portion of one extension is folded onto its corresponding proximal portion. The length of the extension is configured to be longer than the length of the intended cover unit wall, so that the end portions of the double thickness extension can be folded perpendicularly to the intended cover unit wall and be adhesively affixed as a reinforcement to a second intended cover unit wall.

Figure 48:
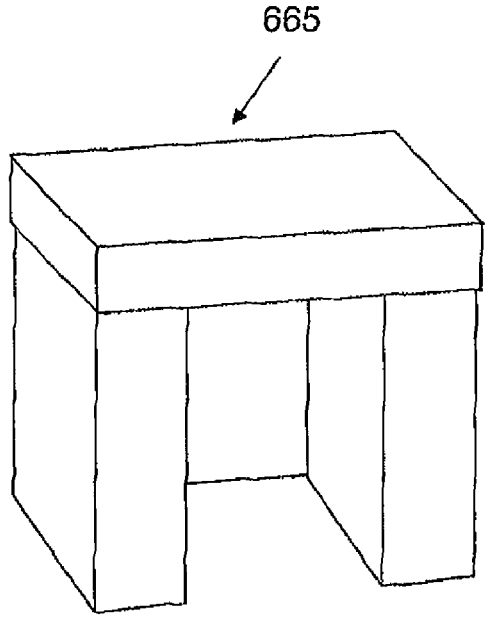
FIG. 48 is a perspective view from the side of a fully assembled table.

FIG. 48 illustrates the fully assembled table 665. Table 665 is sufficiently sturdy so that a user can write on cover unit 675 without experiencing any wobbling motion caused by stabilized frame unit 677. The legs of the user are positioned within open region 629.

In another embodiment of the invention, FIGS. 24-29 illustrate the assembly of a hexagonal stool 625.

Figure 24:
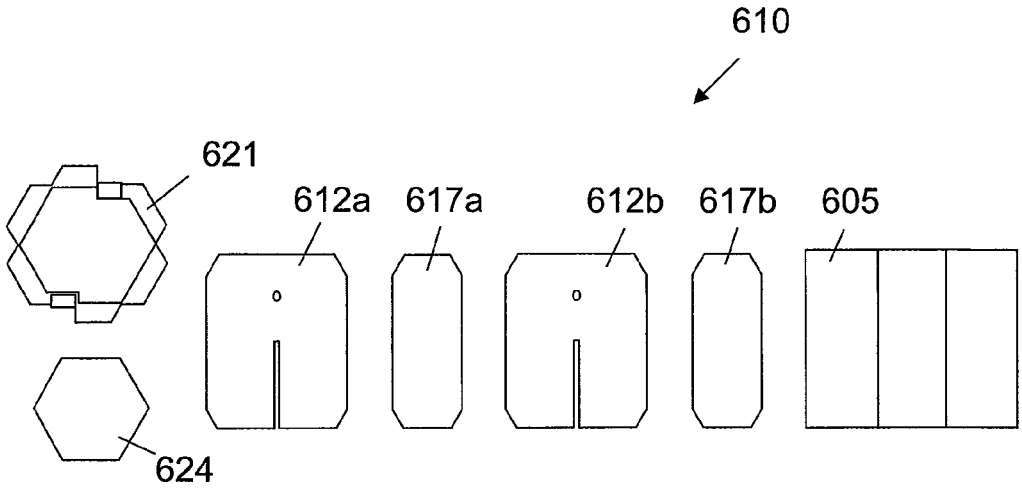
FIG. 24 is a top view of a kit comprising a plurality of members for assembling a stool.
Figure 25:
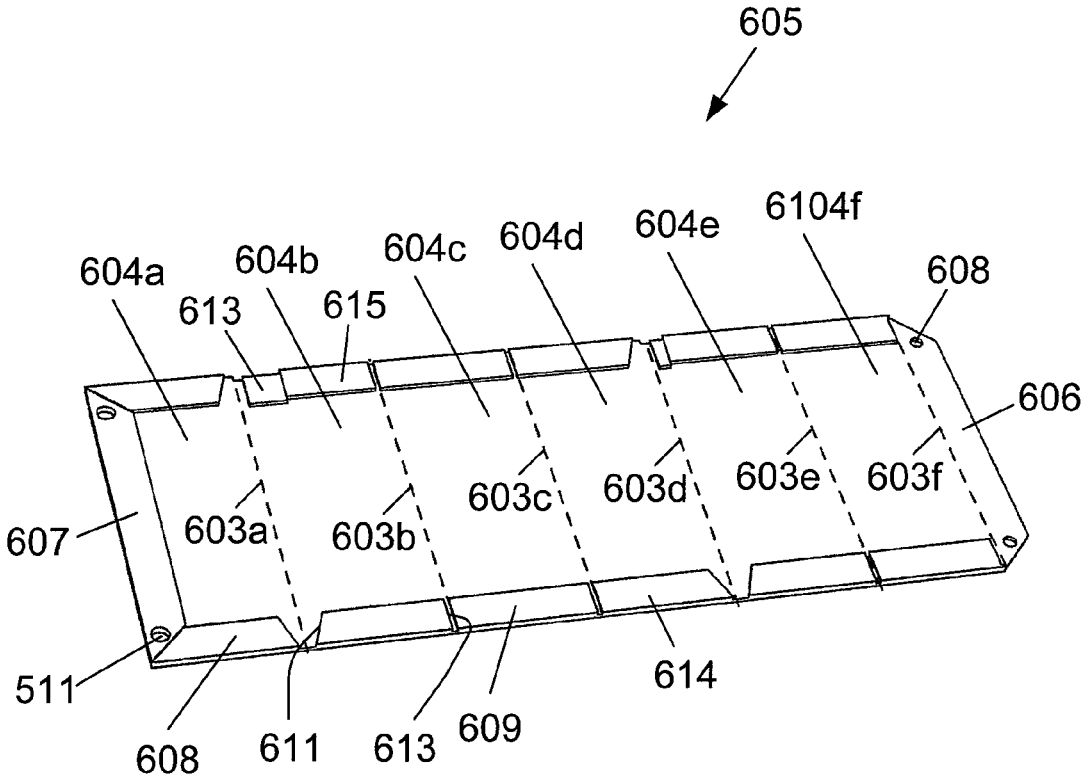
FIG. 25 is a top perspective view of the inner face of a fabricated exterior member frame unit for assembling a stool.

As shown in FIG. 24, the members for assembling the stool, as well as the members of any other embodiment of the invention, may be provided in a kit 610. For increased compactness during storage and shipping, members 605, 612*a-b*, 617*a-b*, 621, and 624 are in a flat condition, and for clarity are shown to be separated one from the other. It will be appreciated, however, that the members are stacked one on the other or placed in abutting relation one next to the other when included in kit 610. For additional compactness, an enlarged severable member containing two or more of members 612*a-b* and 617*a-b* may be provided.

In this embodiment, frame unit 605 comprises a single exterior member having side flap 607 at one longitudinal end in which are embedded female fasteners 513, and an opened side flap 606 provided with apertures 608 through which corresponding male fasteners may be introduced. Frame unit 605 is formed with parallel fold lines 603*a-f* to provide sides 604*a-f*, respectively, that can be set at a different angular disposition. Fold line 603*f* is interposed between side 604*f* and side flap 606. While sides 604*c* and 604*f* are provided with a rectangular flap 609 at their outward and inward edge, side 604*a* is provided with trapezoidal inward and outward flaps 608. Sides 604*b*, 604*d*, and 604*e* are provided with inward flaps 614 having one edge 611 that is oblique to the fold lines and one edge that is parallel to the fold lines. Sides 604*b* and 604*e* are provided with an outward flap 615 having a recessed portion 613. When two oblique edges 611 are facing each other, the two corresponding sides can be completely folded, for compactness during shipping and storage.

Figure 26:
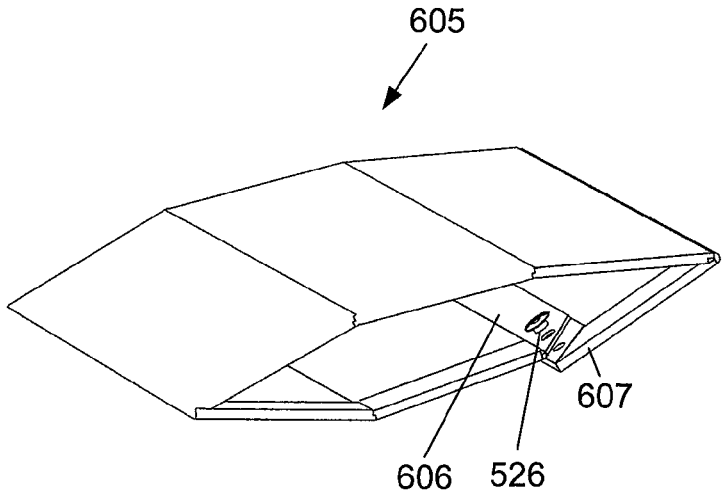
FIG. 26 is a top perspective view of a frame unit being assembled in a substantially flat condition from the member of FIG. 25.

FIG. 26 illustrates a male fastener 526 being introduced through an aperture of side flaps 606 and 607 during the assembly of frame unit 605.

Figure 27:
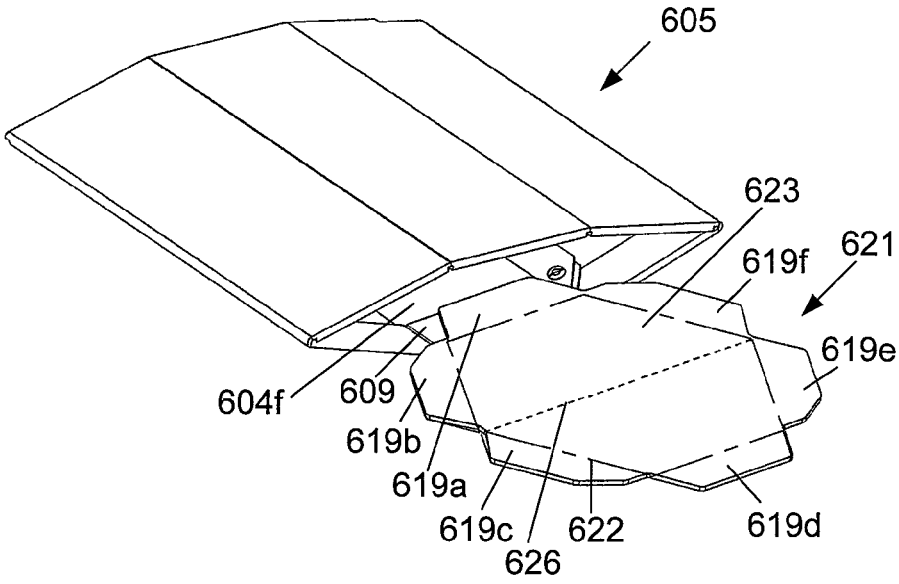
FIG. 27 is a top perspective view of the frame unit of FIG. 26, showing a bottom cover affixed thereto.
Figure 28:
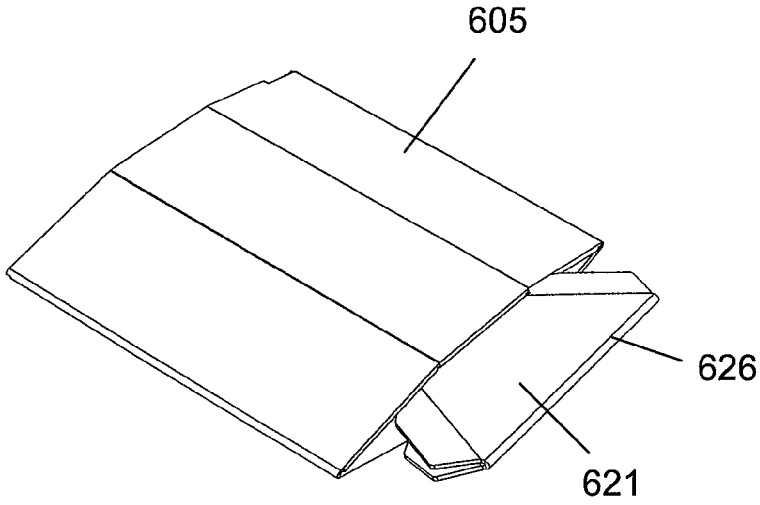
FIG. 28 is a top perspective view of the frame unit of FIG. 27, showing the bottom cover in a flat and folded condition.

In FIG. 27, hexagonal bottom cover 621 is shown to be attached to frame unit 605. Bottom cover has six symmetrically disposed trapezoidal side flaps 619*a-f* that extend from hexagonal base portion 623 and that are foldable along a corresponding fold line 622. Side flap 619*a* is adhesively affixed to inward flap 609 of side 604*f*. A fold line 626 extending between flaps 619*b*, 619*c*, 619*e*, and 619*f* allows bottom cover 621 to be folded and disposed within the interior of a frame unit 605 in a flat condition, as shown in FIG. 28.

Figure 29:
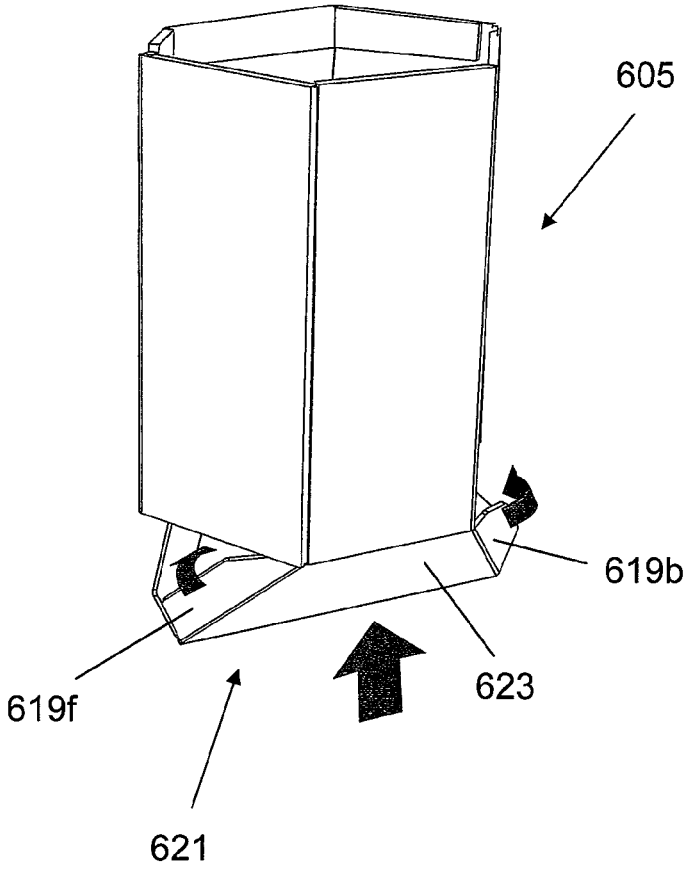
FIG. 29 is a side perspective view of the frame unit and bottom cover of FIG. 27 in an expanded condition, showing side flaps of the bottom cover being introduced within the interior of the frame unit.

FIG. 29 shows frame unit 605 and bottom cover 621 in an expanded condition. Side flaps 619*b* and 619*f*, for example, are shown to be introduced into the interior of frame unit 605.

Figure 30:
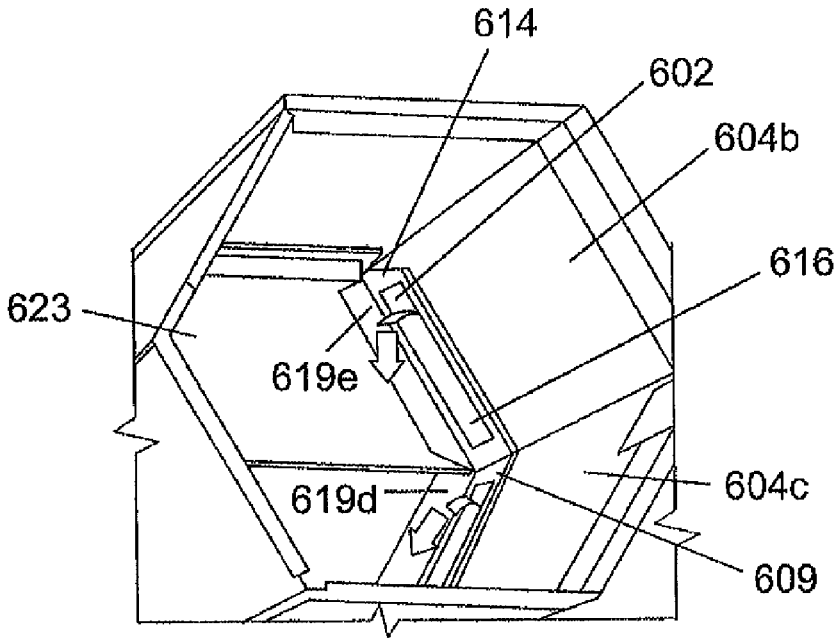
FIG. 30 is a top perspective view of the interior of the frame unit of FIG. 29, showing flaps of the frame unit being adhesively affixed to flaps of the bottom cover.

As shown in FIG. 30, the side flaps 619*b-f* are then folded onto base portion 623 of the bottom cover. The inward flaps of frame unit 605, e.g. the illustrated flaps 609 and 614 of sides 604*b* and 604*c*, respectively, are provided with a peelable protective layer 616, which when peeled, reveals an adhesive layer 602. The inward flaps of frame unit 605 are then folded so that each adhesive layer 602 is affixed to a corresponding folded side flap of the bottom cover.

Figure 31:
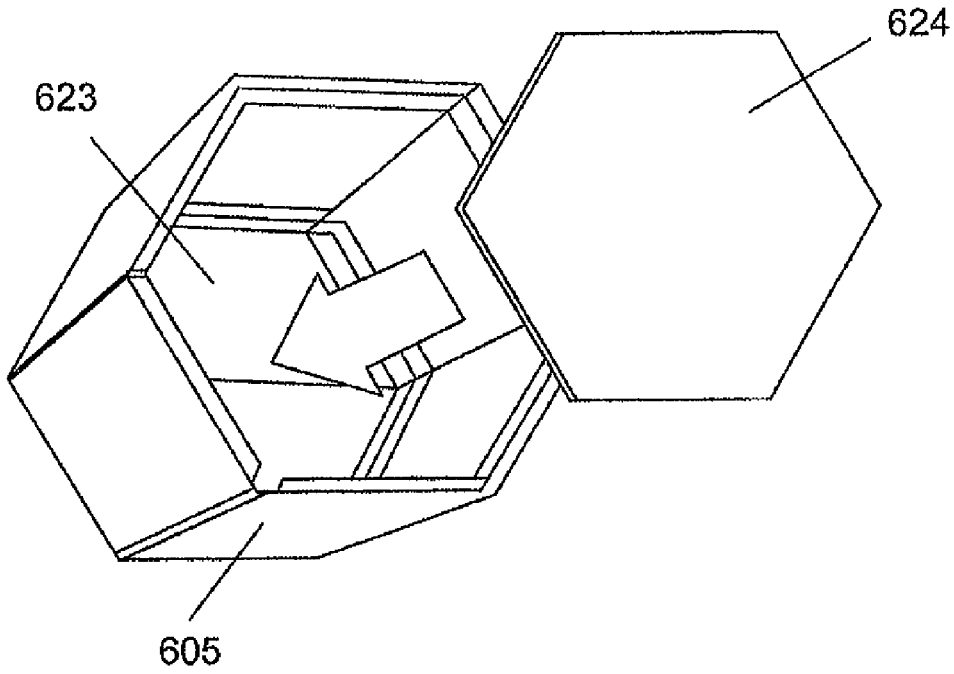
FIG. 31 is a top perspective view of the interior of the frame unit of FIG. 30, showing a reinforcement being introduced into the interior of the frame unit.

In FIG. 31, hexagonal reinforcement 624 is introduced into the interior of frame unit 605 and placed on base portion 623 of the bottom cover.

Figure 32:
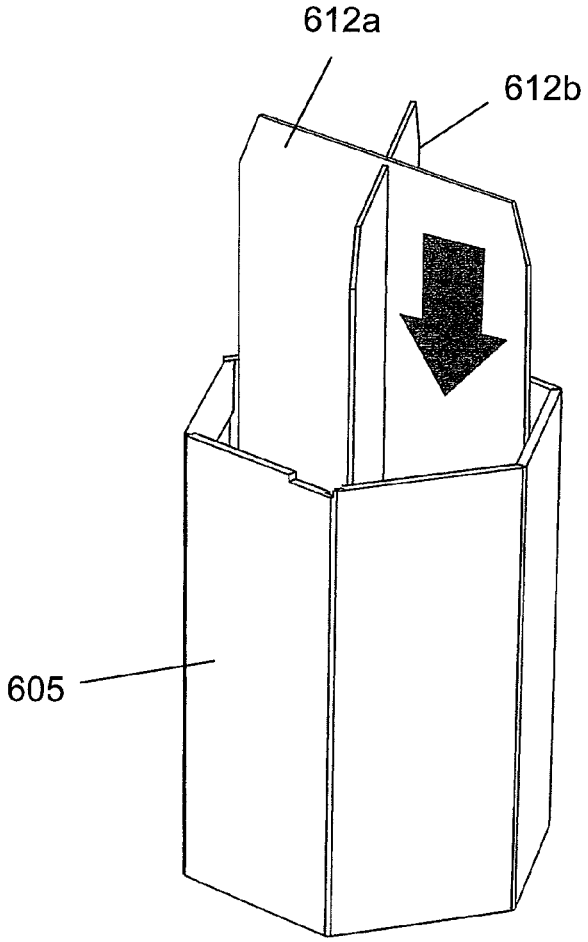
FIG. 32 is a side perspective view of the frame unit of FIG. 31, showing interconnected stabilizing elements being introduced into the interior of the frame unit.
Figure 33:
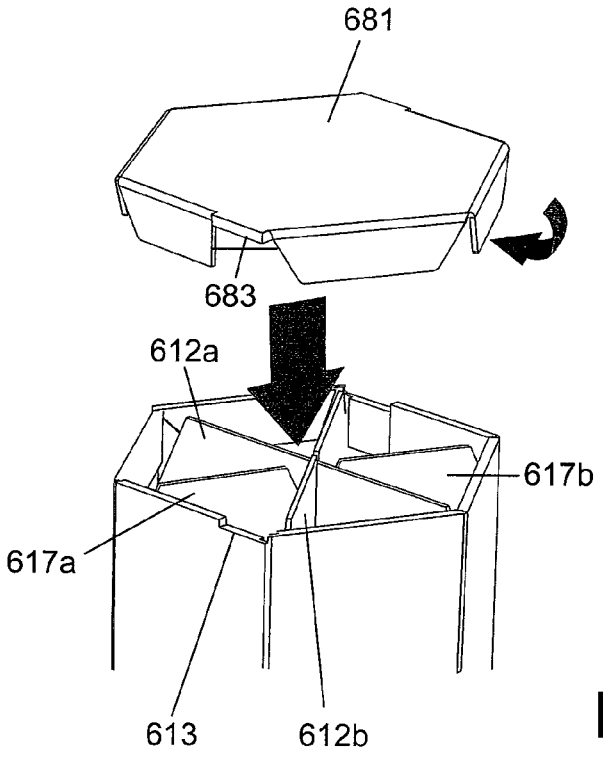
FIG. 33 is a side perspective view of a stabilized frame unit, showing a top cover being secured thereto.
Figure 34:
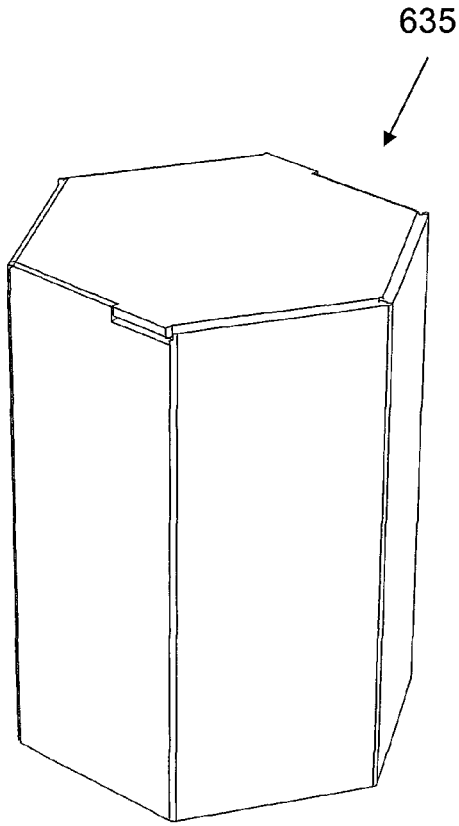
FIG. 34 is a side perspective view of a fully assembled stool.

In FIG. 32, stabilizer elements 612*a* and 612*b* are interconnected and introduced into the interior of frame unit 605, to frictionally engage corresponding sides of the frame unit. As shown in FIG. 33, opposed stabilizer elements 617*a* and 617*b* are then introduced into the interior of frame unit 605 so as to frictionally engage a junction of stabilizer elements 612*a* and 612*b* and an interface of two frame unit sides. A top cover 681 is then secured to the stabilized frame unit such that recessed portion 683 of top cover 681 is aligned with recessed portion 613 of the frame unit, to produce a fully assembled stool 635, as shown in FIG. 34. Stool 635 is sufficiently structurally strong to support an adult person when standing thereon.

While some embodiments of the invention have been described by way of illustration, it will be apparent that the invention can be carried out with many modifications, variations and adaptations, and with the use of numerous equivalents or alternative solutions that are within the scope of persons skilled in the art, without departing from the spirit of the invention or exceeding the scope of the claims.

The invention claimed is:

1. A three-dimensional article produced from sheet material, comprising a frame unit defining an interior and having a plurality of outer sides made of sheet material each having a different angular disposition, wherein first and second longitudinal ends of said frame unit are interconnected by means of a female fastener embedded in said first longitudinal end and a male fastener introduced through said second longitudinal end and coupled with said female fastener, wherein the first longitudinal end of the frame unit comprises a first side flap formed with at least one first aperture, said first side flap being folded and affixed to a base portion of a frame unit side such that said female fastener when placed on a predetermined region of said base region is embedded within said side flap while being accessible to said male fastener by means of a corresponding aperture, wherein the second longitudinal end of the frame unit comprises a second side flap formed with at least one aperture, said second side flap remaining in an opened position while its at least one second aperture is aligned with said at least one first aperture and said male fastener introduced through said at least one second aperture is coupled with a corresponding embedded female fastener, whereby to form a reinforced connection, the frame unit further comprising a plurality of exterior members, each of which is interconnected by means of a reinforced connection, wherein each exterior member comprises a base portion, a flap inwardly extending from said base portion, and at least one extension outwardly extending from said base portion and provided with a single projection protruding from an outward edge thereof, a first portion of said inward flap being adhesively affixed to said base portion and a second portion of said inward flap being foldable perpendicularly to said base portion.

2. The article according to claim 1, wherein at least one expanded stabilizing element is frictionally engaged with inner faces of the frame unit, for increasing the structural strength of the three-dimensional article.

3. The article according to claim 1, wherein the reinforced connection protrudes from an inner side of the frame unit.

4. The article according to claim 1, further comprising an insert made of the sheet material, the insert being located within the interior of the frame unit and contacting each inward flap second portion of the frame unit.

5. The article according to claim 4, further comprising a reinforcement adhesively attached to the base portion of each exterior member, an outwardly folded peripheral element of the insert being positioned within spacing between said reinforcement and a corresponding inward flap second portion.

6. The article according to claim 4, wherein a plurality of apertures are formed in the insert and the extension of each exterior member is inwardly folded until the projection protruding from its outward edge engages a corresponding aperture formed in the insert, thereby concealing a corresponding reinforced connection.

7. The article according to claim 1, wherein a first exterior member comprises two side flaps that are folded and adhesively affixed to the base portion, two female fasteners being embedded in each side flap and being accessible via a corresponding aperture formed therein, and a second exterior member comprises two side flaps each of which are in an opened position and bored with two apertures, a male fastener introduced through a side flap aperture of said second exterior member being coupled with a corresponding female fastener embedded within said first exterior member to form a reinforced connection.

8. The article according to claim 1, wherein each exterior member comprises a first side flap that is folded and adhesively affixed to the base portion, two female fasteners being embedded in said first side flap, and a second side flap that is opened and bored with two apertures, a male fastener introduced through a second side flap aperture of a first exterior member being coupled with a corresponding female fastener embedded within a first side flap of a second exterior member to form a reinforced connection.

9. A three-dimensional article produced from sheet material, comprising a frame unit having a plurality of outer sides made of sheet material each of having a different angular disposition, wherein first and second longitudinal ends of said frame unit are interconnected by means of a female fastener embedded in said first longitudinal end and a male fastener introduced through said second longitudinal end and coupled with said female fastener, wherein at least one expanded stabilizing element is frictionally engaged with inner faces of the frame unit, for increasing the structural strength of the three-dimensional article, and wherein two stabilizing elements are interconnected by means of a notch formed in each of said two stabilizing elements.

10. The article according to claim 9, which is a cabinet, wherein a first stabilizing element is a spine member and a second stabilizing element is a shelf element, a web of said spine member being formed with a plurality of parallel notches formed only in an outward region of said spine member web by means of each of which a web of a corresponding shelf element is interconnected, expanded flange portions of said spine member and said corresponding shelf element being frictionally engaged with corresponding inner faces of the frame unit.

11. The article according to claim 10, wherein a cabinet back is formed with a plurality of apertures and each exterior member of the frame unit comprises an extension outwardly extending from an inner face of the cabinet back and provided with a single projection protruding from an outward edge thereof, said extension being inwardly foldable until pressingly contacting a corresponding frictionally engaged flange portion and the projection thereof engages a corresponding aperture formed in the cabinet back.

12. The article according to claim 10 which comprises a plurality of second stabilizing elements which are shelf elements, wherein each shelf element comprises two U-shaped appendages that protrude from an inward edge thereof, said appendages being adapted to be introduced in corresponding slits formed in a cabinet back and foldable so as to contact said back, a clip having two parallel portions being insertable in a slit such that one of said parallel portions pressingly contacts a corresponding folded appendage.

13. The article according to claim 1, which is selected from the group consisting of cabinet, table, storage box, wheeled storage box stool, doll house, chair, trunk, bench, wine holder, and file holder.

14. A kit for assembling a three-dimensional article, comprising a plurality of separate members made from sheet material and set in a flat condition, including one or more first members configured with a side flap in which is embedded at least one accessible female fastener and one or more second members configured with a side flap in an opened position formed with at least one aperture, wherein a male fastener introduced through an aperture of the opened side flap of a second member is coupleable with a corresponding and aligned embedded female faster of a first member, so that when a plurality of said first and second members are serially interconnected such that each of which has a different angular disposition a frame unit is formed, wherein a first or second member comprises a U-shaped base portion, two divider elements stacked in a flat condition and overlying a centrally located, rectangular open region of said base portion, border flaps that border said open region, a foldable side flap extending from a first divider element adhesively affixed to a first border flap, and a foldable side flap extending from a second divider element adhesively affixed to a second border flap, wherein said first and second divider elements are foldable so as to be perpendicular to said base portion and unattached side flaps of each of said first and second divider elements being interconnectable with corresponding unattached side flaps of folded divider elements of an opposed member of the frame unit.

15. The kit according to claim 14, wherein one or more third members are stabilizing elements frictionally engageable, when expanded, with corresponding inner faces of the frame unit.

* * * * *